US007471264B2

(12) United States Patent
Inoue et al.

(10) Patent No.: US 7,471,264 B2
(45) Date of Patent: Dec. 30, 2008

(54) PLASMA DISPLAY PANEL DRIVER AND PLASMA DISPLAY

(75) Inventors: Manabu Inoue, New Paltz, NY (US); Satoshi Ikeda, Suita (JP); Yasuhiro Arai, Katano (JP); Toshikazu Nagaki, Hirakata (JP); Hideki Nakata, Katano (JP); Jumpei Hashiguchi, Kyoto (JP); Fumito Kusama, Takatsuki (JP)

(73) Assignee: Panasonic Corporation, Osaka (JP)

( * ) Notice: Subject to any disclaimer, the term of this patent is extended or adjusted under 35 U.S.C. 154(b) by 526 days.

(21) Appl. No.: 11/098,731

(22) Filed: Apr. 4, 2005

(65) Prior Publication Data

US 2005/0285820 A1 Dec. 29, 2005

Related U.S. Application Data

(63) Continuation-in-part of application No. 11/049,564, filed on Feb. 2, 2005.

(30) Foreign Application Priority Data

Apr. 15, 2004 (JP) ..... 2004-119992
Dec. 24, 2004 (JP) ..... 2004-374528

(51) Int. Cl.
*G09G 3/28* (2006.01)

(52) U.S. Cl. ..... 345/60; 315/169.4

(58) Field of Classification Search ..... 345/55, 345/60–72; 315/169.4
See application file for complete search history.

(56) References Cited

U.S. PATENT DOCUMENTS

| | | | | |
|---|---|---|---|---|
| 4,866,349 | A | 9/1989 | Weber et al. | |
| 6,195,072 | B1 | 2/2001 | Iwami et al. | |
| 6,525,486 | B2 * | 2/2003 | Awamoto et al. | 315/169.4 |
| 6,628,087 | B2 * | 9/2003 | Roh et al. | 315/169.3 |
| 7,006,057 | B2 | 2/2006 | Jin et al. | |
| 2002/0186184 | A1 * | 12/2002 | Lim | 345/60 |
| 2003/0057851 | A1 | 3/2003 | Roh et al. | |
| 2004/0085262 | A1 * | 5/2004 | Lee | 345/41 |
| 2005/0231440 | A1 * | 10/2005 | Inoue et al. | 345/60 |

FOREIGN PATENT DOCUMENTS

| | | |
|---|---|---|
| JP | 2000-293135 | 10/2000 |
| JP | 2003-15600 | 1/2003 |
| JP | 2004-13168 | 1/2004 |

OTHER PUBLICATIONS

Chinese Office Action dated Jan. 25, 2008 with English translation.

* cited by examiner

*Primary Examiner*—Alexander Eisen
*Assistant Examiner*—Jason M Mandeville
(74) *Attorney, Agent, or Firm*—Pearne & Gordon LLP

(57) ABSTRACT

A reset pulse generating section applies the total of voltages of a positive voltage source and two constant-voltage sources from a high side ramp wave generating section to a high side scan switching device as the upper limit of a reset voltage pulse, and applies the ground potential from a low side ramp wave generating section to a low side scan switching device as the lower limit of the reset voltage pulse. A sustaining pulse generating section applies the upper and lower limits of a sustaining voltage pulse through a common sustaining pulse transmission path to the low side scan switching device.

23 Claims, 26 Drawing Sheets

PLASMA DISPLAY PANEL DRIVER AND PLASMA DISPLAY

This application is a Continuation-In-Part of U.S. application Ser. No. 11/049,564, filed Feb. 2, 2005.

BACKGROUND OF THE INVENTION

This invention relates to a driver of a plasma display panel (PDP).

Plasma displays are display devices using a light emission phenomenon caused by a discharge in gas. Screens of the plasma displays, that is, plasma display panels (PDPs) have advantages in upsizing, slimming-down, and widening of viewing angles over other display devices. PDPs are broadly divided into DC and AC types that operate on DC and AC pulses, respectively. The AC-type PDPs have, in particular, higher brightness and a simpler structure. Accordingly, the AC-type PDPs are suitable for mass production and improvement in a high pixel resolution, and therefore, extensively used.

An AC-type PDP comprises, for example, the three-electrode surface-discharge type structure. See, for example, Published Japanese patent application 2004-13168 gazette. In the structure, address electrodes are arranged on the rear substrate in the vertical direction of the panel, and sustain and scan electrodes are alternately arranged on the front substrate in the horizontal direction of the panel. In general, the scan electrodes separately allow individual potential changes, and the address electrodes do so.

A discharge cell is installed at the intersection of an adjacent pair of sustain and scan electrodes and an address electrode. On the surface of the discharge cell, a layer of dielectric material (a dielectric layer), a layer protecting the electrodes and the dielectric layer (a protection layer), and a layer including phosphor (a phosphor layer) are laminated. The inside of the discharge cell is filled with gas. The gas molecules ionize and emit ultraviolet rays when the applications of voltage pulses between the sustain, scan, and address electrodes cause electric discharges in the discharge cells. The ultraviolet rays excite the phosphors on the surfaces of the discharge cell, and then, cause them to emit fluorescence. Thus, the discharge cells glow.

A PDP driver controls the potentials of the sustain, scan, and address electrodes under the ADS (Address Display-period Separation) scheme. The ADS scheme is a kind of the sub-field scheme where one field of image is divided into a plurality of sub-fields. Each sub-field includes reset, address, and sustain periods. Under the ADS scheme, in particular, the three periods are provided in common for all the discharge cells of a PDP. See, for example, Published Japanese patent application 2004-13168 gazette.

During the reset period, a reset voltage pulse is applied between the sustain and scan electrodes. Thereby, wall charges are evened among all the discharge cells.

During the address period, scan voltage pulses are applied to the scan electrodes in sequence, and address voltage pulses are applied to some of the address electrodes. The address electrodes to be provided with the address voltage pulses are selected based on the video signal received from the outside. A discharge in gas occurs in the discharge cell located at the intersection of the scan electrode provided with the scan voltage pulse and the address electrode provided with the address voltage pulse. As a result of the discharge, wall charges accumulate on the surfaces of the discharge cell.

During the sustain period, the sustain voltage pulses are periodically and simultaneously applied to all the pairs of the sustain and scan electrodes. At that time, in the discharge cells where the wall charges have accumulated during the address period, the gas discharges are sustained, and accordingly, the discharge cells glow. The durations of the sustain periods vary among the sub-fields, and therefore, a light emission time per field of the discharge cell, that is, the brightness of the discharge cell is adjusted by the selection of a sub-field in which the discharge cell should glow.

FIG. 24 is an equivalent circuit diagram showing scan and sustain electrode driver sections 110 and 120 of a conventional PDP driver and a PDP 20. See, for example, Published Japanese patent application 2003-15600 gazette. Here, the equivalent circuit of the PDP 20 is represented only by a stray capacitance-Cp between the sustain and scan electrodes X and Y, which is hereafter referred to as a panel capacitance of the PDP 20. A path of the current flowing through the PDP 20 at the discharges in the discharge cells is omitted.

In the reset, address, and sustain periods, the potentials of the scan, sustain, and address electrodes Y, X, and A of the PDP 20 change as follows. See FIG. 25. The hatched areas shown in FIG. 25 represent the ON periods of the switching devices Q1, Q2, QS, QR1, QR2, SA1, SA2, SC1, SC2, Q1X, and Q2X, shown in FIG. 24.

During the reset period, in the scan electrode driver section 110, a scan pulse generating section 111 maintains a low side scan switching device SC2 in the ON state. A reset pulse generating section 112 applies a reset voltage pulse through the low side scan switching device SC2 to the scan electrode Y. In the sustain electrode driver section 120, at the same time, a second sustaining pulse generating section 123 applies a reset voltage pulse to the sustain electrode X. Thereby, potentials of the scan and sustain electrodes Y and X change. On the other hand, the address electrode A is maintained at the ground potential (nearly equal to 0).

According to the change of the reset voltage pulse, the reset period is divided into the following six modes I-VI.

<Mode I>

In the scan electrode driver section 110, the first low side sustain switching device Q2, the separation switching device QS, the low side auxiliary switching device SA2, and the low side scan switching device SC2 are maintained in the ON state. In the sustain electrode driver section 120, the second low side sustain switching device Q2X is maintained in the ON state. The remainder of the switching devices are maintained in the OFF state. Thereby, both the scan and sustain electrode Y and X are maintained at the ground potential.

<Mode II>

In the scan electrode driver section 110, the first low side sustain switching device Q2 is turned off, and the first high side sustain switching device Q1 is turned on. Thereby, the potential of the scan electrode Y rises to the potential Vs of the external power supply Es. In the sustain electrode driver section 120, the ON and OFF states of all the switching devices are maintained as they are. Thereby, the sustain electrode X is maintained at the ground potential.

<Mode III>

In the scan electrode driver section 110, the separation switching device QS is turned off, and the high side ramp wave generating section QR1 is turned on. Thereby, the potential of the scan electrode Y rises at a constant rate from the potential Vs of the external power supply Es to the upper limit Vr of the reset voltage pulse. In the sustain electrode driver section 120, the ON and OFF states of all the switching devices are maintained as they are. Thereby, the sustain electrode X is maintained at the ground potential. Thus, the voltages applied to all the discharge cells of the PDP 20 uniformly rise to the upper limit Vr of the reset voltage pulse. Thereby, uniform wall charges accumulate in all the discharge cells of the PDP 20.

The upper limit Vr of the reset voltage pulse must be high enough for making wall charges uniform in all the discharge cells of the PDP 20 in the reset period. Accordingly, the upper limit Vr of the reset voltage pulse is set, in general, higher than the potential Vs of the external power supply Es.

In mode III, the potential exceeds the potential Vs of the external power supply Es on a path from the separation switching device QS through the low side scan switching device SC2 to the node J of the series connection 1S of the two scan switching devices SC1 and SC2. See FIG. 24. On the other hand, the separation switching device QS is turned off, and the current to flow from the low side scan switching device SC2 to the output terminal J1 of the first sustaining pulse generating section 113 (the node between the two sustain switching devices Q1 and Q2) is cut off. Thereby, the reset voltage pulse rises reliably to the upper limit Vr, without being clamped by the body diode of the first high side sustain switching device Q1 to the potential Vs of the external power supply Es.

<Mode IV>

In the scan electrode driver section 110, the high side ramp wave generating section QR1 is turned off, and the separation switching device QS is turned on. Thereby, the potential of the scan electrode Y falls to the potential Vs of the external power supply Es. In the sustain electrode driver section 120, the ON and OFF states of all the switching devices are maintained as they are. Thereby, the sustain electrode X is maintained at the ground potential.

<Mode V>

In the scan electrode driver section 110, the ON and OFF states of all the switching devices are maintained as they are. Thereby, the scan electrode Y is maintained at the potential Vs of the external power supply Es. In the sustain electrode driver section 120, the second low side sustain switching device Q2X is turned off, and the second high side sustain switching device Q1X is turned on. Thereby, the potential of the sustain electrode X rises to the potential Vs of the external power supply Es.

<Mode VI>

In the scan electrode driver section 110, the first high side sustain switching device Q1 is turned off, and the low side ramp wave generating section QR2 is turned on. Thereby, the potential of the scan electrode Y falls at a constant rate to the ground potential. In the sustain electrode driver section 120, the ON and OFF states of all the switching devices are maintained as they are. Thereby, the sustain electrode X is maintained at the potential Vs of the external power supply Es. Accordingly, the voltage opposite in polarity to the voltages applied in the modes II-V is applied to the discharge cells of the PDP 20. Thereby, the wall charges are uniformly eliminated and evened in all the discharge cells.

During the address period, in the sustain electrode driver section 120, the second high side sustain switching device Q1X is maintained in the ON state. The remainder of the switching devices are maintained in the OFF state. Thereby, the sustain electrode X is maintained at the potential Vs of the external power supply Es. In the scan electrode driver section 110, the first low side sustain switching device Q2, the separation switching device QS, and the high side auxiliary switching device SA1 are maintained in the ON state. Accordingly, one end of the series connection 1S of the scan switching devices SC1 and SC2 is maintained at a potential Vp=V1 higher than the ground potential by the voltage V1 of the first constant-voltage source E1 (the potential Vp is hereafter referred to as the upper limit of the scan voltage pulse), and the other end of the series connection 1S is maintained at the ground potential.

At the start of the address period, for all the scan electrodes Y, the high- and low-side scan switching devices SC1 and SC2 are maintained in the ON and OFF states, respectively. Thereby, the potentials of all the scan electrodes Y are uniformly maintained at the upper limit Vp of the scan voltage pulse. Next, the scan electrode driver section 110 changes the potentials of the scan electrodes Y as follows. See the scan voltage pulse SP shown in FIG. 25. When one Y of the scan electrodes is selected, the high- and low-side scan switching devices SC1 and SC2 connected to the scan electrode Y are turned off and on, respectively. Thereby, the potential of the scan electrode Y falls to the ground potential. When the scan electrode Y is maintained at the ground potential for a predetermined time, the low and high side scan switching device SC2 and SC1 connected to the scan electrode Y are turned off and on, respectively. Thereby, the potential of the scan electrode Y rises to the upper limit Vp of the scan voltage pulse. The scan electrode driver section 110 performs the switching operation similar to the above-described one, for the series connections 1S of the scan switching devices SC1 and SC2 connected to the respective scan electrodes one after another. Thus, the scan voltage pulses SP are applied to the respective scan electrodes in sequence.

During the address period, one A of the address electrode is selected based on the video signal received from the outside, and the potential of the selected address electrode A rises to the upper limit Va of the signal voltage pulse for a predetermined time. For example, when the scan voltage pulse SP is applied to one Y of the scan electrodes and the signal voltage pulse Va is applied to one A of the address electrodes, as shown in FIG. 25, the voltage between the scan and address electrodes Y and A is higher than the voltages between other electrodes. Accordingly, an electric discharge occurs in the discharge cell located at the intersection between the scan and address electrodes Y and A. New wall charges accumulate on the surfaces of the discharge cell because of the electric discharge.

During the sustain period, in the scan electrode driver section 110, the scan pulse generating section 111 maintains the low side scan switching device SC2 in the ON state, and the reset pulse generating section 112 maintains the separation switching device QS in the ON state. The first sustaining pulse generating section 113 turns on the two sustain switching devices Q1 and Q2 alternately. Thereby, the potential of the scan electrode Y changes between the potential Vs of the external power supply Es and the ground potential. In other words, the sustaining voltage pulse is applied to the scan electrode Y through the separation and low-side switching devices QS and SC2. At the same time, in the sustain electrode driver section 120, the second sustaining pulse generating section 123 turns on the two sustain switching devices Q1X and Q2X alternately. Thereby, the potential of the scan electrode Y changes between the potential Vs of the external power supply Es and the ground potential. In other words, the sustaining voltage pulse is applied to the sustain electrode X. The sustaining voltage pulses are applied alternately to the scan and sustain electrode Y and X, since the two sustaining pulse generating sections 113 and 123 operate in the opposite phase. See FIG. 25. Thereby, the AC voltage appears between the scan and sustain electrodes Y and X in each discharge cell of the PDP 20. At that time, in the discharge cell where the wall charges have accumulated during the address period, the electric discharge is sustained, and therefore, the light emission occurs.

Two power recovery sections 114 and 124 each include an inductor and a recovery capacitor (not shown). When the potential of the scan electrode Y rises or falls, in the first power recovery section 114, the inductor resonates with the panel capacitance Cp of the PDP 20, and thereby, the electric power is efficiently exchanged between the recovery capacitor and the panel capacitance Cp. Similarly when the potential of the sustain electrode X rises or falls, in the second power recovery section 124, the inductor resonates with the panel capacitance Cp, and the electric power is efficiently exchanged between the recovery capacitor and the panel capacitance Cp. Thus, at the application of the sustaining voltage pulse, reactive power due to the charging and discharging of the panel capacitance is reduced.

For the reduction in power consumption of PDP, lower voltages applied to the sustain, scan, and address electrodes are desirable. For example, the voltage applied to the sustain electrode during the reset and address periods can be reduced when the lower limits of the reset and scan voltage pulses are set lower than the ground potential. Thereby, the power consumption of PDP is reduced without changing the applied voltages to the discharge cells of the PDP.

As shown in FIG. 26, for example, the low side ramp wave generating section QR2 may be connected to an external negative voltage source En (its voltage: $-Vn<0$) in place of the ground conductor for the purpose of setting the lower limit of the reset voltage pulse lower than the ground potential. See, for example, Published Japanese patent application 2000-293135 gazette. Thereby, in the mode VI of the reset period, the lower limit $-Vn$ of the reset voltage pulse falls below the ground potential, in contrast to FIG. 25.

In such PDP driver, the scan electrode driver section 110 includes another separation switching device QS1. See FIG. 26. During the ON period of the low side ramp wave generating section QR2 (cf. the mode VI shown in FIG. 25), the potential falls below the ground potential in the path from the separation switching device QS1 through the low side scan switching device SC2 to the node J of the two scan switching devices SC1 and SC2. However, the separation switching device QS1 is turned off, and then, the current to flow from the output terminal J1 of the first sustaining pulse generating section 113 to the low side scan switching device SC2 is cut off. Thereby, the reset voltage pulse falls reliably to the negative lower limit $-Vn$, without being clamped by the body diode of the first low side sustain switching device Q2 to the ground potential.

In conventional PDP drivers as described above, both the reset and sustaining pulse generating sections raise and lower the potentials of the scan electrodes through a common scan switching device, for example, the low side scan switching device SC2. Accordingly, during the reset period, the sustaining pulse generating section must be separated from the scan switching device (for example, the low side scan switching device SC2), in order to prevent the reset voltage pulse from being clamped to the upper or lower limit of the sustaining voltage pulse.

In the conventional PDP driver, the separation switching device is installed between the sustain and scan switching devices. In the example shown in FIG. 24, the separation switching device QS is inserted between the output terminal J1 of the first sustaining pulse generating section 113 and the low side scan switching device SC2, and cuts off a current to flow from the low side scan switching device SC2 to the output terminal J1. In the example shown in FIG. 26, another separation switching device QS1 is inserted between the output terminal J1 of the first sustaining pulse generating section 113 and the low side scan switching device SC2, and cuts off a current to flow opposite to the direction of the above-described current. In other words, the pair of the separation switching devices QS and QS1 constitutes a two-way switch.

During the sustain period, the separation switching device is turned on, and thereby, the sustaining pulse generating section is connected to the scan switching device. During the reset period, the separation switching device is turned off, and thereby, the sustaining pulse generating section is separated from the scan switching device. Thus, the reset voltage pulse rises and falls to the predetermined upper and lower limits, respectively, without being clamped to the upper and lower limits of the sustaining voltage pulse.

During the sustain period, the separation switching device allows currents to flow. The currents are caused by the applications of the sustaining voltage pulses to the PDP, that is, the gas discharges in the discharge cells and the charging and discharging of the panel capacitance. The amount of the current is, in general, larger than the amounts of currents caused by the applications of the other voltage pulses, and accordingly, the reduction in conduction loss at the separation switching devices is important for the reduction in power consumption in the PDP driver. In particular, the ON resistance of the separation switching device must be set sufficiently low. Accordingly, the number or size of the separation switching device is large. As a result, it is difficult to establish the compatibility between reduction in power consumption and improvement in miniaturization.

In the example shown in FIG. 26, the lower limit of the reset voltage pulse is set lower than the ground potential, that is, the lower limit of the sustaining voltage pulse. In that case, the two-way switch had to be composed of the separation switching devices in order to prevent the reset voltage pulse from being clamped to the lower limit of the sustaining voltage pulse. Under that conditions, the number of the separation switching devices further increases, and therefore, prevents both of reduction in conduction loss and improvement in miniaturization.

In the example shown in FIG. 26, in addition, the potentials at the ends of the series connection 1S of the separation switching devices QS and QS1 change within the ranges equal to the amplitudes of the reset and sustaining voltage pulses, respectively. Accordingly, the separation switching device requires a withstand voltage substantially equal to or above the difference between the upper limit of the reset voltage pulse and the lower limit of the sustaining voltage pulse. Therefore, the reduction in ON resistance of the separation switching device is difficult. As a result, it is further difficult to lower the conduction losses at the separation switching devices and improve the miniaturizations of the separation switching devices.

SUMMARY OF THE INVENTION

An object of the present invention is to provide a PDP driver that lowers the withstand voltages of separation switching devices or reduces the number of separation switching devices, thereby establishing the compatibility between reduction in power consumption and improvement in miniaturization.

This PDP driver according to the invention is installed in a plasma display. The plasma display comprises the following PDP. The PDP comprises a discharge cell emitting light due to an electric discharge in gas filling its inside, and sustain and scan electrodes for applying reset, scan, and sustaining voltage pulses to the discharge cell.

The PDP driver according to the invention comprises:

a scan pulse generating section including high- and low-side scan switching devices connected in series, whose node is connected to a scan electrode of a PDP, turning on the high- and low-side scan switching devices alternately at a predetermined timing, and applying a scan voltage pulse to the scan electrode;

a sustaining pulse generating section turning on one of the high- and low-side scan switching devices and applying a sustaining voltage pulse to the scan electrode; and a reset pulse generating section turning on the high- and low-side scan switching devices alternately at a predetermined timing and applying to the scan electrode a reset voltage pulse reaching its upper and lower limits in the ON periods of the high- and low-side scan switching devices, respectively.

The reset pulse generating section, preferably, comprises:

a high side ramp wave generating section raising a voltage applied to the high side scan switching device at a predetermined rate, and a low side ramp wave generating section lowering a voltage applied to the low side scan switching device at a predetermined rate.

Hereafter, a sustaining pulse transmission path refers to the path through which the sustaining voltage pulse is transmitted between either of the high- or low-side scan switching device and the sustaining pulse generating section. Furthermore, a high side reset pulse transmission path refers to the path through which the reset voltage pulse is transmitted between the reset pulse generating section and the high side scan switching device during the period when the reset voltage pulse rises to its upper limit; and a low side reset pulse transmission path refers to the path through which the reset voltage pulse is transmitted between the reset pulse generating section and the low side scan switching device during the period when the reset voltage pulse falls to its lower limit.

As is clear from these definitions, the sustaining pulse transmission path shares its end part with, or coupled directly to, at least one of the high- and low-side reset pulse transmission paths. The high- and low-side reset pulse transmission paths are separated from each other in the above-described PDP driver according to the invention, in contrast to conventional PDP drivers. Accordingly, the range of potential variation in each reset pulse transmission path is narrower than the difference between the upper and lower limits of the reset voltage pulse. Therefore, the range of potential variation in the sustaining pulse transmission path is narrower than that in the conventional PDP driver. As a result, the withstand voltages or number of the separation switching devices are reduced.

The following four patterns may serve as the sustaining pulse transmission paths, especially in the above-described PDP driver according to the invention.

In the first pattern, the upper and lower limits of the sustaining voltage pulse are applied to the scan pulse generating section through the common sustaining pulse transmission path that connects between the sustaining pulse generating section and the low side scan switching device. The sustaining pulse generating section preferably includes:

a high side sustain switching device connected to an external power supply and provided with a voltage equal to the upper limit of the sustaining voltage pulse, and a low side sustain switching device connected to one of an external power supply and a ground conductor, and provided with a voltage equal to the lower limit of the sustaining voltage pulse;

and furthermore, the high- and low-side sustain switching devices are connected in series and their node is connected to the low side scan switching device through the sustaining pulse transmission path. In this case, the sustaining pulse transmission path does not need to be coupled directly to the high side reset pulse transmission path. Accordingly, the potential of the sustaining pulse transmission path is maintained within the range sufficiently lower than the upper limit of the reset voltage pulse.

During the reset period, the sustaining pulse transmission path may be completely separated from the high side reset pulse transmission path. At that time, the upper limit of the potential of the sustaining pulse transmission path is equal to the upper limit of the sustaining voltage pulse, and thus, any substantial current does not flow through the sustaining pulse transmission path into the sustaining pulse generating section. Accordingly, a separation switching device for cutting off the current, which is hereafter referred to as a second separation switching device, does not need to be installed. In other words, the number of separation switching devices is reduced.

The above-described PDP driver according to the invention may comprise a constant-voltage source including positive and negative electrodes connected to the high- and low-side scan switching devices, respectively, and maintaining a constant voltage between the positive and negative electrodes. This constant-voltage source, in particular, maintains a constant voltage between the sustaining and high side reset pulse transmission paths. When the difference between the upper limit of the reset voltage pulse and the voltage of the constant-voltage source is lower than the upper limit of the sustaining voltage pulse, the upper limit of the potential of the sustaining pulse transmission path is equal to the upper limit of the sustaining voltage pulse. Accordingly, the second separation switching device does not need to be installed. In other words, the number of the separation switching devices is reduced. The second separation switching device is installed when the difference between the upper limit of the reset voltage pulse and the voltage of the constant-voltage source is higher than the upper limit of the sustaining voltage pulse. While the reset voltage pulse exceeds the sum of the voltage of the constant-voltage source and the upper limit of the sustaining voltage pulse, the second separation switching device cuts off a current to flow from the negative electrode of the constant-voltage source through the sustaining pulse transmission path to the sustaining pulse generating section. In the sustaining pulse transmission path, the upper limit of the potential is lower than the upper limit of the reset voltage pulse by the voltage of the constant-voltage source. Accordingly, the withstand voltage of the second separation switching device is sufficiently lower than the withstand voltage of the conventional separation switching device.

The second separation switching device is preferably a wide band gap semiconductor switching device. The wide band gap semiconductor includes, for example, silicone carbide (SiC), diamond, gallium nitride (GaN), or zinc oxide (ZnO). The wide band gap semiconductor switching devices increase less ON resistances with rise in withstand voltage than conventional silicone semiconductor switching devices. In other words, the wide band gap semiconductor switching devices have higher withstand voltages and lower ON resistances. Accordingly, use of wide band gap semiconductor switching devices as the separation switching devices is extremely effective for reduction in conduction loss and improvement in miniaturization.

In the first pattern, the sustaining pulse transmission path is coupled directly to the low side reset pulse transmission path. When the lower limit of the reset voltage pulse is, at the lowest, equal to the lower limit of the sustaining voltage pulse, any substantial current does not flow from the sustaining pulse generating section into the sustaining pulse transmission path during the reset period. Accordingly, the separation switching device for cutting off the current, which is hereafter referred to as the first separation switching device, does not need to be installed. In other words, the number of the separation switching devices is reduced. The first separation switching device is installed when the lower limit of the reset voltage pulse is lower than the lower limit of the sustaining voltage pulse. The first separation switching device is, preferably, a wide band gap semiconductor switching device. While the reset voltage pulse falls below the lower limit of the sustaining voltage pulse, the first separation switching device cuts off the current to flow from the sustaining pulse generating section through the sustaining pulse transmission path to the low side scan switching device. Thereby, the reset voltage pulse falls reliably to the predetermined lower limit, without being clamped to the lower limit of the sustaining voltage pulse.

Preferably, the scan pulse generating section further includes a constant-voltage source which includes an negative electrode connected to the low side scan switching device and which maintains a constant voltage between a positive electrode and the negative electrode, a high side auxiliary switching device which connects the positive electrode of the constant-voltage source to the high side scan switching device, a low side auxiliary switching device which connects between both ends of the series connection of the high- and low-side scan switching devices, and an auxiliary switch driving section which turns on and off the high- and low-side auxiliary switching devices alternately. In the address period, the auxiliary switch driving section maintains the high- and low-side auxiliary switching devices in the ON and OFF states, respectively. Thereby, in the series connection of the two scan switching devices, the potential of the high side terminal is maintained higher than the potential of the low side terminal by the voltage of the constant-voltage source. Under the condition, the two scan switching devices are turned on and off alternately, and then, the potential of the scan electrode changes by the voltage of the constant-voltage source. Thus, the scan voltage pulse is applied to the scan electrode. In the sustain period, the auxiliary switch driving section maintains the high- and low-side auxiliary switching devices in the OFF and ON states, respectively. Thereby, the series connection of the two scan switching devices is short-circuited through the low side auxiliary switching device. Under the condition, the same sustaining voltage pulses are applied at the same time to the two scan switching devices, and accordingly, overvoltage never occur at any of the scan switching devices.

The upper and lower limits of the reset voltage pulses are applied to the scan electrode, passing through the high- and low-side scan switching devices, respectively, in the above-described PDP driver according to the invention. Accordingly, when the two auxiliary switching devices are installed, the low side auxiliary switching device have to be maintained in the OFF state during the reset period. In the first pattern, in addition, the reset voltage pulse should be allowed to rise to its upper limit, avoiding the clamping of the constant-voltage source. Accordingly, the high side auxiliary switching device also have to be maintained in the OFF state at least during the period when the reset voltage pulse rises to its upper limit. Preferably, the reset pulse generating section, when raising the reset voltage pulse to its upper limit, suppresses the turn-on of the high side auxiliary switching device by the auxiliary switch driving section. Further preferably, the reset pulse generating section comprises a high side ramp wave generating section which raises a voltage applied to the high side scan switching device at a predetermined rate, and a reset switch driving section which turns the high side ramp wave generating section on and off, and in particular when turning it on, suppresses the turn-on of the high side auxiliary switching device by the auxiliary switch driving section. Thus, when the auxiliary switching devices are installed in the above-described PDP driver according to the invention, the same auxiliary switch driving section can drive the two auxiliary switching devices, and therefore, the component count and size of the driver can be maintained small.

In the second pattern, the upper and lower limits of the sustaining voltage pulse are applied to the scanning pulse generating section through the common sustaining pulse transmission path connecting between the sustaining pulse generating section and the high side scan switching device. Preferably, a high side sustain switching device connected to an external power supply and provided with a voltage equal to the upper limit of the sustaining voltage pulse, and a low side sustain switching device connected to one of an external power supply and a ground conductor, and provided with a voltage equal to the lower limit of the sustaining voltage pulse; and the sustaining pulse generating section includes the high- and low-side sustain switching devices are connected in series and their node is connected through the sustaining pulse transmission path to the high side scan switching device. In this case, the sustaining pulse transmission path does not need to be coupled directly to the low side reset pulse transmission path. Accordingly, the potential of the sustaining pulse transmission path is maintained within a range sufficiently higher than the lower limit of the reset voltage pulse.

The potential of the sustaining pulse transmission path can exceed the upper limit of the sustaining voltage pulse, since the sustaining pulse transmission path is coupled to the high side reset pulse transmission path. Accordingly, the second separation switching device is preferably installed. While the reset voltage pulse exceeds the upper limit of the sustaining voltage pulse, the second separation switching device cuts off a current to flow from the high side scan switching device through the sustaining pulse transmission path to the sustaining pulse generating section. Thereby, the reset voltage pulse rises to its predetermined upper limit, without being clamped to the upper limit of the sustaining voltage pulse.

The sustaining pulse transmission path may be completely separated from the low side reset pulse transmission path during the reset period. At that time, the lower limit of the potential of the sustaining pulse transmission path is equal to the lower limit of the sustaining voltage pulse, and thus, any substantial current does not flow from the sustaining pulse generating section into the sustaining pulse transmission path. Accordingly, the first separation switching device for cutting off the current does not need to be installed. In other words, the number of the separation switching devices is reduced.

When the lower limit of the reset voltage pulse is lower than the lower limit of the sustaining voltage pulse, the above-described PDP driver according to the invention may comprise a constant-voltage source including positive and negative electrodes connected to the high- and low-side scan switching devices, respectively, and maintaining a voltage between the positive and negative electrodes, at the lowest, equal to the difference between the lower limits of the sustaining and reset voltage pulses. In particular, this constant-voltage source maintains the sustaining pulse transmission path at a potential the above-described voltage higher than the potential of the low side reset pulse transmission path. Thereby, the sum of the lower limit of the reset voltage pulse and the voltage of the constant-voltage source is equal to or above the lower limit of the sustaining voltage pulse. Accordingly, the lower limit of the potential of the sustaining pulse transmission path is maintained equal to the lower limit of the sustaining voltage pulse. Therefore, the first separation switching device does not need to be installed. In other words, the number of the separation switching devices is reduced.

In the third pattern;

the upper limit of the sustaining voltage pulse is applied to the scan pulse generating section through a high side sustaining pulse transmission path connecting between the sustaining pulse generating section and the high side scan switching device; and the lower limit of the sustaining voltage pulse is applied to the scan pulse generating section through a low side sustaining pulse transmission path connecting between the sustaining pulse generating section and the low side scan switching device. Preferably, the sustaining pulse generating section includes the following high- and low-side sustain switching devices. The high side sustain switching device is connected between an external power supply and the high side scan switching device, and provided with a voltage equal to the upper limit of the sustaining voltage pulse. Accordingly, the voltage equal to the upper limit of the sustaining voltage pulse is applied to the high side scan switching device during the ON period of the high side sustain switching device. The low side sustain switching device is connected between the low side scan switching device and one of an external power supply and a ground conductor, and provided with a voltage equal to the lower limit of the sustaining voltage pulse. Accordingly, the voltage equal to the lower limit of the sustaining voltage pulse is applied to the low side scan switching device during the ON period of the low side sustain switching device.

In the third pattern, the high side sustaining pulse transmission path can be completely separated from the low side sustaining pulse transmission path. Thereby, the high side sustaining pulse transmission path does not need to be coupled directly to the low side reset pulse transmission path. Similarly, the low side sustaining pulse transmission path does not need to be coupled directly to the high side reset pulse transmission path.

Alternatively, the above-described PDP driver according to the invention may comprise a constant-voltage source including positive and negative electrodes connected to the high- and low-side scan switching devices, respectively, and maintaining a constant voltage between the positive and negative electrodes. In particular, this constant-voltage source maintains the high side sustaining pulse transmission path at a potential the constant level higher than the potential of the low side sustaining pulse transmission path. Accordingly, the potential of the high side sustaining pulse transmission path is maintained within a range sufficiently higher than the lower limit of the reset voltage pulse, and the potential of the low side sustaining pulse transmission path is maintained within a range sufficiently lower than the upper limit of the reset voltage pulse.

The high side reset pulse transmission path is coupled directly to the high side sustaining pulse transmission path, and thus, the potential of the high side sustaining pulse transmission path can exceed the upper limit of the sustaining voltage pulse in the reset period. Accordingly, the second separation switching device is preferably installed. While the reset voltage pulse exceeds the upper limit of the sustaining voltage pulse, the second separation switching device cuts off a current to flow from the high side scan switching device through the high side sustaining pulse transmission path to the sustaining pulse generating section. Thereby, the reset voltage pulse rises to the predetermined upper limit, without being clamped to the upper limit of the sustaining voltage pulse. In the high side sustaining pulse transmission path, the range in potential change is limited to the range from the upper limit of the sustaining voltage pulse to the upper limit of the reset voltage pulse. Accordingly, the second separation switching device has a withstand voltage sufficiently lower than that of the conventional separation switching device.

The low side reset pulse transmission path is coupled directly to the low side sustaining pulse transmission path. When the reset voltage pulse has the lower limit, at the lowest, equal to the lower limit of the sustaining voltage pulse, any substantial current does not flow from the sustaining pulse generating section into the low side sustaining pulse transmission path during the reset period. Accordingly, the first separation switching device for cutting off the current does not need to be installed. In other words, the number of the separation switching devices is reduced. The first separation switching device is installed when the lower limit of the reset voltage pulse is lower than the lower limit of the sustaining voltage pulse. While the reset voltage pulse falls below the lower limit of the sustaining voltage pulse, the first separation switching device cuts off a current to flow from the sustaining pulse generating section through the low side sustaining pulse transmission path to the low side scan switching device. Thereby, the reset voltage pulse falls reliably to the predetermined lower limit, without being clamped to the lower limit of the sustaining voltage pulse. In the low side sustaining pulse transmission path, the range in potential change is limited to the range from the lower limit of the reset voltage pulse to the lower limit of the sustaining voltage pulse. Accordingly, the first separation switching device has a withstand voltage sufficiently lower than that of the conventional separation switching device.

In the fourth pattern, the upper limit of the sustaining voltage pulse is applied to the scan pulse generating section through a high side sustaining pulse transmission path connecting between the sustaining pulse generating section and the low side scan switching device; and the lower limit of the sustaining voltage pulse is applied to the scan pulse generating section through a low side sustaining pulse transmission path connecting between the sustaining pulse generating section and the high side scan switching device. Preferably, the sustaining pulse generating section includes the following high- and low-side sustain switching devices. The high side sustain switching device is connected between an external power supply and the low side scan switching device, and provided with a voltage equal to the upper limit of the sustaining voltage pulse. Accordingly, the voltage equal to the upper limit of the sustaining voltage pulse is applied to the low side scan switching device during the ON period of the high side sustain switching device. The low side sustain switching device is connected between the high side scan switching device and one of an external power supply and a ground conductor, and provided with a voltage equal to the lower limit of the sustaining voltage pulse. Accordingly, the voltage equal to the lower limit of the sustaining voltage pulse is applied to the high side scan switching device during the ON period of the low side sustain switching device.

In the fourth pattern, the high side sustaining pulse transmission path can be completely separated from the low side sustaining pulse transmission path, similarly in the third pattern. Thereby, the high side sustaining pulse transmission path does not need to be coupled directly to the low side reset pulse transmission path. Similarly, the low side sustaining pulse transmission path does not need to be coupled directly to the high side reset pulse transmission path. Alternatively, this above-described PDP driver according to the invention may comprise a constant-voltage source including positive and negative electrodes connected to the high and low side scan switching device, respectively, and maintaining a constant voltage between the positive and negative electrodes. In particular, this constant-voltage source maintains the low side sustaining pulse transmission path at a potential a constant level higher than the potential of the high side sustaining pulse transmission path. Accordingly, the potential of the low side sustaining pulse transmission path is maintained within a range sufficiently higher than the lower limit of the reset voltage pulse, and the potential of the high side sustaining pulse transmission path is maintained within a range sufficiently lower than the upper limit of the reset voltage pulse.

When the lower limit of the reset voltage pulse is lower than the lower limit of the sustaining voltage pulse, preferably, the constant-voltage source maintains the voltage between the positive and negative electrodes, at the lowest, equal to the difference between the lower limits of the sustaining and reset voltage pulses. Thereby, in the low side sustaining pulse transmission path, the lower limit of the potential is equal to the lower limit of the sustaining voltage pulse. When the potential of the low side sustaining pulse transmission path is maintained equal to or above the lower limit of the sustaining voltage pulse, any substantial current does not flow from the sustaining pulse generating section into the low side sustaining pulse transmission path during the reset period. Therefore, the first separation switching device for cutting off the current does not need to be installed. In other words, the number of the separation switching devices is reduced.

When the difference between the upper limit of the reset voltage pulse and the voltages of the constant-voltage source are lower than the upper limit of the sustaining voltage pulse, the potential of the high side sustaining pulse transmission path is maintained within the range equal to or below the upper limit of the sustaining voltage pulse. Accordingly, the second separation switching device does not need to be installed. In other words, the number of the separation switching devices is reduced. The second separation switching device is installed when the difference between the upper limit of the reset voltage pulse and the voltages of the constant-voltage source are higher than the upper limit of the sustaining voltage pulse. While the reset voltage pulse exceeds the sum of the voltage of the constant-voltage source and the upper limit of the sustaining voltage pulse, the second separation switching device cuts off the current to flow from the negative electrode of the constant-voltage source through the high side sustaining pulse transmission path to the sustaining pulse generating section. In the high side sustaining pulse transmission path, the upper limit of the potential is lower than the upper limit of the reset voltage pulse by the voltage of the constant-voltage source. Accordingly, the withstand voltage of the second separation switching device is sufficiently lower than the withstand voltage of the conventional separation switching device.

In the PDP driver according to the invention, as described above, the withstand voltages or the number of the separation switching devices are reduced. Since reduction in withstand voltage leads to reduction in ON resistance, the separation switching devices are easy both to reduce in conduction loss and to further miniaturize. Furthermore, the reduction of the separation switching device itself is effective to the reductions both in power consumption and size of the whole of the PDP driver as well. Thus, the PDP driver according to the invention is easier to improve in power reduction and miniaturization than conventional devices. Furthermore, a smaller number of the separation switching devices reduce parasitic inductances due to circuit elements and lines on the sustaining pulse transmission path. Accordingly, the voltages applied to the PDP have only a little ringing, and therefore, the PDP driver according to the invention also has advantage in further improvement in high image quality of the plasma display.

While the novel features of the invention are set forth particularly in the appended claims, the invention, both as to organization and content, will be better understood and appreciated, along with other objects and features thereof, from the following detailed description taken in conjunction with the drawings.

Figure 1:
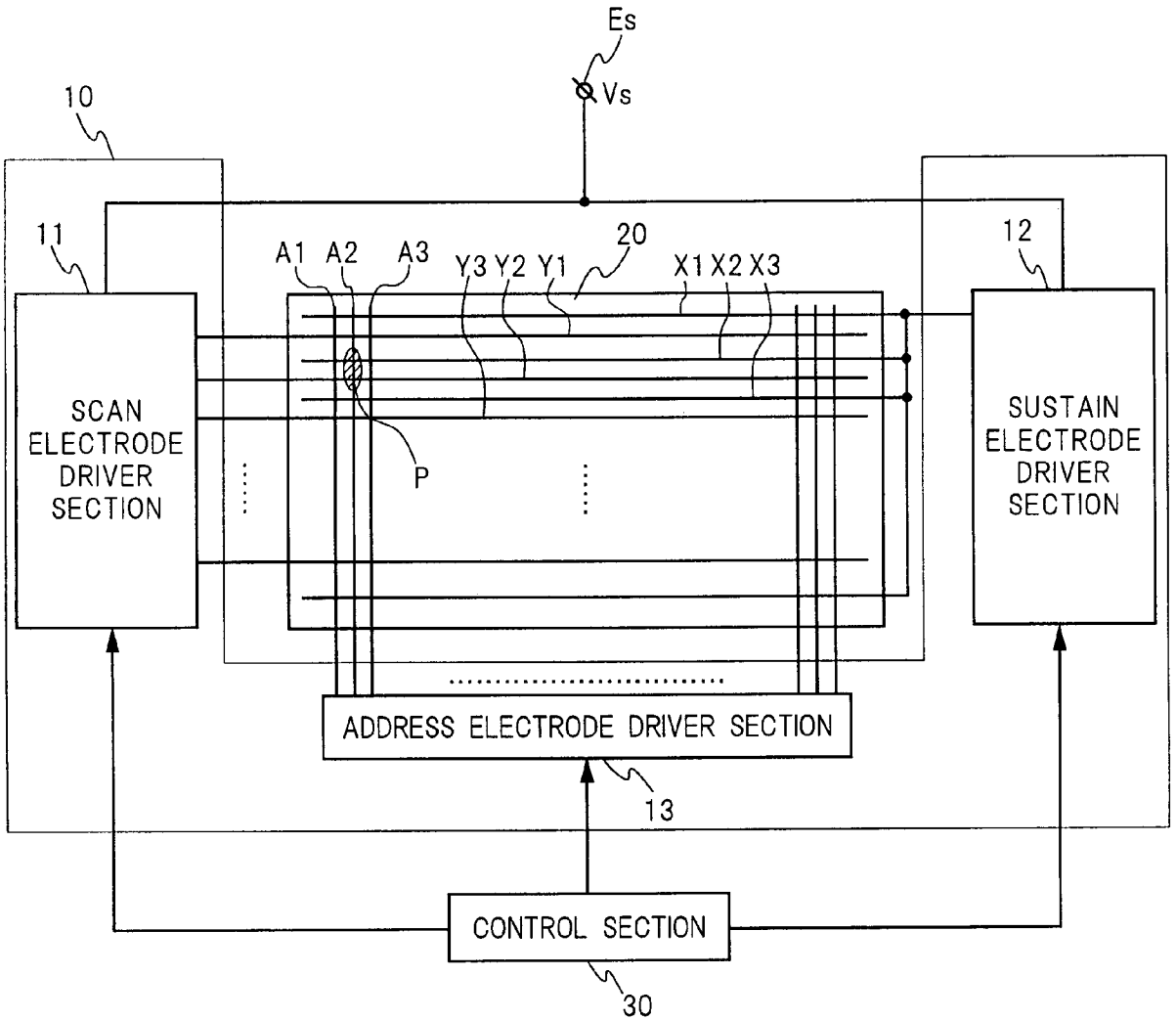
FIG. 1 is a block diagram that shows the structure of a plasma display according to embodiments of the invention.

It will be recognized that some or all of the Figures are schematic representations for purposes of illustration and do not necessarily depict the actual relative sizes or locations of the elements shown.

DETAILED DESCRIPTION OF THE INVENTION

The following explains the best embodiments of the present invention, referring to the figures.

Embodiment 1

A plasma display according to Embodiment 1 of the invention comprises a PDP driver 10, a PDP 20, and a control section 30. See FIG. 1.

The PDP 20 is an AC type, for example, and comprises the three-electrode surface-discharge type structure. Address electrodes A1, A2, A3, . . . are arranged on the rear substrate of the PDP 20 in the vertical direction of the panel. Sustain electrodes X1, X2, X3, . . . and scan electrodes Y1, Y2, Y3, . . . are alternately arranged on the front substrate of the PDP 20 in the horizontal direction of the panel. The sustain electrodes X1, X2, X3, . . . are connected to each other, and thus, have a substantially equal potential. The address electrodes A1, A2, A3, . . . and the scan electrodes Y1, Y2, Y3, . . . each allow an individual potential change.

A discharge cell is installed at the intersection of an adjacent pair of sustain and scan electrodes (e.g., a pair of sustain and scan electrodes X2 and Y2) and an address electrode (e.g., an address electrode A2). See, for example, a hatched area P shown in FIG. 1. On the surface of the discharge cell, a layer of dielectric material (a dielectric layer), a layer protecting the electrodes and the dielectric layer (a protection layer), and a layer including phosphor (a phosphor layer) are laminated. The inside of the discharge cell is filled with gas. An electric discharge occurs in the discharge cell when a predetermined voltage pulse is applied across the sustain, scan, and address electrodes. At that time, the gas molecules ionize and emit ultraviolet rays. The ultraviolet rays excite the phosphors on the surfaces of the discharge cell, and then, cause them to emit fluorescence. Thus, the discharge cells glow.

The PDP driver 10 includes scan, sustain, and address electrode driver sections 11, 12, and 13. See FIG. 1. The input terminals of the scan and sustain electrode driver sections 11 and 12 are connected to the power supply section Es. The power supply section Es first converts an AC voltage from an external commercial AC power supply (not shown) into a DC voltage (for example, 400V). The power supply section Es further converts the DC voltage into a predetermined DC voltage Vs (for example, 155V). The DC voltage Vs is applied to the PDP driver 10. The output terminals of the scan electrode driver section 11 are separately connected to the respective scan electrodes Y1, Y2, Y3, . . . of the PDP 20. The scan electrode driver section 11 separately changes each potential of the scan electrodes Y1, Y2, Y3, . . . . The output terminal of the sustain electrode driver section 12 is connected to the sustain electrodes X1, X2, X3, . . . of the PDP 20. The sustain electrode driver section 12 uniformly changes the potentials of the sustain electrode X1, X2, X3, . . . . The output terminals of the address electrode driver section 13 are separately connected to the respective address electrodes A1, A2, A3, . . . of the PDP 20. The address electrode driver section 13 generates signal voltage pulses based on a video signal from the outside, and selects some of the address electrodes A1, A2, A3, . . . . The signal voltage pulse is applied to the selected address electrode.

The PDP driver 10 controls each potential of the electrodes of the PDP 20 under the ADS (Address Display-period Separation) scheme. The ADS scheme is a kind of the sub-field scheme. In the Japanese television broadcasts, for example, one field of picture is transmitted at intervals of 1/60 seconds (=about 16.7 msec). In other words, the display time per field is fixed. Under the sub-field scheme, each field is divided into more than one sub-fields. Under the ADS scheme, furthermore, all the discharge cells of the PDP 20 have in common the following three periods (reset, address, and sustain periods) in every sub-field. In particular, the durations of the sustain periods vary from one sub-field to another. In the reset, address, and sustain periods, different voltage pulses are applied to the discharge cells, as follows.

During the reset period, reset voltage pulses are applied to the sustain electrodes X1, X2, X3, . . . and the scan electrodes Y1, Y2, Y3 . . . . Thereby, wall charges are evened in all the discharge cells.

During the address period, the scan electrode driver section 11 applies scan voltage pulses to the scan electrodes Y1, Y2, Y3, . . . in sequence. In synchronization with the application, the address electrode driver section 13 applies signal voltage pulses to some of the address electrodes A1, A2, A3 . . . , which have been selected in advance. When the scan voltage pulse is applied to one of the scan electrodes and the signal voltage pulse is applied to one of the address electrodes, a gas discharge occurs in the discharge cell located at the intersection between the scan and address electrodes. Because of the discharge, new wall charges accumulate on the surfaces of the discharge cell.

During the sustain period, the scan and sustain electrode driver section 11 and 12 alternately apply the sustaining voltage pulses to the scan electrodes Y1, Y2, Y3, . . . and the sustain electrodes X1, X2, X3, . . . , respectively. At that time, in the discharge cells where wall charges have accumulated during the address period, the gas discharge and the accumulation of wall charges are repeated, and therefore, the light emission by the phosphors is sustained. The durations of the sustain periods are different from one sub-field to another, and accordingly, the selection of sub-field where the discharge cell should glow adjusts the light emission time per field of the discharge cell, or the brightness of the discharge cell.

The scan, sustain, and address electrode driver sections 11, 12, and 13 each include an internal switching inverter. The control section 30 performs switching controls over the driver sections. Thereby, the reset, scan, signal, and sustaining voltage pulses are generated at predetermined waveforms and timings. The control section 30, in particular, selects the address electrodes to be provided with the signal voltage pulses, based on a video signal from the outside. The control section 30 further determines the duration of the sustain period after the application of the signal voltage pulse, that is, the sub-field where the signal voltage pulse should be provided. As a result, each discharge cell glows at an appropriate brightness. Thus, the image corresponding to the video signal is reproduced on the PDP 20. respectively. On the other hand, any of IGBTs and bipolar transistors does not include a body diode, in contrast to MOSFETs. However, in an IGBT and a bipolar transistor, the emitter and collector are equivalent to the source and drain of a MOSFET in the functionality of a switching device. Hereafter, the two terminals of the switching device are referred to as anode and cathode. In the case where the switching device is a MOSFET, the anode and cathode are equivalent to the source and drain, respectively. In the case where the switching device is an IGBT or a bipolar transistor, the anode and cathode is equivalent to the emitter and collector, respectively.

The positive electrode of the first constant-voltage source E1 is connected to the anode of the first bypass switching device QB1. The cathode of the first bypass switching device QB1 is connected to the cathode of the high side auxiliary switching device SA1. The anode of the high side auxiliary switching device SA1 is connected to the cathodes of the high side scan switching device SC1 and the low side auxiliary switching device SA2. The anode of the high side scan switching device SC1 is connected to the cathode of the low side scan switching device SC2. The node J therebetween is connected to one Y of the scan electrodes of the PDP 20. Here, in actuality, the series connections 1S of the high- and low-side scan switching devices SC1 and SC2 as many as a plurality of the scan electrodes Y1, Y2, . . . (cf. FIG. 1) are provided and each connected to one of the scan electrodes Y1, Y2, . . . The anodes of the low-side scan and auxiliary switching devices SC2 and SA2 are both connected to the negative electrode of the first constant-voltage source E1.

The two auxiliary switching devices SA1 and SA2 are, preferably, turned on and off in an alternating manner similar to that of the two scan switching devices SC1 and SC2. The installation of the two auxiliary switching devices SA1 and SA2 aims at the protection of the two scan switching devices SC1 and SC2 from overvoltage. Thereby, the malfunction of the two scan switching devices SC1 and SC2 is avoided. In the case where there is little fear of the malfunction, the auxiliary switching devices SA1 and SA2 do not need to be installed. In that case, the cathode of the high side scan switching device SC1 is coupled directly to the cathode of the first bypass switching device QB1, and connected to the anode of the low side scan switching device SC2 through the first constant-voltage source E1. Furthermore, aside from the position shown in FIG. 2, the high side auxiliary switching device SA1 may be connected between the negative electrode of the first constant-voltage source E1 and the anode of the low side scan switching device SC2. In that case, the cathode of the first bypass switching device QB1 is coupled directly to the cathode of the high side scan switching device SC1.

The reset pulse generating section 2A includes a positive voltage source Et, a second constant-voltage source E2, a reset switch section Q5, a high side ramp wave generating section QR1, and a low side ramp wave generating section QR2. The positive voltage source Et maintains its output terminal at a constant positive potential Vt, based on the output voltage Vs of the power supply section Es, by using, for example, a DC-DC converter (not shown). In particular, the voltage Vt of the positive voltage source Et is lower than the output voltage Vs of the power supply section Es by the voltage of the first constant-voltage source E1: Vt=Vs−V1. The second constant-voltage source E2 maintains the positive electrode at a potential a constant voltage V2 higher than the potential of the negative electrode, based on the output voltage Vs of the power supply section Es, by using, for example, a DC-DC converter (not shown). In particular, the upper limit of the reset voltage pulse is set at the potential Vr=Vs+V2 higher than the potential Vs of the power supply section Es by the voltage V2 of the second constant-voltage source E2. The reset switch section Q5 is a two-way switch, and for example, includes a series connection of two switching devices. The two switching devices are preferably MOSFETs, or alternatively, may be IGBTs or bipolar transistors to which diodes are connected in parallel. The anodes or cathodes of the two switching devices are connected to each other, and the switching devices are turned on and off in synchronization with each other. The reset switch section Q5 may be a parallel connection of two IGBTs or bipolar transistors. In that case, the collector of one of the two transistors is connected to the emitter of the other. The ramp wave generating sections QR1 and QR2 preferably include an N-channel MOSFET (NMOS). The gate and drain of the NMOS are connected across elements including a capacitor. When the ramp wave generating sections QR1 and QR2 are turned on, the voltages across them change to zero at a constant or nearly constant rate. The ramp wave generating sections QR1 and QR2 may, alternatively, comprise an electric discharge circuit. The electric discharge circuit includes a capacitor and a resistance, and their time constant corresponds to the decay time of each voltage across the ramp wave generating sections QR1 and QR2.

The positive voltage source Et is connected to the cathode of the low side ramp wave generating section QR2 through the reset switch section Q5. The anode of the low side ramp wave generating section QR2 is grounded. The cathode of the low side ramp wave generating section QR2 is further connected to the negative electrode of the first constant-voltage source E1. The positive electrode of the first constant-voltage source E1 is connected to the negative electrode of the second constant-voltage source E2. The positive electrode of the second constant-voltage source E2 is connected to the cathode of the high side ramp wave generating section QR1. The anode of the high side ramp wave generating section QR1 is connected to the cathode of the high side auxiliary switching device SA1.

The first sustaining pulse generating section 3A includes a first high side sustain switching device Q1, a first low side sustain switching device Q2, and a first power recovery section 4. The two sustain switching devices Q1 and Q2 are preferably MOSFETs, or alternatively, may be IGBTs or bipolar transistors. Further preferably, they are wide band gap semiconductor switching devices.

The cathode of the first high side sustain switching device Q1 is connected to the power supply section Es. The anode of the first high side sustain switching device Q1 is connected to the cathode of the first low side sustain switching device Q2. The anode of the first low side sustain switching device Q2 is grounded. The node J1 between the first high- and low-side sustain switching devices Q1 and Q2 is the output terminal of the first sustaining pulse generating section 3A, and coupled directly to the anode of the low side scan switching device SC2.

The scan electrode driver section 11 according to Embodiment 1 of the invention comprises no separation switching device for cutting off the current to flow through the path from the output terminal J1 of the first sustaining pulse generating section 3A to the anode of the low side scan switching device SC2, in contrast to conventional devices. The path is hereafter referred to as a sustaining pulse transmission path.

The first power recovery section 4 includes a first recovery capacitor C, a first high side recovery switching device Q3, a first low side recovery switching device Q4, a first high side diode D1, a first low side diode D2, and a first inductor L. See FIGS. 2 and 3A. The capacitance of the first recovery capacitor C is sufficiently larger than that of the panel capacitance Cp of the PDP 20. The voltage across the first recovery capacitor C is maintained substantially equal to half Vs/2 of the output voltage Vs of the power supply section Es. The two recovery switching devices Q3 and Q4 are preferably MOSFETs, or alternatively, may be IGBTs or bipolar transistors. Further preferably, they are wide band gap semiconductor switching devices.

One end of the first recovery capacitor C is grounded, and the other end thereof is connected to the cathode of the first high side recovery switching device Q3 and the anode of the first low side recovery switching device Q4. The anode of the first high side recovery switching device Q3 is connected to the anode of the first high side diode D1. The cathode of the first high side diode D1 is connected to the anode of the first low side diode D2. The cathode of the first low side diode D2 is connected to the cathode of the first low side recovery switching device Q4. The node between the first high and low side diodes D1 and D2 is connected to one (first) end of the first inductor L. The other (second) end 40 of the first inductor L is preferably connected to the conducting path coupled directly to the output terminal J1 of the first sustaining pulse generating section 3A (see FIG. 2), or alternatively, may be connected to the conducting path coupled directly to the positive electrode of the first constant-voltage source E1 (for example, the node J2) or the conducting path coupled to the cathode of the high side scan switching device SC1 (for example, the node J3). The first high side recovery switching device Q3 and the first high side diode D1 may be connected in reversed polarity. In other words, the other end of the first recovery capacitor C may be connected to the anode of the first high side diode D1, the cathode of the first high side diode D1 may be connected to the cathode of the first high side recovery switching device Q3, and the anode of the first high side recovery switching device Q3 may be connected to the one end of the first inductor L. Similarly, the first low side recovery switching device Q4 and the first low side diode D2 may be connected in reversed polarity. In other words, the other end of the first recovery capacitor C may be connected to the cathode of the first low side diode D2, the anode of the first low side diode D2 may be connected to the anode of the first low side recovery switching device Q4, and the cathode of the first low side recovery switching device Q4 may be connected to the one end of the first inductor L.

Figure 2:
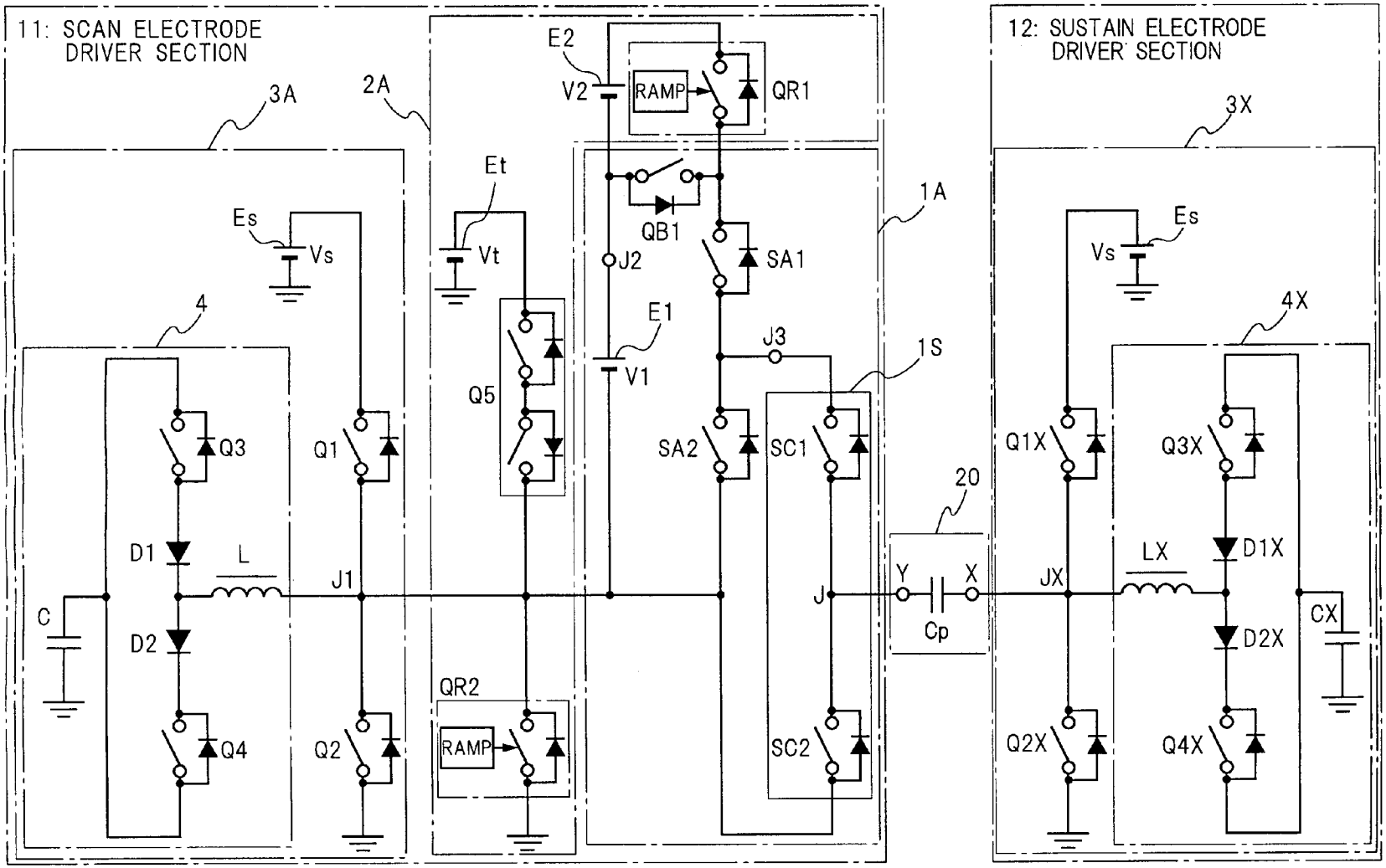
FIG. 2 is an equivalent circuit diagram that shows scan and sustain electrode driver sections 11 and 12 according to Embodiment 1 of the invention and a PDP 20.
Figure 3A:
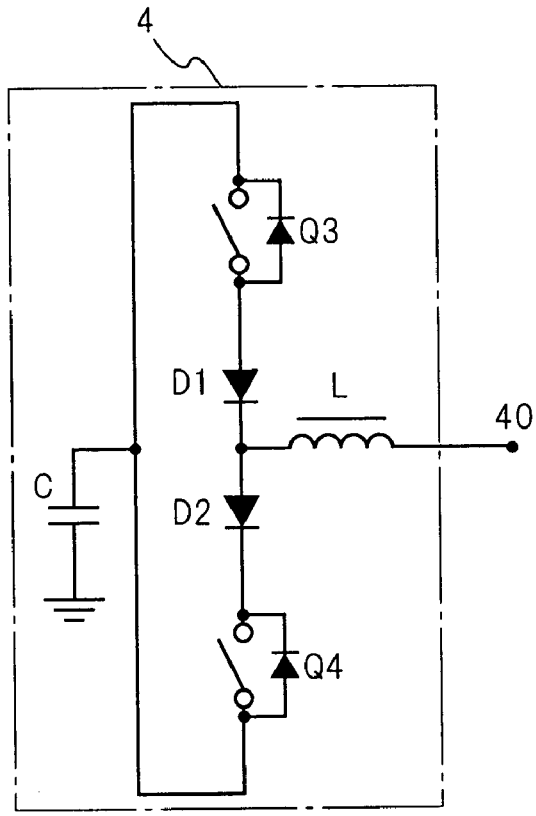
FIGS. 3A and 3B are equivalent circuit diagrams that show a first power recovery section 4 according to the embodiments of the invention.
Figure 3B:
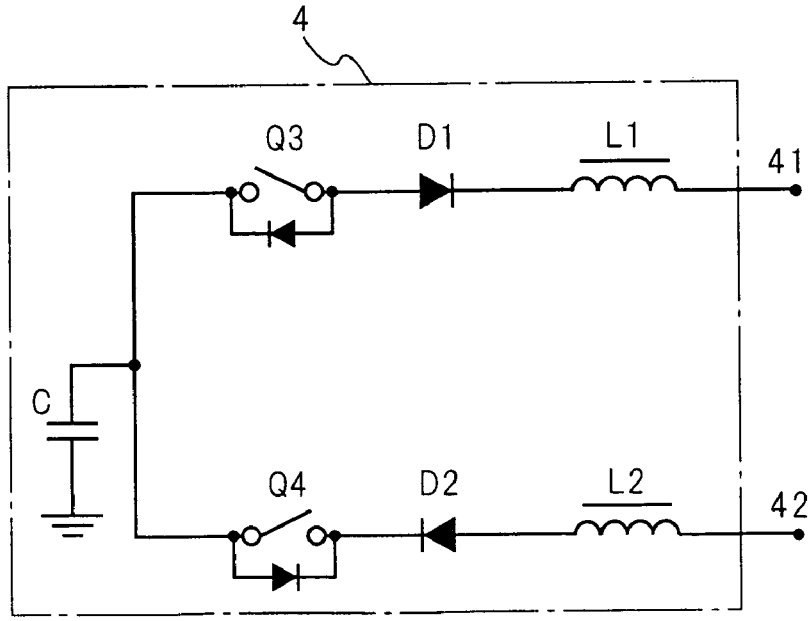

In the first power recovery section 4 shown in FIGS. 2 and 3A, the current due to the charging and discharging of the recovery capacitor C flows through the single inductor L in both directions. Alternatively, for example, as shown in FIG. 3B, the discharging and charging currents for the recovery capacitor C may separately flow through the different inductors L1 and L2, respectively. The second ends 41 and 42 of the two inductors L1 and L2 may be both connected to one, or separately connected to two, of the conducting path coupled directly to the output terminal J1 of the first sustaining pulse generating section 3A, the conducting path coupled directly to the positive electrode of the first constant-voltage source E1 (for example, the node J2), and the conducting path coupled directly to the cathode of the high side scan switching device SC1 (for example, the node J3).

The second sustaining pulse generating section 3X includes a second high side sustain switching device Q1X, a second low side sustain switching device Q2X, and a second power recovery section 4X. See FIG. 2. The two sustain switching devices Q1X and Q2X are preferably MOSFETs, or alternatively, may be IGBTs or bipolar transistors. Further preferably, they are wide band gap semiconductor switching devices.

The cathode of the second high side sustain switching device Q1X is connected to the power supply section Es. The anode of the second high side sustain switching device Q1X is connected to the cathode of the second low side sustain switching device Q2X. The anode of the second low side sustain switching device Q2X is grounded. The node J1X between the second high- and low-side sustain switching devices Q1X and Q2X is connected to the sustain electrode X of the PDP 20.

The second power recovery section 4X includes a second recovery capacitor CX, a second high side recovery switching device Q3X, a second low side recovery switching device Q4X, a second high side diode D1X, a second low side diode D2X, and a second inductor LX. The capacitance of the second recovery capacitor CX is sufficiently larger than that of the panel capacitance Cp of the PDP 20. The voltage across the second recovery capacitor CX is maintained substantially equal to half Vs/2 of the output voltage Vs of the power supply section Es. The two recovery switching devices Q3X and Q4X are preferably MOSFETs, or alternatively, may be IGBTs or bipolar transistors. Further preferably, they are wide band gap semiconductor switching devices.

One end of the second recovery capacitor CX is grounded, and the other end is connected to the cathode of the second high side recovery switching device Q3X and the anode of the second low side recovery switching device Q4X. The anode of the second high side recovery switching device Q3X is connected to the anode of the second high side diode D1X. The cathode of the second high side diode D1X is connected to the anode of the second low side diode D2X. The cathode of the second low side diode D2X is connected to the cathode of the second low side recovery switching device Q4X. The node J2X between the second high and low side diodes D1X and D2X is connected to one end of the second inductor LX. The other end of the second inductor LX is connected to the node J1X between the two sustain switching devices Q1X and Q2X. Aside from the configuration shown in FIG. 2, the second power recovery section 4X may have the configuration, for example, shown in FIG. 3B.

Figure 4:
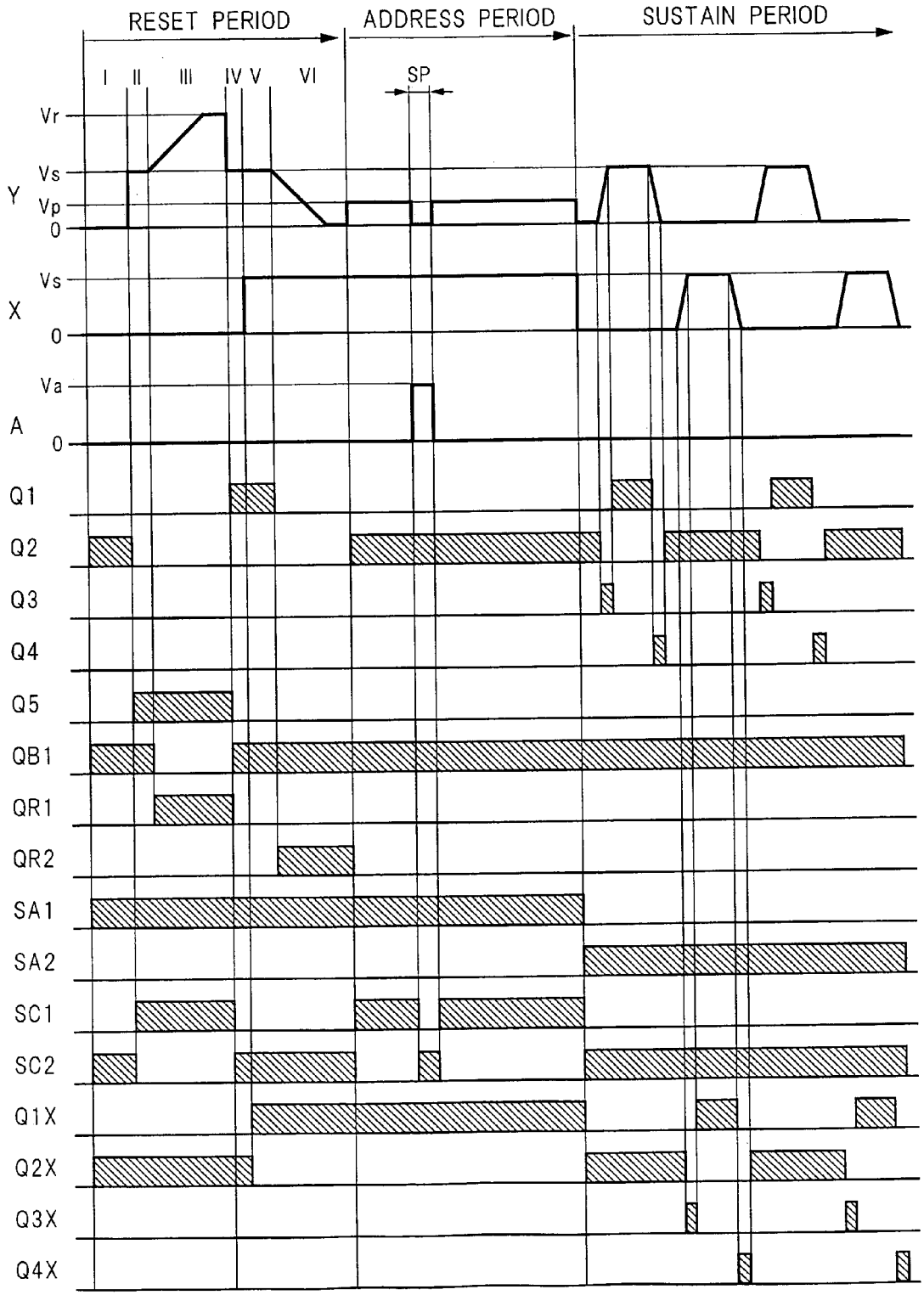
FIG. 4 is, regarding Embodiment 1 of the invention, a waveform chart that shows the voltages applied to the scan, sustain, and address electrodes Y, X, and A of the PDP 20, and the ON periods of the switching devices Q1-Q5, QB1, QR1, QR2, SA1, SA2, SC1, and SC2 included in the scan electrode driver section 11, and the ON periods of the switching devices Q1X-Q4X included in the sustain electrode driver section 12, in the reset, address, and sustain periods.

Each potential of the scan, sustain, and address electrodes Y, X, and A of the PDP 20 changes during the reset, address, and sustain periods as follows. See FIG. 4. In FIG. 4, hatched areas show the ON periods of the switching devices Q1-Q5, QB1, QR1, QR2, SA1, SA2, SC1, and SC2 included in the scan electrode driver section 11, and the switching devices Q1X-Q4X included in the sustain electrode driver section 12.

During the reset period, the application of the reset voltage pulses changes the potentials of the scan and sustain electrodes Y and X. On the other hand, the address electrode A is maintained at the ground potential (nearly equal to 0). According to the changes in the reset voltage pulses, the reset period is divided into the following six modes I-VI. The ON and OFF states of the switching devices included in the scan and sustain electrode driver sections 11 and 12 are switched to each other mode by mode. Note that, during the reset period, the high- and low-side auxiliary switching devices SA1 and SA2 are maintained in the ON and OFF states, respectively. Furthermore, all the recovery switching devices Q3, Q4, Q3X, and Q4X are maintained in the OFF state.

<Mode I>

In the scan electrode driver section 11, the first low side sustain switching device Q2, the first bypass switching device QB1 and the low side scan switching device SC2 are turned on. Thereby, the sustaining pulse transmission path J1-SC2 and the scan electrode Y are maintained at the ground potential. In the sustain electrode driver section 12, the second low side sustain switching device Q2X is turned on. Thereby, the sustain electrode X is maintained at the ground potential.

<Mode II>

In the scan electrode driver section 11, the first low side sustain switching device Q2 and the low side scan switching device SC2 are turned off, and the high side scan switching device SC1 and the reset switch section Q5 are turned on. Thereby, the scan electrode Y is maintained at a potential higher than the potential Vt of the positive voltage source Et by the voltage V1 of the first constant-voltage source E1, that is, the potential Vs of the power supply section Es: Vs=Vt+V1. The sustaining pulse transmission path J1-SC2 is maintained at the potential Vt of the positive voltage source Et. In other words, the potential Vt is lower than the potential Vs of the power supply section Es by the voltage V1 of the first constant-voltage source E1: Vt=Vs−V1. The sustain electrode driver section 12 maintains the state in the mode I, and thereby, the sustain electrode X is maintained at the ground potential.

<Mode III>

In the scan electrode driver section 11, the first bypass switching device QB1 is turned off, and the high side ramp wave generating section QR1 is turned on. Thereby, the potential of the scan electrode Y rises by the voltage V2 of the second constant-voltage source E2 at a constant rate, and reaches the upper limit Vr=Vs+V2 of the reset voltage pulse. In other words, the reset voltage pulse reaches the upper limit Vr in the ON period of the high side scan switching device SC1. The transmission path of the reset voltage pulse, which is hereafter referred to as the high side reset pulse transmission path, runs from the anode of the high side ramp wave generating section QR1 through the high side auxiliary switching device SA1 to the cathode of the high side scan switching device SC1. The sustaining pulse transmission path J1-SC2 is connected through the two constant-voltage sources E1 and E2 to the high side reset pulse transmission path QR1-SA1-SC1. Accordingly, the sustaining pulse transmission path J1-SC2 is maintained at the potential Vt of the positive voltage source Et. In other words, the potential Vt is lower than the potential Vs of the power supply section Es by the voltage V1 of the first constant-voltage source E1: Vt=Vs−V1. The sustain electrode driver section 12 maintains the state in the mode II, and thereby, the sustain electrode X is maintained at the ground potential. Thus, the voltages applied to all the discharge cells of the PDP 20 uniformly rise to the upper limit Vr of the reset voltage pulse at a comparatively low rate. Thereby, uniform wall charges accumulate in all the discharge cells of the PDP 20. In that case, the discharge cells are allowed to emit extremely feeble light, since the rising rate of the applied voltages are low.

In the mode II and III as described above, the sum Vt+V1=Vs of the voltages of the positive voltage source Et and the first constant-voltage source E1 is used instead of the potential Vs of the power supply section Es. Alternatively, the series connection of the positive voltage source Et and the reset switch section Q5 may be omitted. In that case, the sum V1+V2 of the voltages of the first and second constant-voltage sources E1 and E2 is set at either the upper limit Vr of the reset voltage pulse or a level Vr−Vs lower than the upper limit Vr by the output voltage Vs of the power supply section Es. In the mode II, the scan electrode Y is maintained at a potential higher than either the ground potential or the potential Vs of the power supply section Es, by the voltage V1 of the first constant-voltage source E1, depending on the ON and OFF states of the two sustain switching devices Q1 and Q2. In the mode III, the potential of the scan electrode Y rises from the potential in the mode II to the upper limit Vr of the reset voltage pulse. Over the modes II and III, the sustaining pulse transmission path J1-SC2 is maintained at either the ground potential or the potential Vs of the power supply section Es.

In the above-described example, the sum Vt+V1 of the voltages of the positive voltage source Et and the first constant-voltage source E1 is set equal to the potential Vs of the power supply section Es: Vt+V1=Vs. Alternatively, the voltage sum Vt+V1 may be set higher than the potential Vs of the power supply section Es: Vt+V1>Vs. In that case, the potential of the scan electrode Y is higher than the above-described value Vs at the start of the mode III, and thus, the time required for the reset voltage pulse to reach the upper limit Vr, that is, the duration of the mode III is reduced. Accordingly, the whole duration of the reset period is reduced.

<Mode IV>

In the scan electrode driver section 11, the high side ramp wave generating section QR1, the reset switch section Q5, and the high side scan switching device SC1 are turned off, and the first high side sustain switching device Q1, the first bypass switching device QB1, and the low side scan switching device SC2 are turned on. Thereby, the potential of the scan electrode Y falls to the potential Vs of the power supply section Es. On the other hand, the sustaining pulse transmission path J1-SC2 is maintained at the potential Vs of the power supply section Es. The sustain electrode driver section 12 maintains the state in the mode III, and thereby, the sustain electrode X is maintained at the ground potential.

<Mode V>

The scan electrode driver section 11 maintains the state in the mode IV, and thereby, both the sustaining pulse transmission path J1-SC2 and the scan electrode Y are maintained at the potential Vs of the power supply section Es. In the sustain electrode driver section 12, the second low side sustain switching device Q2X is turned off, and the second high side sustain switching device Q1X is turned on. Thereby, the potential of the sustain electrode X rises to the potential Vs of the power supply section Es. Thus, the scan and sustain electrodes Y and X are maintained at the same potential Vs.

<Mode VI>

In the scan electrode driver section 11, the first high side sustain switching device Q1 is turned off, and the low side ramp wave generating section QR2 is turned on. Thereby, both the potentials of the sustaining pulse transmission path J1-SC2 and the scan electrode Y fall at a constant rate from the potential Vs of the power supply section Es to the ground potential. In other words, the reset voltage pulse reaches to the lower limit, or the ground potential, in the ON period of the low side scan switching device SC2. The transmission path of the reset voltage pulse, which is hereafter referred to as a low side reset pulse transmission path, runs from the cathode of the low side ramp wave generating section QR2 to the anode of the low side scan switching device SC2. The sustaining pulse transmission path J1-SC2 overlaps the low side reset pulse transmission path QR2-SC2. However, the lower limit of the reset voltage pulse is equal to the ground potential as well as the lower limit of the sustaining voltage pulse. Accordingly, the sustaining pulse transmission path J1-SC2 is maintained at a potential equal to or above the ground potential. The sustain electrode driver section 12 maintains the state in the mode V, and thereby, the sustain electrode X is maintained at the potential Vs of the power supply section Es. Thus, the voltage opposite in polarity to the voltages applied in the mode II-V is applied uniformly to all the discharge cells of the PDP 20. In particular, the applied voltage falls at a comparatively low rate. Thereby, the wall charges are eliminated uniformly and evened in all the discharge cells. In that case, the discharge cells are allowed to emit extremely feeble light, since the falling rate of the applied voltages are low.

During the address period, in the sustain electrode driver section 12, the second high side sustain switching device Q1X is maintained in the ON state, and the remainder of the switching devices are maintained in the OFF state. Thereby, the sustain electrode X is maintained at the potential Vs of the power supply section Es. In the scan electrode driver section 11, the first low side sustain switching device Q2, the first bypass switching device QB1, and high side auxiliary switching device SA1 are maintained in the ON state. Accordingly, the cathode of the high side scan switching device SC1 is maintained at a potential Vp=V1 higher than the ground potential by the voltage V1 of the first constant-voltage source E1. The potential Vp is hereafter referred to as the upper limit of the scan voltage pulse. On the other hand, the sustaining pulse transmission path J1-SC2, especially the anode of the low side scan switching device SC2, is maintained at the ground potential.

At the start of the address period, for all the scan electrodes Y1, Y2, Y3, . . . (cf. FIG. 1), the high- and low-side scan switching devices SC1 and SC2 are maintained in the ON and OFF states, respectively. Thereby, all the scan electrodes Y are maintained uniformly at the upper limit Vp of the scanning voltage pulse. The scan electrode driver section 11 next changes each potential of the scan electrodes Y1, Y2, Y3, . . . in sequence as follows. See the scan voltage pulse SP shown in FIG. 4. When one Y of the scan electrodes is selected, the high- and low-side scan switching devices SC1 and SC2 connected to the scan electrode Y are turned off and on, respectively. Thereby, the potential of the scan electrode Y falls to the ground potential. When the scan electrode Y is maintained at the ground potential for a predetermined time, the low- and high-side scan switching devices SC2 and SC1 connected to the scan electrode Y are turned of f and on, respectively. Thereby, the potential of the scan electrode Y rises to the upper limit Vp of the scan voltage pulse. The scan electrode driver section 11 performs the similar switching operation for the series connections 1S of the scan switching devices SC1 and SC2 connected to the scan electrodes Y1, Y2, Y3, . . . , in sequence. Thus, the scan voltage pulse SP is applied to the scan electrodes Y1, Y2, Y3, . . . , one after another.

During the address period, the address electrode driver section 13 selects one A of the address electrodes, based on the video signal received from the outside, and then, raises the potential of the selected address electrode A to the upper limit Va of the signal voltage pulse for a predetermined time. When the scan voltage pulse SP is applied to one Y of the scan electrodes and the signal voltage pulse Va is applied to one A of the address electrodes, for example, as shown in FIG. 3, the voltage between the scan and address electrodes Y and A is higher than voltages between the other electrodes. Accordingly, the gas discharge occurs in the discharge cell located at the intersection between the scan and address electrodes Y and A. Because of the gas discharge, new wall charges accumulate on the surfaces of the discharge cell.

During the sustain period, the scan and sustain electrode driver sections 11 and 12 alternately apply the sustaining voltage pulses to the scan electrodes Y1, Y2, Y3, . . . and the sustain electrodes X1, X2, X3, . . . , respectively, as follows. In that case, the discharge in gas and the accumulation of wall charges are repeated, and thereby, the light emission of the phosphors is sustained in the discharge cells where the wall charges have accumulated during the address.

During the sustain period, in the scan pulse generating section 1A, the first bypass switching device QB1, the low side auxiliary switching device SA2, and the low side scan switching device SC2 are maintained in the ON state, and the high side auxiliary switching device SA1 and the high side scan switching device SC1 are maintained in the OFF state. Thereby, the first sustaining pulse generating section 3A raises and lowers the potential of the scan electrode Y through the sustaining pulse transmission path J1-SC2 and the low side scan switching device SC2, as follows. In that case, the potential of the sustaining pulse transmission path J1-SC2 changes between the potential Vs of the power supply section Es and the ground potential (nearly equal to 0). In other words, the upper and lower limits of the sustaining voltage pulse are equal to the potential Vs of the power supply section Es and the ground potential, respectively.

At the start of the sustain period, the first and second low side sustain switching devices Q2 and Q2X are maintained in the ON state in the first and second sustaining pulse generating sections 3A and 3X, respectively. The remainder of the switching devices are maintained in the OFF state. Thereby, both the scan and sustain electrodes Y and X are maintained at the ground potential.

In the first sustaining pulse generating section 3A, the first high side recovery switching device Q3 is turned on. Thereby, the following loop is brought into conduction: a ground terminal→the first recovery capacitor C→the first high side recovery switching device Q3→the first high side diode D1→the first inductor L→the low side scan switching device SC2→the panel capacitance Cp→the second low side sustain switching device Q2X→a ground terminal, where the arrows show the direction of the current. See FIG. 2. At that time, the series circuit of the first inductor L and the panel capacitance Cp resonates under the application of the voltage Vs/2 from the first recovery capacitor C. Accordingly, the potentials of the sustaining pulse transmission path J1-SC2 and the scan electrode Y rise smoothly.

When the resonance current decays to a level substantially equal to zero, the potential of the scan electrode Y reaches the upper limit Vs of the sustaining voltage pulse, in synchronization with the first high side diode D1 turned off. At that time, the first high side recovery switching device Q3 is turned off, and the first high side sustain switching device Q1 is turned on. Thereby, the potentials of the sustaining pulse transmission path J1-SC2 and the scan electrode Y are clamped to the upper limit Vs of the sustaining voltage pulse. When the electric discharge is sustained in the PDP 20, power for sustaining the discharge current is provided from the power supply section Es through the first high side sustain switching device Q1.

When the scan electrode Y is maintained at the upper limit Vs of the sustaining voltage pulse for a predetermined time, in the first sustaining pulse generating section 3A, the first high side sustain switching device Q1 is turned off, and the first low side recovery switching device Q4 is turned on. Thereby, the following loop is brought into conduction: a ground terminal→the second low side sustain switching device Q2X→the panel capacitance Cp→the low side scan switching device SC2→the first inductor L→the first low side diode D2→the first low side recovery switching device Q4→the first recovery capacitor C→a ground terminal. The arrows show the direction of the currents. See FIG. 2. At that time, the series circuit of the first inductor L and the panel capacitance Cp resonates because of the application of the voltage Vs/2 between the scan electrode Y and the first recovery capacitor C. Accordingly, the potentials of the sustaining pulse transmission path J1-SC2 and the scan electrode Y fall smoothly.

When the resonance current decays to a level substantially equal to zero, the potentials of the sustaining pulse transmission path J1-SC2 and the scan electrode Y reach the ground potential, in synchronization with the first low side diode D2 turned off. At that time, the first low side recovery switching device Q4 is turned off, and the first low side sustain switching device Q2 is turned on. Thereby, the potentials of the sustaining pulse transmission path J1-SC2 and the scan electrode Y are clamped to the ground potential.

During the sustain period, the low side auxiliary switching device SA2 is maintained in the ON state, and thus, the current flowing from the scan electrode Y toward the output terminal J1 of the first sustaining pulse generating section 3A can pass through not only the low side scan switching device SC2 but also the body diode of the high side scan switching device SC1. Thereby, an occurrence of latch up due to an increase in the amount of current is effectively prevented at the series connection 1S of the scan switching devices SC1 and SC2.

In the first sustaining pulse generating section 3A, the first low side sustain switching device Q2 is maintained in the ON state, and thereby, both the sustaining pulse transmission path J1-SC2 and the scan electrode Y are maintained at the ground potential.

In the second sustaining pulse generating section 3X, at first, the second low side sustain switching device Q2X is turned off, and the second high side recovery switching device Q3X is turned on. The remainder of the switching devices are maintained in the OFF state. Thereby, the following loop is brought into conduction: a ground terminal→the second recovery capacitor CX→the second high side recovery switching device Q3X→the second high side diode D1X→the second inductor LX→the panel capacitance Cp→the low side scan switching device SC2→the first low side sustain switching device Q2→a ground terminal. The arrows show the direction of the current. See FIG. 2. At that time, the series circuit of the second inductor LX and the panel capacitance Cp resonates because of the application of the voltage Vs/2 from the second recovery capacitor CX. Accordingly, the potential of the sustain electrode X rises smoothly.

When the resonance current decays substantially equal to zero, the potential of the sustain electrode X reaches the upper limit Vs of the sustaining voltage pulse, in synchronization with the second high side diode D1X turned off. At that time, the second high side recovery switching device Q3X is turned off, and the second high side sustain switching device Q1X is turned on. Thereby, the potential of the sustain electrode X is clamped to the upper limit Vs of the sustaining voltage pulse. When the electric discharge is sustained in the PDP 20, the power for maintaining the discharge current is supplied from the power supply section Es through the second high side sustain switching device Q1X.

When the sustain electrode X is maintained at the upper limit Vs of the sustaining voltage pulse for a predetermined time, in the second sustaining pulse generating section 3X, the second high side sustain switching device Q1X is turned off, and the second low side recovery switching device Q4X is turned on. Thereby, the following loop is brought into conduction: a ground terminal→the first low side sustain switching device Q2→the low side scan switching device SC2→the panel capacitance Cp→the second inductor. LX→the second low side diode D2X→the second low side recovery switching device Q4X→the second recovery capacitor CX→a ground terminal. The arrows show the direction of the current. See FIG. 2. At that time, the series circuit of the second inductor LX and the panel capacitance Cp resonate because of the application of the voltage Vs/2 between the sustain electrode X and the second recovery capacitor CX. Accordingly, the potential of the sustain electrode X falls smoothly.

When the resonance current decays substantially equal to zero, the potential of the sustain electrode X reaches the ground potential, in synchronization with the second low side diode D2X turned off. At that time, the second low side recovery switching device Q4X is turned off, and the second low side sustain switching device Q2X is turned on. Thereby, the potential of the sustain electrode X is clamped to the ground potential.

The power supplied from the first recovery capacitor C to the panel capacitance Cp because of the potential rise in the scan electrode Y is recovered from the panel capacitance Cp to the first recovery capacitor C because of the potential fall in the scan electrode Y. Similarly, the power supplied from the second recovery capacitor CX to the panel capacitance Cp because of the potential rise in the sustain electrode X is recovered from the panel capacitance Cp to the second recovery capacitor CX because of the potential fall in the sustain electrode X. Thus, at the rising or falling edges of the sustaining voltage pulses, the inductor L or LY resonates with the panel capacitance Cp of the PDP 20, and thereby, the recovery capacitor C or CX efficiently exchanges power with the panel capacitance Cp. In other words, at the application of the sustaining voltage pulses, reactive power caused by the charging and discharging of the panel capacitance is reduced. Note that the switching operation quite similar to the above-described one may be applied in the case where the power recovery sections 4 and 4X comprise the configuration of FIG. 3B. In particular, whichever node J1, J2, or J3 the second ends 41 and 42 of the two inductors L1 and L2 are connected to, the switching operation may be applied in common.

Figure 24:
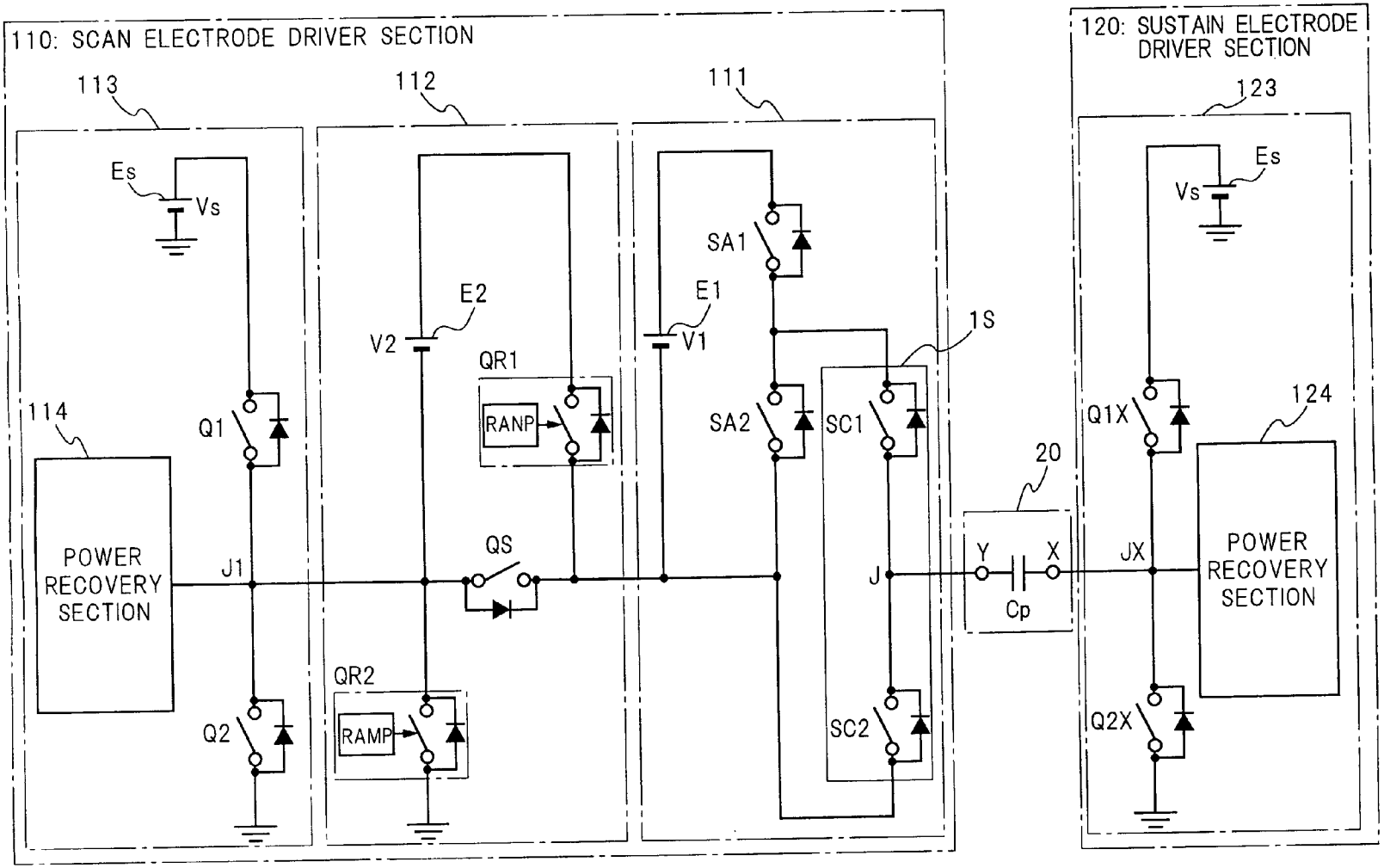
FIG.24 PRIOR ART
FIG. 24 is the equivalent circuit diagram that shows the scan and sustain electrode driver sections 110 and 120 of the conventional PDP driver and the PDP 20.
Figure 25:
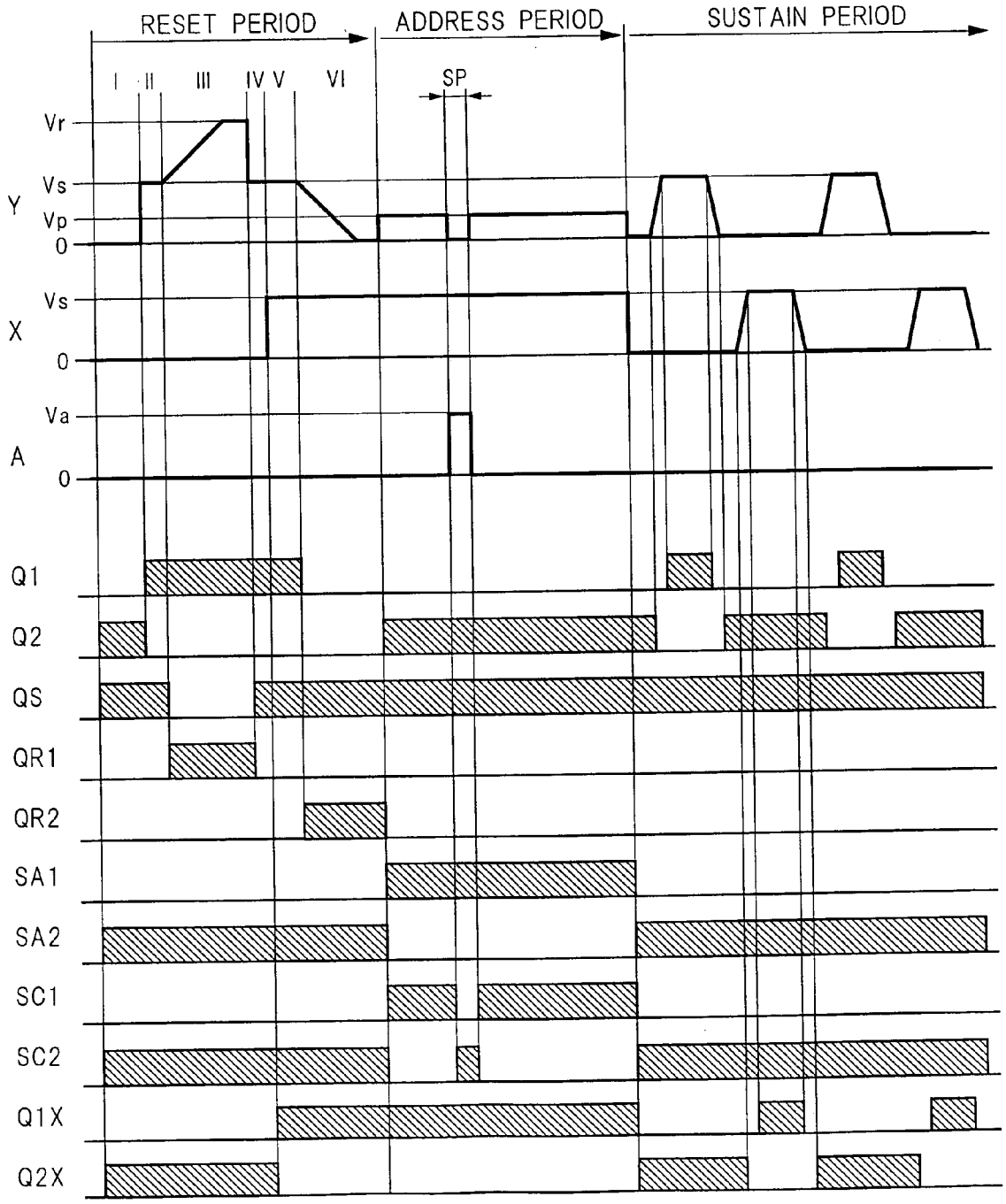
FIG.25 PRIOR ART
FIG. 25 is, regarding the conventional PDP driver, the waveform chart that shows the voltages applied to the scan, sustain, and address electrodes Y, X, and A of the PDP 20, and the ON periods of the switching devices Q1, Q2, QS, QR1, QR2, SA1, SA2, SC1, and SC2 included in the scan electrode driver section 110, and the ON periods of the switching devices Q1X and Q2X included in the sustain electrode driver section 120, in the reset, address, and sustain periods.

In the PDP driver 10 according to Embodiment 1 of the invention, the potential of the sustaining pulse transmission path (from the output terminal J1 of the first sustaining pulse generating section 3A to the anode of the low side scan switching device SC2) is maintained within the range in change of the sustaining voltage pulse (from the ground potential through the potential Vs of the power supply section Es) over both the reset and address periods, as described above. Accordingly, the reset voltage pulse reliably reaches the predetermined upper or lower limit Vr or −Vn, without being clamped to the upper or lower limit Vs or nearly 0 of the sustaining voltage pulse, even if no separation switching device is installed, in contrast to the conventional driver (cf. FIG. 24). Thus, the PDP driver 10 according to Embodiment 1 of the invention reduces the conduction loss at the separation switching device, and therefore, have the power consumption lower than the conventional driver, and furthermore, is easy to miniaturize by the removal of the separation switching device. In addition, ringing included in the voltages applied to the PDP is reduced since parasitic inductances due to the circuit elements and conducting paths on the sustaining pulse transmission path are reduced. As a result, the PDP driver 10 according to Embodiment 1 of the invention also has advantage in further improvement in high image quality of the plasma display.

The negative electrode of the second constant-voltage source E2 is connected to the positive electrode of the first constant-voltage source E1 in the above-described reset pulse generating section 2A according to Embodiment 1 of the invention. Alternatively, the negative electrode of the second constant-voltage source E2 may be grounded and separated from the first constant-voltage source E1. In that case, the voltage V2 of the second constant-voltage source E2 is set at a level higher than the level in the above-described example by the output voltage Vs of the power supply section Es, that is, the upper limit Vr of the reset voltage pulse. Furthermore, when the upper limit Vr of the reset voltage pulse is lower than the sum Vs+V1 of the output voltage Vs of the power supply section Es and the voltage V1 of the first constant-voltage source E1 (V2=Vr<Vs+V1), the positive electrode of the first constant-voltage source E1 may be coupled directly to the cathode of the high side auxiliary switching device SA1. Thereby, the component count can be reduced since the first bypass switching device QB1 can be eliminated. In addition, the withstand voltages of the two scan switching devices SC1 and SC2 may be approximately the voltage V1 of the first constant-voltage source E1, and therefore, the conduction losses and sizes can be reduced.

Embodiment 2

A plasma display according to Embodiment 2 of the invention comprises a configuration quite similar to that of the above-described plasma display according to Embodiment 1 (cf. FIG. 1). Accordingly, for the details of the configuration, the explanation of the above-described Embodiment 1 and FIG. 1 are cited.

A sustain electrode driver section according to Embodiment 2 of the invention (not shown) comprises a configuration quite similar to that of the sustain electrode driver section 12 according to Embodiment 1 (cf. FIG. 2). Accordingly, for the details of the configuration, the explanation of Embodiment 1 and FIG. 2 are cited.

Figure 5:
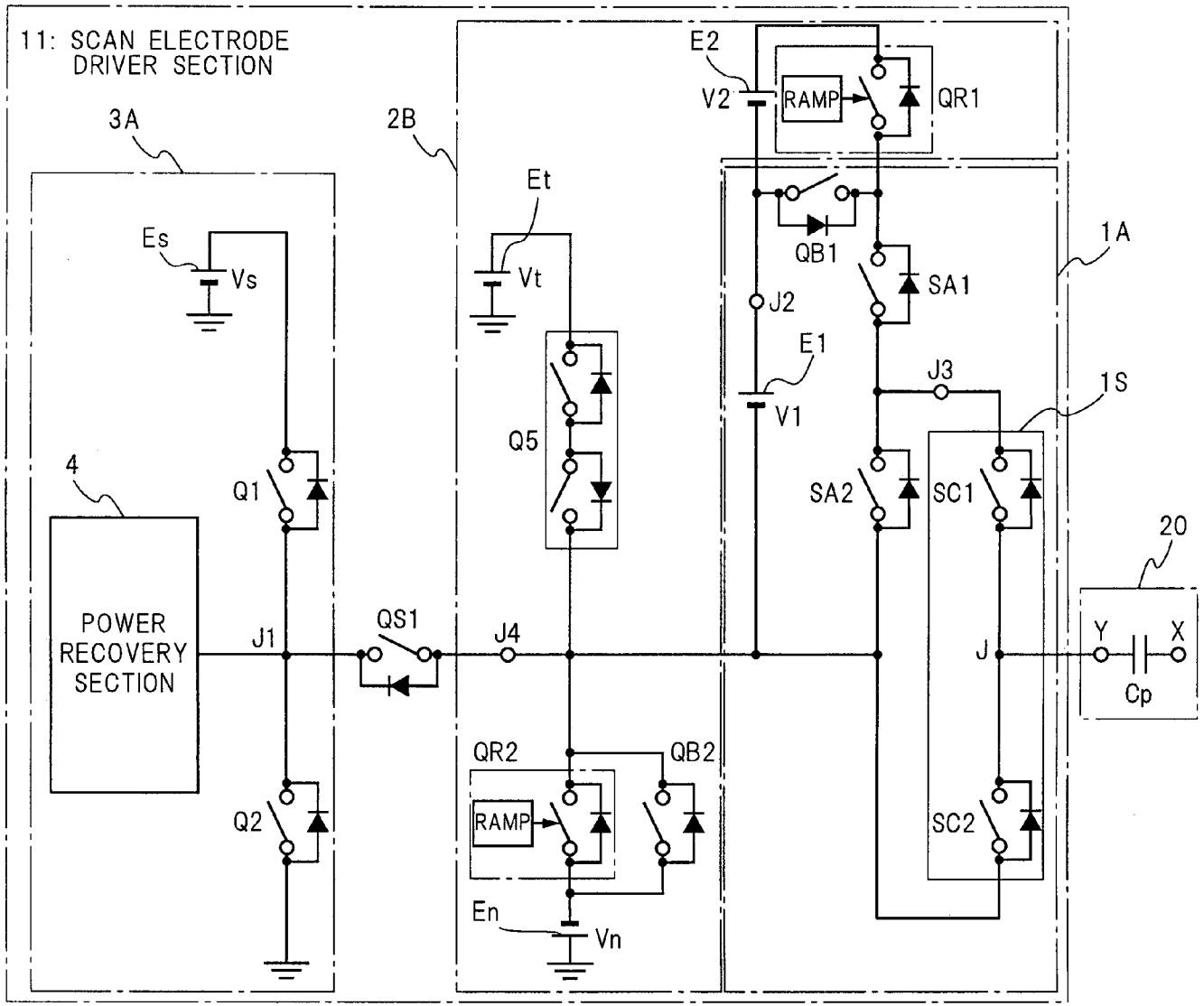
FIG. 5 is an equivalent circuit diagram that shows the scan electrode driver section 11 according to Embodiment 2 of the invention and the PDP 20, where a first separation switching device QS1 is connected in a first mode.
Figure 6:
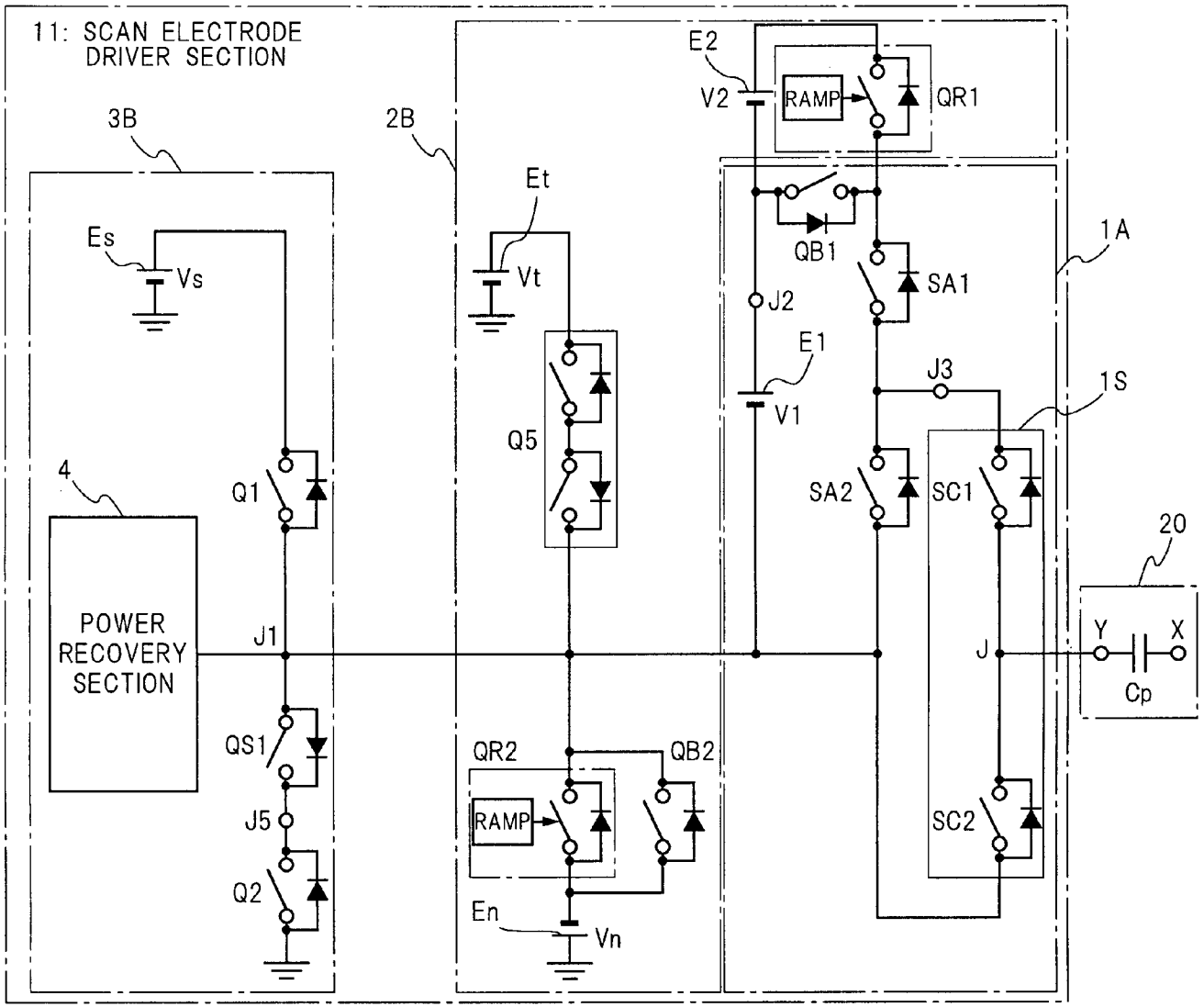
FIG. 6 is an equivalent circuit diagram that shows the scan electrode driver section 11 according to Embodiment 2 of the invention and the PDP 20, where the first separation switching device QS1 is connected in a second mode.

In a scan electrode driver section 11 according to Embodiment 2 of the invention, a reset pulse generating section 2B includes an negative voltage source En and a second bypass switching device QB2, in contrast to the reset pulse generating section 2A according to Embodiment 1 (cf. FIG. 2). See FIGS. 5 and 6. Furthermore, a first separation switching device QS1 is installed. Other components are similar to the components according to Embodiment 1. In FIGS. 5 and 6, the similar components are marked with the same reference symbols as the reference symbols shown in FIG. 2. Furthermore, for the details of the similar components, the explanation of Embodiment 1 of the invention is cited.

The negative voltage source En maintains its output terminal at a constant negative potential −Vn, based on the output voltage Vs of the power supply section Es, by using, for example, a DC-DC converter (not shown). The second bypass switching device QB2 and the first separation switching device QS1 are preferably MOSFETs, or alternatively, may be IGBTs or bipolar transistors. Further preferably, the first separation switching device QS1 is a wide band gap semiconductor switching device. The first separation switching device QS1 may be a parallel connection of more than one switching devices, for example, since the large current capacity is required of the first separation switching device QS1. When the low side ramp wave generating section QR2 has a sufficiently large current capacity, the second bypass switching device QB2 does not need to be installed.

The negative voltage source En is connected to the anode of the low side ramp wave generating section QR2 and the anode of the second bypass switching device QB2. The cathode of the second bypass switching device QB2 is connected to the anode of the low side scan switching device SC2. When the low side ramp wave generating section QR2 or the second bypass switching device QB2 is turned on, the negative voltage −Vn is applied to the anode of the low side scan switching device SC2.

The connection of the first separation switching device QS1 is allowed in either of the following two patterns. In the first pattern, the cathode and anode of the first separation switching device QS1 are connected to the output terminal J1 of the first sustaining pulse generating section 3A and the anode of the low side scan switching device SC2, respectively. See FIG. 5. In the second pattern, the cathode and anode of the first separation switching device QS1 are connected to the cathode of the first low side sustain switching device Q2 and the anode of the first high side sustain switching device Q1. See FIG. 6. The node J1 between the first separation switching device QS1 and the first high side sustain switching device Q1 is the output terminal of the first sustaining pulse generating section 3B, and connected to the anode of the low side scan switching device SC2. The first separation switching device QS1 and the first low side sustain switching device Q2 may be connected in the reversed polarity. In other words, the cathode of the first separation switching device QS1 may be grounded, and its anode may be connected to the anode of the first low side sustain switching device Q2. In any of the above-described two patterns of the connections, the first separation switching device QS1 can cut off a current to flow from the ground terminal through the first low side sustain switching device Q2 and the sustaining pulse transmission path J1-SC2 to the anode of the low side scan switching device SC2.

The first power recovery section 4 has a circuitry exactly equivalent to the first power recovery section 4 according to Embodiment 1 (cf. FIGS. 2 and 3). Accordingly, in FIGS. 5 and 6, an equivalent circuit of the first power recovery section 4 is omitted from illustration. For the details of the equivalent circuit, the explanation of Embodiment 1 and FIGS. 2 and 3 are cited. In particular, when the first power recovery section 4 includes two inductors L1 and L2 as shown in FIG. 3B, their second ends 41 and 42 may be connected to the same node or separate nodes. In FIG. 5, the second ends 41 and 42 of the inductors L1 and L2 are connected to one in common, or two separately, of the following, for example: the conducting path coupled directly to the output terminal J1 of the first sustaining pulse generating section 3A; the conducting path coupled directly to the positive electrode of the first constant-voltage source E1 (e.g., the node J2); the conducting path coupled directly to the cathode of the high side scan switching device SC1 (e.g., the node J3); and the conducting path coupled directly to the anode of the first separation switching device QS1 (e.g., the node J4). In FIG. 6, the second ends 41 and 42 of the inductors L1 and L2 are connected to one in common, or two separately, of the following, for example: the node J1 on the sustaining pulse transmission path J1-SC2; the conducting path coupled directly to the positive electrode of the first constant-voltage source E1 (e.g., the node J2); the conducting path coupled directly to the cathode of the high side scan switching device SC1 (e.g., the node J3); and the conducting path between the first separation switching device QS1 and the first low side sustain switching device Q2 (e.g., the node J5). Note that, when the first separation switching device QS1 and the first low side sustain switching device Q2 are connected to each other in the polarity opposite to the polarity shown in FIG. 6, the first power recovery section 4 is not connected to the node J5 of the switching devices, since the first power recovery section 4 should be connected to the scan electrode Y during the periods when the two sustain switching devices Q1 and Q2 are both maintained in the OFF state (dead times) in the sustain period. See FIG. 4.

Figure 7:
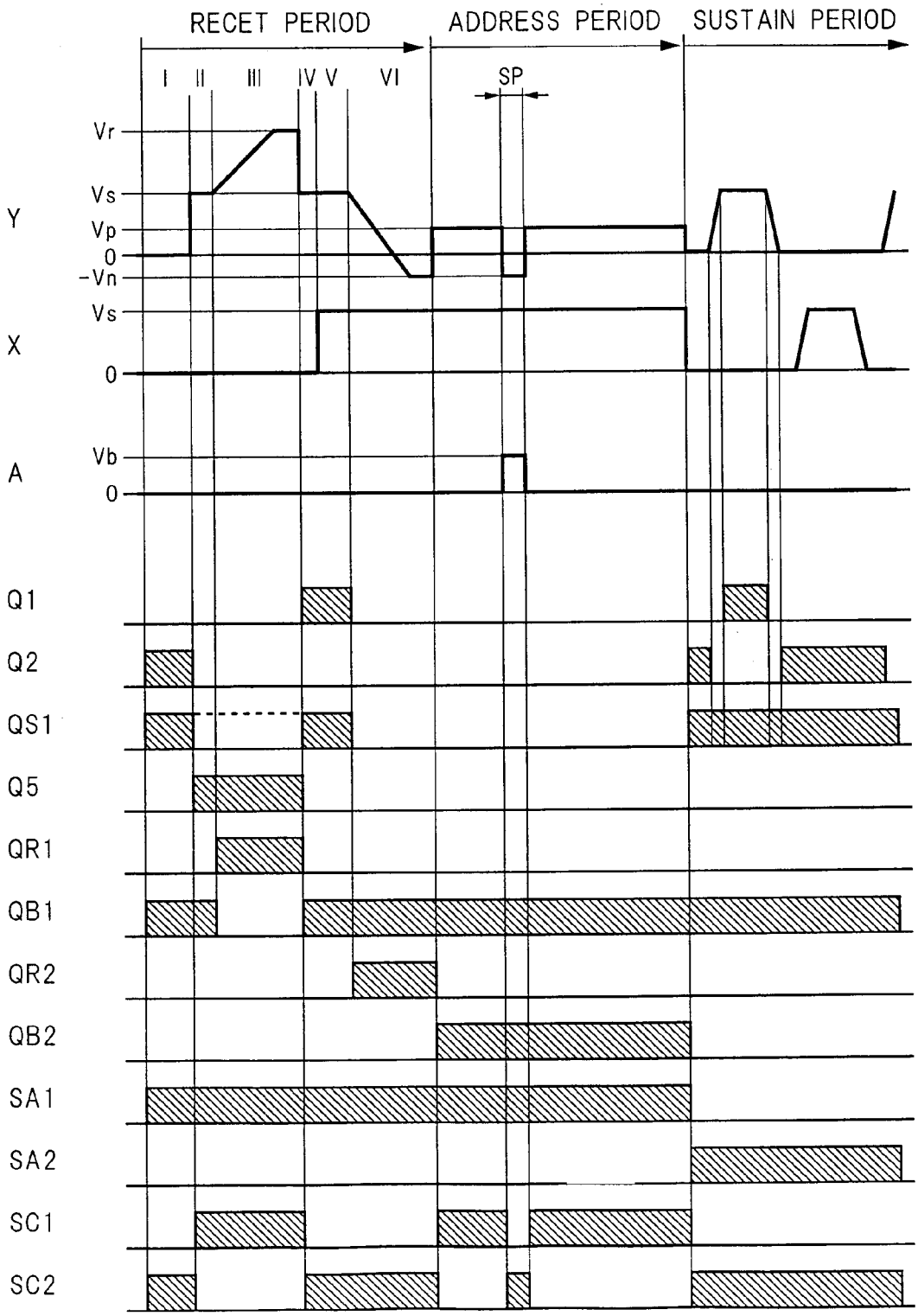
FIG. 7 is, regarding Embodiment 2 of the invention, a waveform chart that shows the voltages applied to the scan, sustain, and address electrodes Y, X, and A of the PDP 20, and the ON periods of the switching devices Q1, Q2, QS1, Q5, QR1, QB1, QR2, QB2, SA1, SA2, SC1, and SC2 included in the scan electrode driver section 11, in the reset, address, and sustain periods.

In the reset, address, and sustain periods, the potentials of the scan, sustain, and address electrodes Y, X, and A of the PDP 20 change as follows. See FIG. 7. In FIG. 7, hatched areas show the ON periods of the switching devices Q1, Q2, QS1, Q5, QR1, QB1, QR2, QB2, SA1, SA2, SC1, and SC2 included in the scan electrode driver section 11.

During the reset period, the application of the reset voltage pulses changes the potentials of the scan and sustain electrodes Y and X. On the other hand, the address electrode A is maintained at the ground potential (nearly equal to 0). Depending on the changes in the reset voltage pulse, the reset period is divided into the following six modes I-VI. The ON and OFF states of the switching devices included in the scan electrode driver section 11 are switched to each other mode by mode. However, during the reset period, the high side auxiliary switching device SA1 is maintained in the ON state, and the second bypass switching device QB2 and the low side auxiliary switching device SA2 are maintained in the OFF state.

<Mode I>

The first low side sustain switching device Q2, the first separation switching device QS1, the first bypass switching device QB1, and the low side scan switching device SC2 are turned on. Thereby, the sustaining pulse transmission path J1-SC2 and the scan electrode Y are maintained at the ground potential.

<Mode II>

The first low side sustain switching device Q2 and the low side scan switching device SC2 are turned off, and the reset switch section Q5 and the high side scan switching device SC1 are turned on. Thereby, the potential of the scan electrode Y rises to a potential high than the potential Vt of the positive voltage source Et by the voltage V1 of the first constant-voltage source E1, that is, the potential Vs of the power supply section Es: Vt+V1=Vs. The sustaining pulse transmission path J1-SC2, in particular the anode of the low side scan switching device SC2, is maintained at the potential Vt of the positive voltage source Et. The potential Vt is lower than the potential Vs of the power supply section Es by the voltage V1 of the first constant-voltage source E1. Accordingly, during the mode II, at least one of the first separation and high-side-sustain switching devices QS1 and Q1 may be maintained in the OFF state.

<Mode III>

The first bypass switching device QB1 is turned off, and the high side ramp wave generating section QR1 is turned on. Thereby, the potential of the scan electrode Y rises at a constant rate by the voltage V2 of the second constant-voltage source E2, and reaches the upper limit Vr=Vs+V2 of the reset voltage pulse. In other words, the reset voltage pulse reaches the upper limit Vr during the ON period of the high side scan switching device SC1. The sustaining pulse transmission path J1-SC2 is connected to the high side reset pulse transmission path QR1-SA1-SC1 through the two constant-voltage sources E1 and E2. Accordingly, the sustaining pulse transmission path J1-SC2, in particular the anode of the low side scan switching device SC2, is maintained at the potential Vt of the positive voltage source Et. The potential Vt is lower than the potential Vs of the power supply section Es by the voltage V1 of the first constant-voltage source E1. Therefore, in the mode III similarly to the mode II, at least one of the first separation and high-side-sustain switching devices QS1 and Q1 may be maintained in the OFF state. Thus, voltages applied to all the discharge cells of the PDP 20 uniformly rises to the upper limit Vr of the reset voltage pulse at a comparatively slow rate. Thereby, uniform wall charges accumulate in all the discharge cells of the PDP 20. At that time, the rising rate of the applied voltage is low, and thereby, the light emitted by the discharge cell is very feeble.

In the modes II and III as described above, the sum Vt+V1=Vs of the voltages of the positive voltage source Et and the first constant-voltage source E1 is used, instead of the potential Vs of the power supply section Es. Alternatively, the series connection of the positive voltage source Et and the reset switch section Q5 may be omitted. In that case, the sum V1+V2 of the voltages of the first and second constant-voltage sources E1 and E2 is set at either the upper limit Vr of the reset voltage pulse or a level Vr−Vs lower than the upper limit Vr by the output voltage Vs of the power supply section Es. Furthermore, the first separation switching device QS1 is maintained in the ON state. In the mode II, the scan electrode Y is maintained at a potential higher than either the ground potential or the potential Vs of the power supply section Es by the voltage V1 of the first constant-voltage source E1, depending on the ON and OFF states of the two sustain switching devices Q1 and Q2. In the mode III, the potential of the scan electrode Y rises from the potential in the mode II to the upper limit Vr of the reset voltage pulse. The sustaining pulse transmission path J1-SC2 is, over the modes II and III, maintained at either the ground potential or the potentials Vs of the power supply section Es.

In the above-described example, the sum Vt+V1 of the voltages of the positive voltage source Et and the first constant-voltage source E1 is set equal to the potential Vs of the power supply section Es: Vt+V1=Vs. Alternatively, the sum Vt+V1 of the voltages may be set higher than the potential Vs of the power supply section Es: Vt+V1>Vs. In that case, at the start of the mode III, the potential of the scan electrode Y is higher than the above-described level Vs, and thus, the time required for the reset voltage pulse to reach the upper limit Vr, that is, the duration of the mode III is reduced. Accordingly, the whole of the reset period is reduced.

<Mode IV>

The reset switch section Q5, the high side ramp wave generating section QR1, and the high side scan switching device SC1 are turned off, and the first high side sustain switching device Q1, the first separation switching device QS1, the first bypass switching device QB1, and the low side scan switching device SC2 are turned on. Note that the first separation switching device QS1 does not need to be turned on in FIG. 6. Thereby, the potential of the scan electrode Y falls to the potential Vs of the power supply section Es. On the other hand, a sustaining pulse transmission path J1-SC2 is maintained at the potential Vs of the power supply section Es.

<Mode V>

In the scan electrode driver section 11, the state of the mode IV is maintained, and thus, the sustaining pulse transmission path J1-SC2 and the scan electrode Y are both maintained at the potential Vs of the power supply section Es. In the sustain electrode driver section 12, the second low side sustain switching device Q2X is turned off, and the second high side sustain switching device Q1X is turned on. See FIG. 2. Thereby, the potential of the sustain electrode X rises to the potential Vs of the power supply section Es. Thus, the scan and sustain electrodes Y and X are maintained at the same potential Vs.

<Mode VI>

The first high side sustain switching device Q1 and the first separation switching device QS1 are turned off, and the low side ramp wave generating section QR2 is turned on. Thereby, both the potentials of a part of the sustaining pulse transmission path, which is connected to the anode of the first separation switching device QS1, and the scan electrode Y fall to the potential −Vn of the negative voltage source En at a constant rate. In other words, the reset voltage pulse reaches the lower limit −Vn in the ON period of the low side scan switching device SC2. The low side reset pulse transmission path runs from the cathode of the low side ramp wave generating section QR2 to the anode of the low side scan switching device SC2. The sustaining pulse transmission path J1-SC2 overlaps the low side reset pulse transmission path QR2-SC2. However, the first separation switching device QS1 is maintained in the OFF state, thereby cutting off the current to flow from the output terminal J1 of the first sustaining pulse generating section 3A (or 3B) to the low side scan switching device SC2. Accordingly, the potential of the anode of the first separation switching device QS1, that is, the low side reset pulse transmission path QR2-SC2 can fall reliably to the negative potential −Vn. In other words, the reset voltage pulse reliably reaches its lower limit −Vn, without being clamped to the ground potential, that is, the lower limit of the sustaining voltage pulse. In the sustain electrode driver section 12, the state in the mode V is maintained, and accordingly, the sustain electrode X is maintained at the potential Vs of the power supply section Es. Thus, the voltage opposite in polarity to the voltages applied in the modes II-V is applied uniformly to all the discharge cells of the PDP 20. Thereby, wall charges are uniformly eliminated and evened in all the discharge cells. At that time, the falling rate of the applied voltage is low, and therefore, the light emitted the discharge cell is very feeble. In particular, the lower limit −Vn of the reset voltage pulse is negative, and thus, lower than the lower limit in Embodiment 1 (=the ground potential nearly equal to 0): −Vn<0. Accordingly, the voltages applied to the discharge cells of the PDP 20 are enhanced sufficiently high, and thereby, the wall charges are sufficiently eliminated. Alternatively, the voltage applied to the sustain electrodes X in the reset period may be reduced. Thereby, the power consumption is reduced.

During the address period, the first and second bypass switching devices QB1 and QB2 and the high side auxiliary switching device SA1 are maintained in the ON state, and the first separation switching device QS1 and the low side auxiliary switching device SA2 are maintained in the OFF state. Accordingly, the cathode of the high side scan switching device SC1 is maintained at a potential Vp=V1−Vn higher than the potential −Vn of the negative voltage source En by the voltage V1 of the first constant-voltage source E1. The potential Vp is hereafter referred to as the upper limit of the scan voltage pulse. On the other hand, a part of the sustaining pulse transmission path J1-SC2 connected to the anode of the first separation switching device QS1 (in particular, the anode of the low side scan switching device SC2) is maintained at the potential −Vn of the negative voltage source En, which is hereafter referred to as the lower limit of the scan voltage pulse.

At the start of the address period, for all the scan electrodes Y1, Y2, Y3, and . . . (cf. FIG. 1), the high- and low-side scan switching devices SC1 and SC2 are maintained in the ON and OFF states, respectively. Thereby, all the scan electrodes Y are uniformly maintained at the upper limit Vp of the scan voltage pulse. The scan electrode driver section 11 next changes each potential of the scan electrodes Y1, Y2, Y3, . . . one after another as follows. See the scan voltage pulse SP shown in FIG. 6. When one Y of the scan electrodes is selected, the high- and low-side scan switching devices SC1 and SC2 connected to the scan electrode Y are turned off and on, respectively. Thereby, the potential of the scan electrode Y falls to the lower limit −Vn of the scan voltage pulse. When the potential of the scan electrode Y is maintained at the lower limit −Vn of the scan voltage pulse for a predetermined time, the low- and high-side scan switching devices SC2 and SC1 connected to the scan electrode Y are turned off and on, respectively. Thereby, the potential of the scan electrode Y rises to the upper limit Vp of the scan voltage pulse. The scan electrode driver section 11 performs the switching operations similar to the above-described over the series connections 1S of the scan switching devices SC1 and SC2 connectedto the scan electrode Y1, Y2, Y3, . . . , in sequence. Thus, the scan voltage pulse SP is applied to the scan electrode Y1, Y2, Y3, . . . one after another.

During the address period, the address electrode driver section 13 selects one A of the address electrodes based on the video signal entered from the outside, and raises the potential of the selected address electrode A to the upper limit Vb of the signal voltage pulse in the predetermined time. Here, the upper limit Vb of the signal voltage pulse according to Embodiment 2 of the invention may be lower than the upper limit Va in Embodiment 1 of the invention (cf. FIG. 4). When the scan voltage pulse SP is applied to one Y of the scan electrode and the signal voltage pulse Vb is applied to one A of the address electrode, for example, as shown in FIG. 7, the voltages between the scan and address electrodes Y and A are higher than voltages between the other electrodes. Accordingly, the electric discharge occurs in the discharge cell located at the intersection between the scan and address electrodes Y and A. Because of the electric discharge, new wall charges accumulate on the surfaces of the discharge cell.

During the sustain period, the first separation and bypass switching devices QS1 and QB1, and the low-side auxiliary and scan switching devices SA2 and SC2 are maintained in the ON state. The remainder of the switching devices, in particular, the second bypass switching device QB2 and the high-side auxiliary and scan switching devices SA1 and SC1 are maintained in the OFF state. Thereby, the first sustaining pulse generating section 3A (or 3B) raises and lowers the potential of the scan electrode Y through the sustaining pulse transmission path J1-SC2 and the low side scan switching device SC2. At that time, the potential of the sustaining pulse transmission path J1-SC2 changes between the upper and lower limits of the sustaining voltage pulse (Vs and the ground potential, respectively). Note that, in FIG. 6, the first separation switching device QS1 may be turned on and of in synchronization with the first low side sustain switching device Q2, when the first power recovery section 4 is not connected to the node J5 between the first separation and low-side-sustain switching devices QS1 and Q2.

During the sustain period, the scan and sustain electrode driver sections 11 and 12 alternately apply the sustaining voltage pulses to the scan electrodes Y1, Y2, Y3, . . . and the sustain electrodes X1, X2, X3, . . . , respectively, similarly in Embodiment 1. See FIG. 4. At that time, in the discharge cells where the wall charges have accumulated in the address period, discharge in gas and accumulation of wall charges are repeated, and thereby the light emission of phosphor is sustained.

During the sustain period, the low side auxiliary switching device SA2 is maintained in the ON state, and accordingly, the current to flow from the scan electrode Y toward the output terminal J1 of the first sustaining pulse generating section 3A can pass not only the low side scan switching device SC2 but also the body diode of the high side scan switching device SC1. Thereby, the occurrence of latch up due to the increase in the amount of current is effectively prevented in the series connection 1S of the scan switching devices SC1 and SC2.

Figure 26:
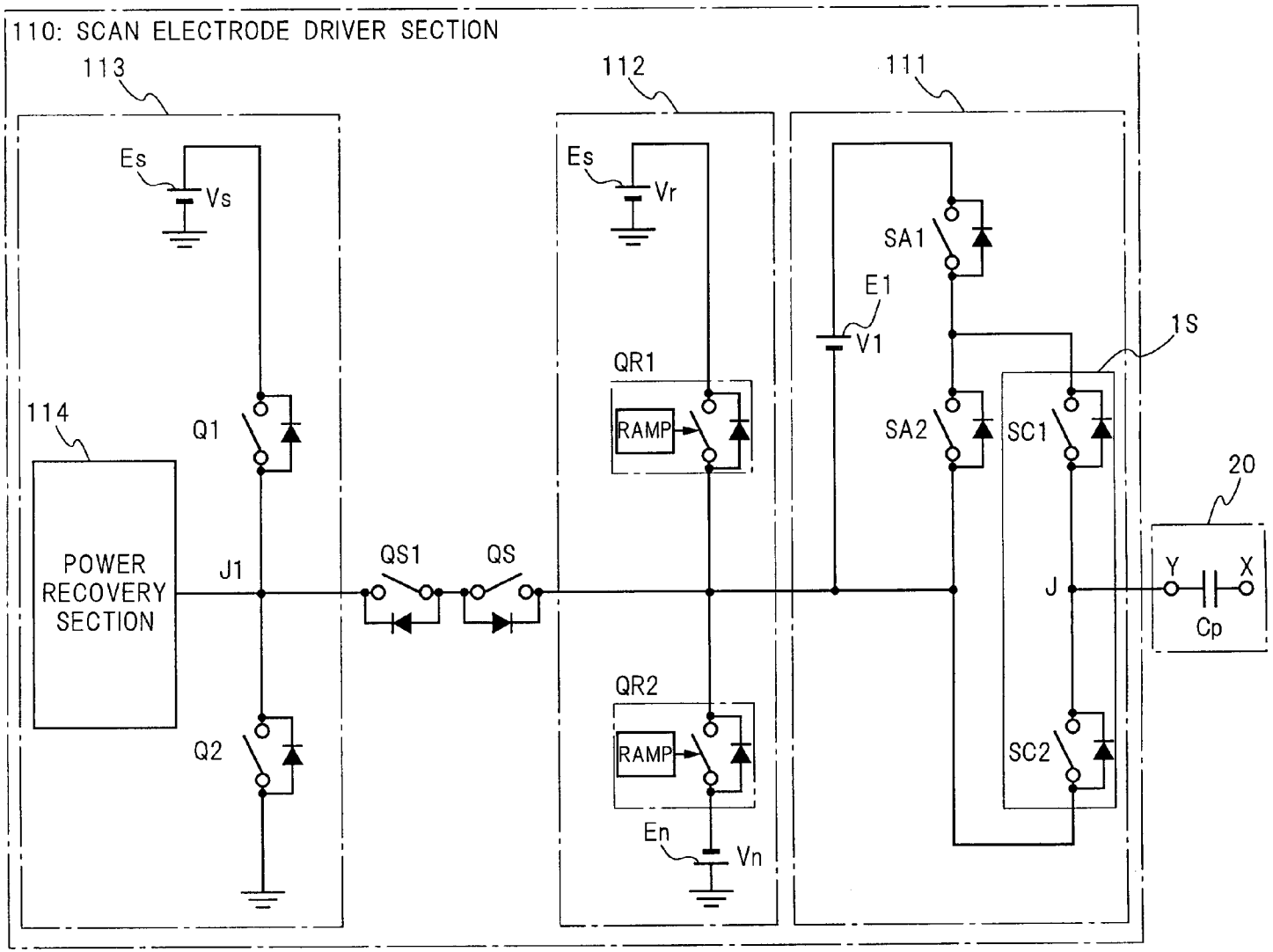
FIG.26 PRIOR ART
FIG. 26 is, regarding the conventional PDP driver, the diagram that shows the equivalent circuit of the scan electrode driver section 110 where the lower limit −Vn of the reset voltage pulse falls below the ground potential.

In the PDP driver according to Embodiment 2 of the invention as described above, the sustaining pulse transmission path J1-SC2 is maintained at a potential equal to or below the upper limit Vs of the sustaining voltage pulse over both the reset and address periods, and thus, any substantial current does not flow through the output terminal J1 into the first sustaining pulse generating section 3A (or 3B). Accordingly, the reset voltage pulse reliably reaches the upper limit Vr, without being clamped to the upper limit of the sustaining voltage pulse, even if no separation switching device for cutting off the current is installed, in contrast to the conventional driver (cf. FIG. 26). Thus, the number of the separation switching devices is reduced, and accordingly, the PDP driver according to Embodiment 2 of the invention has the low conduction losses at the separation switching devices. Therefore, the PDP driver has the power consumption lower than that of the conventional driver. Furthermore, the PDP driver is easy to miniaturize because of the reduction in number of the separation switching devices. In addition, the ringing included in the voltage applied to the PDP is reduced since parasitic inductances caused by the circuit elements and lines on the sustaining pulse transmission path are reduced. As a result, the PDP driver according to Embodiment 2 of the invention has advantage in further improvement in high image quality of the plasma display.

Embodiment 3

A plasma display according to Embodiment 3 of the invention comprises a configuration quite similar to that of the above-described plasma display according to Embodiment 1 (cf. FIG. 1). Accordingly, for the details of the configuration, the explanation of the above-described Embodiment 1 and FIG. 1 are cited.

A sustain electrode driver section according to Embodiment 3 of the invention (not shown) comprises a configuration quite similar to that of the sustain electrode driver section 12 according to Embodiment 1 (cf. FIG. 2). Accordingly, for the details of the configuration, the explanation of Embodiment 1 and FIG. 2 are cited.

In a scan electrode driver section 11 according to Embodiment 3 of the invention, a scan pulse generating section 1B includes no first bypass switching device QB1, in contrast to the scan pulse generating sections 1A according to Embodiments 1 and 2 (cf. FIGS. 2, 5, and 6). See FIGS. 8-11. In other words, the positive electrode of the first constant-voltage source E1 is coupled directly to the cathode of the high side auxiliary switching device SA1. A reset pulse generating section 2C includes a positive voltage source Er, a reset switching device Q6, and a protection diode Dp, in contrast to the components of the reset pulse generating section 2B according to Embodiment 2 (cf. FIG. 5). See FIGS. 8-11.

Furthermore, the second separation switching device QS2 is installed in addition to the first separation switching device QS1, in contrast to the scan electrode driver section 11 according to Embodiment 2 (cf. FIGS. 5 and 6). Other components are similar to the components according to Embodiment 1 or 2. In FIGS. 8-11, the similar components are marked with the same reference symbols as the reference symbols shown in FIGS. 2, 5, and 6. Furthermore, for the details of the similar components, the explanation of Embodiment 1 or 2 of the invention is cited.

The positive voltage source Er maintains its output terminal at the upper limit Vr of the reset voltage pulse, based on the output voltage Vs of the power supply section Es, by using, for example, a DC-DC converter (not shown). The reset and second-separation switching devices Q6 and QS2 are preferably MOSFETs, or alternatively, may be IGBTs or bipolar transistors. The second separation switching device QS2 is further preferably a wide band gap semiconductor switching device. The second separation switching device QS2 may be, for example, a parallel connection of more than one switching devices, since the large current capacity is required of the second separation switching device QS2.

The positive voltage source Er is connected to the cathode of the high side ramp wave generating section QR1. A path running from the anode of the high side ramp wave generating section QR1 through the high side auxiliary switching device SA1 to the cathode of the high side scan switching device SC1 is used as a high side reset pulse transmission path. When the high side ramp wave generating section QR1 is turned on, a high voltage is applied from the positive voltage source Er through the high side ramp wave generating section QR1 and the high side auxiliary switching device SA1 to the cathode of the high side scan switching device SC1. The applied voltage rises at a constant rate to the upper limit Vr of the reset voltage pulse.

The anode and cathode of the protection diode Dp are connected to the power supply section Es and the cathode of the reset switching device Q6, respectively. The anode of the reset switching device Q6 is connected to the cathode of the high side auxiliary switching device SA1. During the ON period of the reset switching device Q6, the potential of the cathode of the high side auxiliary switching device SA1 is maintained equal to or above the potential Vs of the power supply section Es.

The connection of the two separation switching devices QS1 and QS2 is allowed in one of the following four patterns. In the first pattern, the two separation switching devices QS1 and QS2 are connected in series. See FIG. 8. In other words, the cathodes or anodes of the two separation switching devices QS1 and QS2 are coupled directly to each other. One end of the series connection is connected to the output terminal J1 of the first sustaining pulse generating section 3A, and the other end is connected to the anode of the low side scan switching device SC2. In the second pattern, the cathode and anode of the first separation switching device QS1 are connected to the cathode of the first low side sustain switching device Q2 and the anode of the first high side sustain switching device Q1, respectively. See FIG. 9. The first separation and low-side-sustain switching devices QS1 and Q2 may be connected to each other in the reversed polarity; in other words, the anode of the second separation switching device QS2 may be connected to the node J1 between the first separation and high-side-sustain switching devices QS1 and Q1 (the output terminal of the first sustaining pulse generating section 3B), and the cathode of the second separation switching device QS2 may be connected to the anode of the low side scan switching device SC2. In the third pattern, the anode and cathode of the second separation switching device QS2 are connected to the anode of the first high side sustain switching device Q1 and the cathode of the first low side sustain switching device Q2, respectively. See FIG. 10. The second separation switching device QS2 and the first high side sustain switching device Q1 may be connected to each other in the reversed polarity; in other words, the anode and cathode of the second separation switching device QS2 may be connected to the power supply section Es and the cathode of the first high side sustain switching device Q1, respectively. The cathode of the first separation switching device QS1 is connected to the node J1 between the second separation switching device QS2 and the first low side sustain switching device Q2 (the output terminal of the first sustaining pulse generating section 3C), and the anode of the first separation switching device QS1 is connected to the anode of the low side scan switching device SC2. In the fourth pattern, the cathode and anode of the first separation switching device QS1 are connected to the cathode of the first low side sustain switching device Q2 and the output terminal J1 of the first sustaining pulse generating section 3D, respectively. See FIG. 11. The first separation and low-side-sustain switching devices QS1 and Q2 may be connected to each other in the reversed polarity. The anode and cathode of the second separation switching device QS2 are connected to the anode of the first high side sustain switching device Q1 and the output terminal J1 of the first sustaining pulse generating section 3D, respectively. The second separation switching device QS2 and the first high side sustain switching device Q1 may be connected to each other in the reversed polarity. The output terminal J1 of the first sustaining pulse generating section 3D is coupled directly to the anode of the low side scan switching device SC2. In any of the above-described four patterns of the connections, the first separation switching device QS1 can cut off a current to flow from the ground terminal through the first low side sustain switching device Q2 and the sustaining pulse transmission path J1-SC2 to the anode of the low side scan switching device SC2. Similarly, the second separation switching device QS2 can cut off a current to flow from the power supply section Es through the first high side sustain switching device Q1 and the sustaining pulse transmission path J1-SC2 to the anode of the low side scan switching device SC2.

Figure 8:
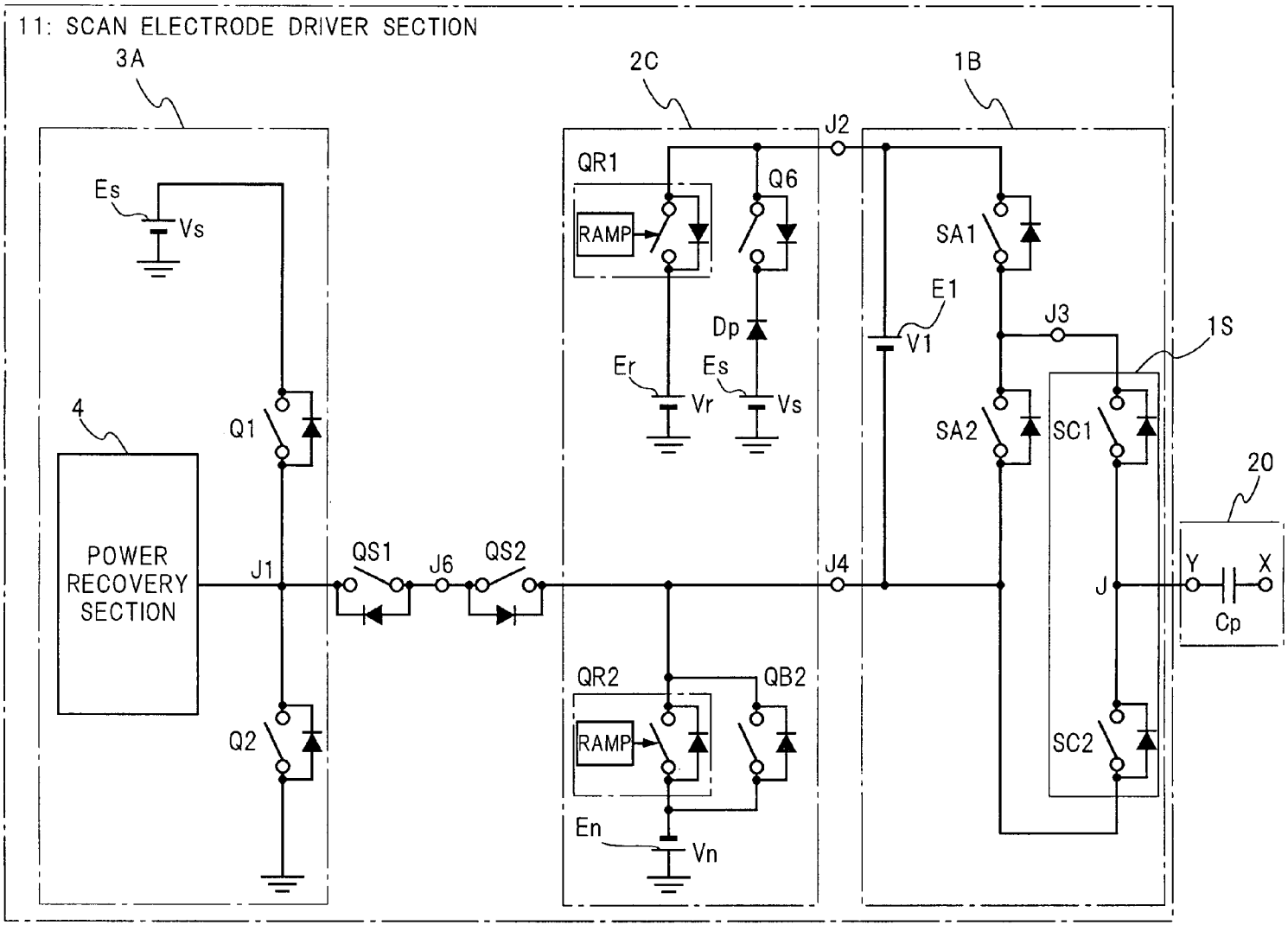
FIG. 8 is an equivalent circuit diagram that shows the scan electrode driver section 11 according to Embodiment 3 of the invention and the PDP 20, where two separation switching devices QS1 and QS2 are connected in a first mode.
Figure 9:
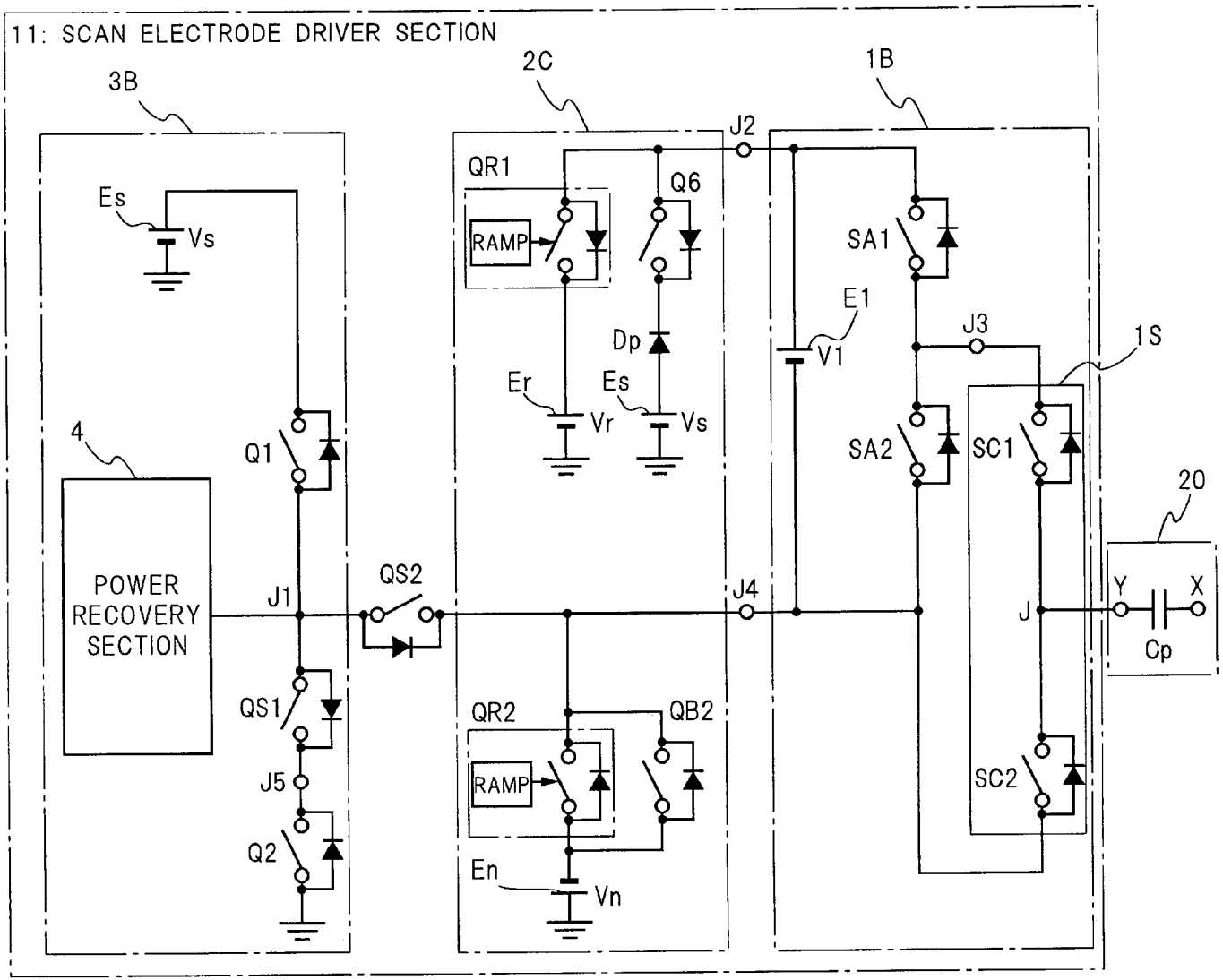
FIG. 9 is an equivalent circuit diagram that shows the scan electrode driver section 11 according to Embodiment 3 of the invention and the PDP 20, where the two separation switching devices QS1 and QS2 are connected in a second mode.
Figure 10:
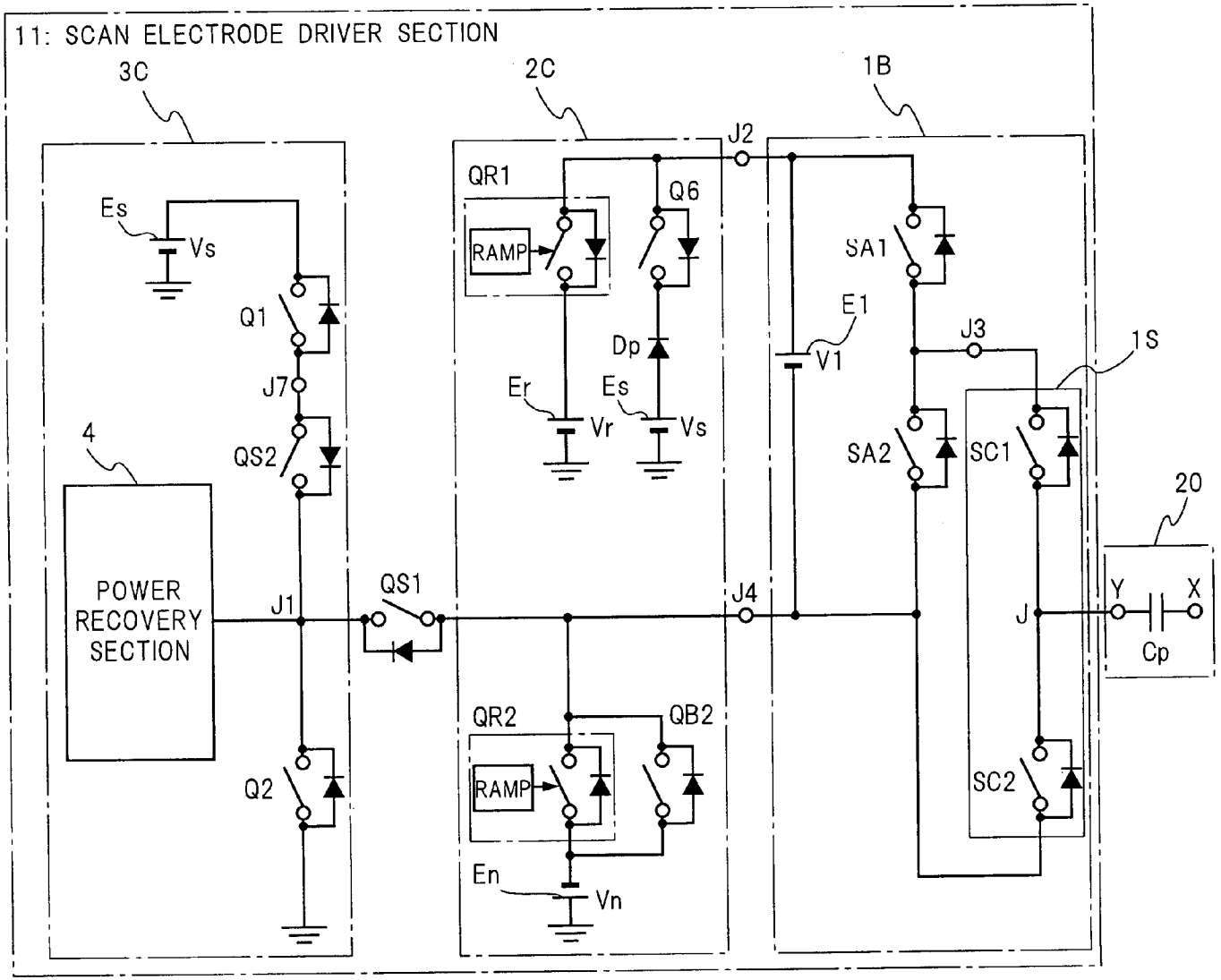
FIG. 10 is an equivalent circuit diagram that shows the scan electrode driver section 11 according to Embodiment 3 of the invention and the PDP 20, where the two separation switching devices QS1 and QS2 are connected in a third mode.
Figure 11:
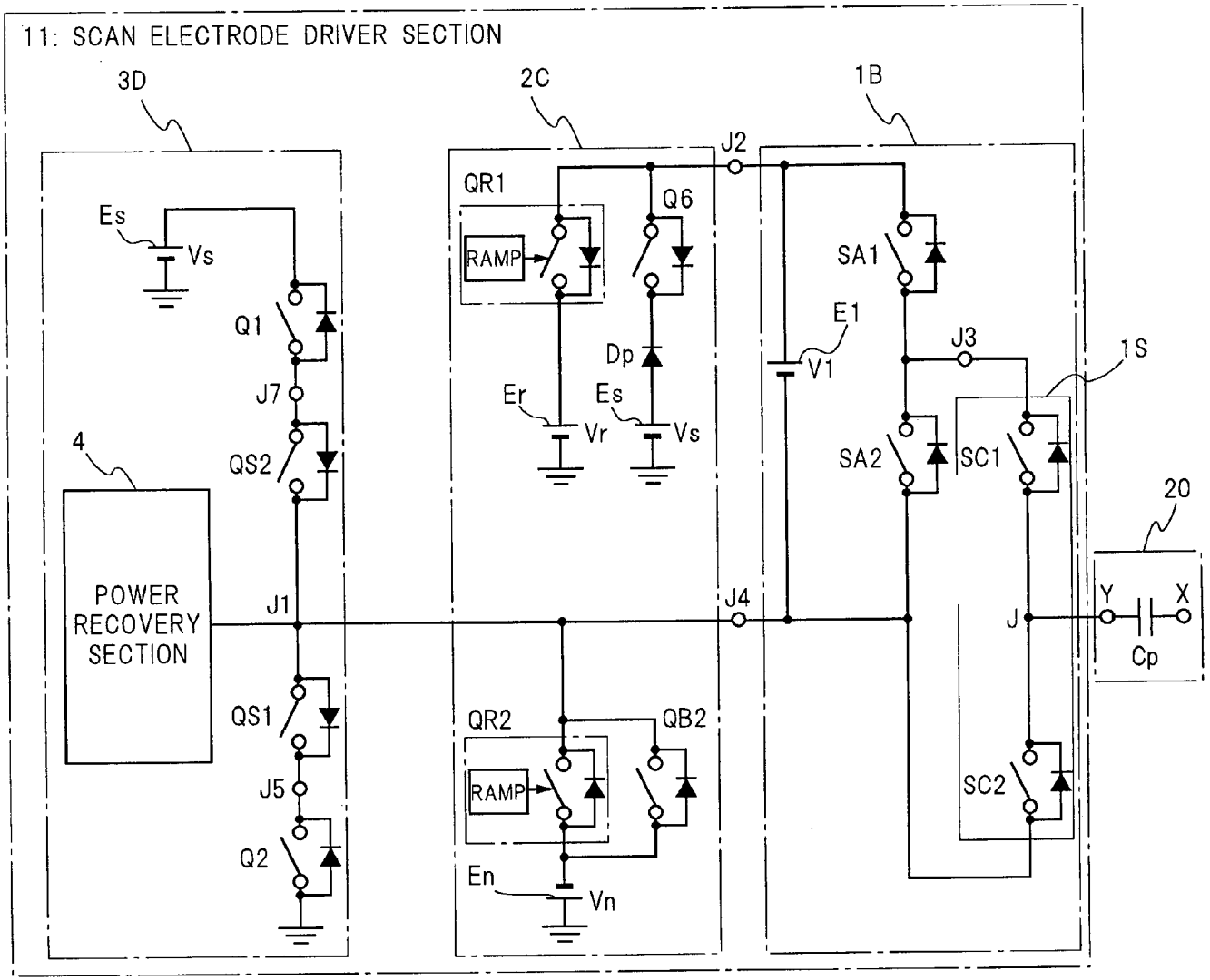
FIG. 11 is an equivalent-circuit diagram that shows the scan electrode driver section 11 according to Embodiment 3 of the invention and the PDP 20, where the two separation switching devices QS1 and QS2 are connected in a fourth mode.

The first power recovery section 4 has a circuitry exactly equivalent to the first power recovery section 4 according to Embodiment 1 (cf. FIGS. 2 and 3). Accordingly, in FIGS. 8-11, an equivalent circuit of the first power recovery section 4 is omitted from illustration. For the details of the equivalent circuit, the explanation of Embodiment 1 and FIGS. 2 and 3 are cited. In particular, when the first power recovery section 4 includes two inductors L1 and L2 as shown in FIG. 3B, their second ends 41 and 42 may be connected to the same node or separate nodes. In FIG. 8, the second ends 41 and 42 of the inductors L1 and L2 are connected to one in common, or two separately, of the following, for example: the conducting path coupled directly to the output terminal J1 of the first sustaining pulse generating section 3A; the conducting path coupled directly to the positive electrode of the first constant-voltage source E1 (e.g., the node J2); the conducting path coupled directly to the cathode of the high side scan switching device SC1 (e.g., the node J3); the conducting path coupled directly to the anode of the low side scan switching device SC2 (e.g., the node J4); and the node J6 between the two separation switching devices QS1 and QS2. In FIG. 9, the second ends 41 and 42 of the inductors L1 and L2 are connected to one in common, or two separately, of the following, for example: the conducting path coupled directly to the output terminal J1 of the first sustaining pulse generating section 3B; the conducting path coupled directly to the positive electrode of the first constant-voltage source E1 (e.g., the node J2); the conducting path coupled directly to the cathode of the high side scan switching device SC1 (e.g., the node J3); the conducting path coupled directly to the anode of the low side scan switching device SC2 (e.g., the node J4); and the node J5 between the first separation and low-side-sustain switching devices QS1 and Q2. In FIG. 10, the second ends 41 and 42 of the inductors L1 and L2 are connected to one in common, or two separately, of the following, for example: the conducting path coupled directly to the output terminal J1 of the first sustaining pulse generating section 3C; the conducting path coupled directly to the positive electrode of the first constant-voltage source E1 (e.g., the node J2); the conducting path coupled directly to the cathode of the high side scan switching device SC1 (e.g., the node J3); the conducting path coupled directly to the anode of the low side scan switching device SC2 (e.g., the node J4); and the node J7 between the second separation switching device QS2 and the first high side sustain switching device Q1. In FIG. 11, the second ends 41 and 42 of the inductors L1 and L2 are connected to one in common, or two separately, of the following, for example: the sustaining pulse transmission path J1-SC2 (e.g., the output terminal J1 of the first sustaining pulse generating section 3D); the conducting path coupled directly to the positive electrode of the first constant-voltage source E1 (e.g., the node J2); the conducting path coupled directly to the cathode of the high side scan switching device SC1 (e.g., the node J3); the node J5 between the first separation and low-side-sustain switching devices QS1 and Q2; and the node J7 between the second separation switching device QS2 and the first high side sustain switching device Q1. Note that, when the first separation and low-side-sustain switching devices QS1 and Q2 are connected to each other in the polarity opposite to the polarity shown in FIGS. 9 and 11, the first power recovery section 4 is not connected to the node J5 between the switching devices. Similarly, when the second separation switching device QS2 and the first high side sustain switching device Q1 are connected to each other in the polarity opposite to the polarity shown in FIGS. 8 and 10, the first power recovery section 4 is not connected to the node J7 between the switching devices.

Figure 12:
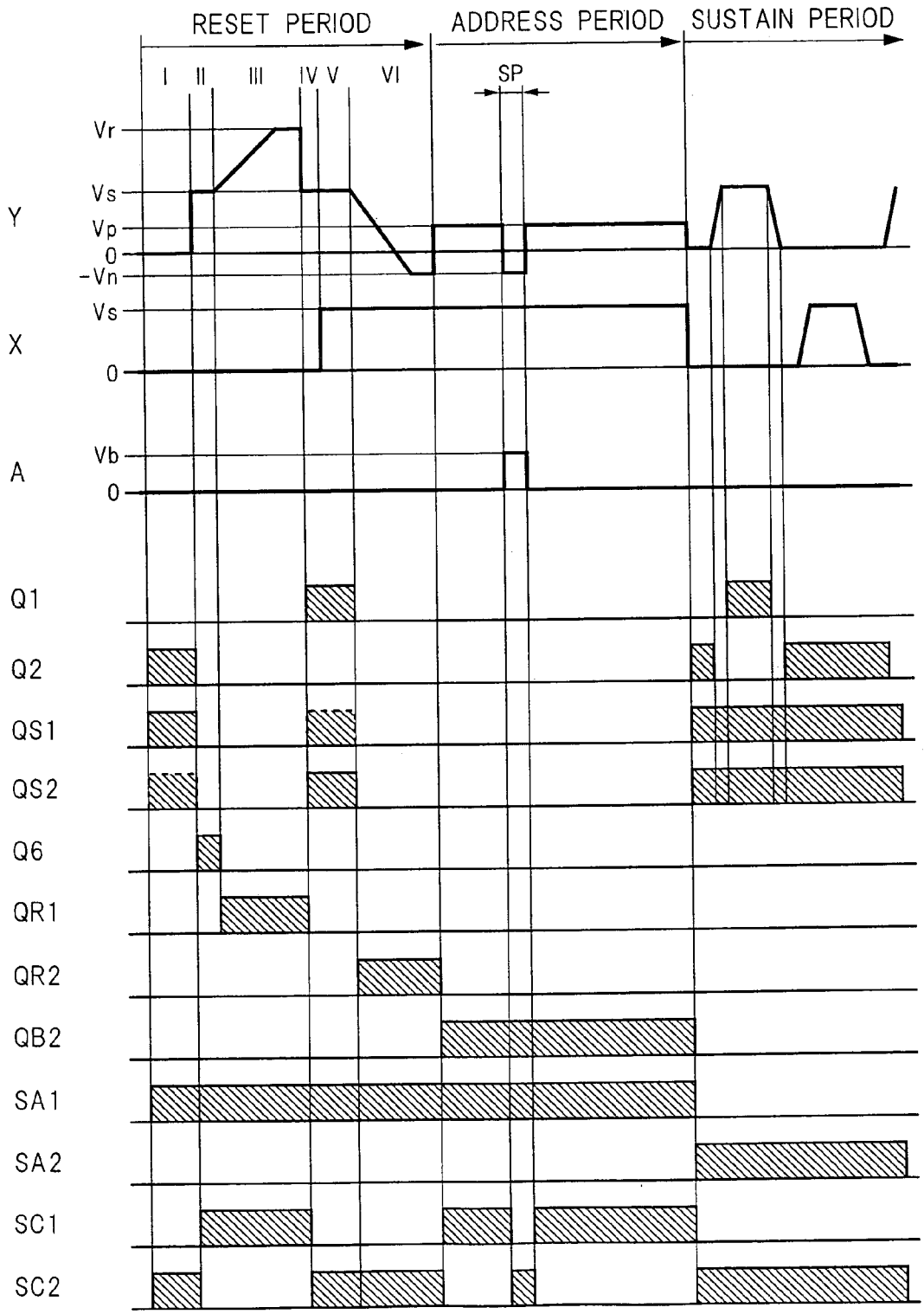
FIG. 12 is, regarding Embodiment 3 of the invention, a waveform chart that shows the voltages applied to the scan, sustain, and address electrodes Y, X, and A of the PDP 20, and the ON periods of the switching devices Q1, Q2, QS1, QS2, Q6, QR1, QR2, QB2, SA1, SA2, SC1, and SC2 included in the scan electrode driver section 11, in the reset, address, and sustain periods.

In the reset, address, and sustain periods, the potentials of the scan, sustain, and address electrodes Y, X, and A of the PDP 20 change as follows. See FIG. 12. In FIG. 12, hatched areas show the ON periods of the switching devices Q1, Q2, QS1, QS2, Q6, QR1, QR2, QB2, SA1, SA2, SC1, and SC2 included in the scan electrode driver section 11.

During the reset period, the application of the reset voltage pulses changes the potentials of the scan and sustain electrodes Y and X. On the other hand, the address electrode A is maintained at the ground potential (nearly equal to 0). Depending on the changes in the reset voltage pulse, the reset period is divided into the following six modes I-VI. The ON and OFF states of the switching devices included in the scan electrode driver section 11 are switched to each other mode by mode. Note that, the high side auxiliary switching device SA1 is maintained in the ON state and the second bypass switching device QB2 and the low side auxiliary switching device SA2 are maintained in the OFF state, during the reset period.

<Mode I>

The first low side sustain switching device Q2, the first and second separation switching devices QS1 and QS2, and the low side scan switching device SC2 are turned on. Thereby, the sustaining pulse transmission path J1-SC2 and the scan electrode Y are maintained at the ground potential. Note that the second separation switching device QS2 does not need to be turned on in FIGS. 10 and 11.

<Mode II>

The first low side sustain switching device Q2, the two separation switching devices QS1 and QS2, and the low side scan switching device SC2 are turned off, and the reset and high-side-scan switching devices Q6 and SC1 are turned on. Thereby, the potential of the scan electrode Y rises to the potential Vs of the power supply section Es. The part of the sustaining pulse transmission path J1-SC2 coupled directly to the anode of the low side scan switching device SC2 is maintained at a potential lower than the potential Vs of the power supply section Es by the voltage V1 of the first constant-voltage source E1. Accordingly, in FIGS. 8 and 10, at least one of the first separation and high-side-sustain switching devices QS1 and Q1 may be maintained in the OFF state.

<Mode III>

The reset switching device Q6 is turned off and the high side ramp wave generating section QR1 is turned on, and then, the potential of the scan electrode Y rises at a constant rate, and reaches the potential Vr of the positive voltage source Er (the upper limit of the reset voltage pulse). In other words, the reset voltage pulse reaches the upper limit Vr in the ON period of the high side scan switching device SC1. Thus, voltages applied to all the discharge cells of the PDP 20 uniformly rises to the upper limit Vr of the reset voltage pulse at a comparatively slow rate. Thereby, uniform wall charges accumulate in all the discharge cells of the PDP 20. At that time, the rising rate of the applied voltage is low, and thereby, the light emitted by the discharge cell is very feeble.

The sustaining pulse transmission path J1-SC2 is connected through the first constant-voltage source E1 to the high side reset pulse transmission path QR1-SA1-SC1. Accordingly, the part of the sustaining pulse transmission path J1-SC2 coupled directly to the anode of the low side scan switching device SC2 is maintained at a potential lower than the potential of the high side reset pulse transmission path QR1-SA1-SC1 by the voltage V1 of the first constant-voltage source E1. When the difference Vr−V1 between the upper limit Vr of the reset voltage pulse and the voltage V1 of the first constant-voltage source E1 is lower than the potential of the power supply section Es, that is, the upper limit Vs of the sustaining voltage pulse (Vr−V1<Vs), the sustaining pulse transmission path J1-SC2 is maintained at a potential equal to or below the upper limit Vs of the sustaining voltage pulse. Accordingly, the second separation switching device QS2 does not need to be installed, since the reset voltage pulse is not clamped to the upper limit Vs of the sustaining voltage pulse. Thereby, the number of the separation switching devices is reduced. Furthermore, in FIGS. 8 and 10, at least one of the first separation and high-side-sustain switching devices QS1 and Q1 may be maintained in the OFF state. When the difference Vr−V1 between the upper limit Vr of the reset voltage pulse and the voltage V1 of the first constant-voltage source E1 is higher than the potential of the power supply section Es, that is, the upper limit Vs of the sustaining voltage pulse (Vr−V1>Vs), the potential of the part of the sustaining pulse transmission path J1-SC2 coupled directly to the anode of the low side scan switching device SC2 exceeds the upper limit Vs of the sustaining voltage pulse. However, the second separation switching device QS2 is maintained in the OFF state, thereby cutting off a current to flow from the sustaining pulse transmission path J1-SC2 into the output terminal J1 of the first sustaining pulse generating section 3A (3B, 3C, or 3D). Accordingly, the reset voltage pulse reliably reaches the upper limit Vr, without being clamped to the upper limit Vs of the sustaining voltage pulse. At that time, the voltage across the second separation switching device QS2 is maintained equal to or below the difference Vr−V1 between the upper limit Vr of the reset voltage pulse and the voltage V1 of the first constant-voltage source E1. In other words, the withstand voltage of the second separation switching device QS2 is sufficiently lower than the withstand voltage of the conventional separation switching device (approximately the upper limit Vr of the reset voltage pulse).

<Mode IV>

The high side ramp wave generating section QR1 and the high side scan switching device SC1 are turned off, and the first high side sustain switching device Q1, the two separation switching devices QS1 and QS2, and the low side scan switching device SC2 are turned on. Note that, in FIGS. 9 and 11, the first separation switching device QS1 does not need to be turned on. Then, the potential of the scan electrode Y falls to the potential Vs of the power supply section Es. On the other hand, the sustaining pulse transmission path J1-SC2 is maintained at the potential Vs of the power supply section Es.

<Mode V>

In the scan electrode driver section 11, the state in the mode IV is maintained, and then, the sustaining pulse transmission path J1-SC2 and the scan electrode Y are both maintained at the potential Vs of the power supply section Es. In the sustain electrode driver section 12, the second low side sustain switching device Q2X is turned off, and the second high side sustain switching device Q1X is turned on. See FIG. 2. Thereby, the potential of the sustain electrode X rises to the potential Vs of the power supply section Es. Thus, the scan and sustain electrodes Y and X are maintained at the same potential Vs.

<Mode VI>

The first high side sustain switching device Q1 and the two separation switching devices QS1 and QS2 are turned off, and the low side ramp wave generating section QR2 is turned on. Thereby, both the potential of the part of the sustaining pulse transmission path J1-SC2 coupled directly to the anode of the low side scan switching device SC2 and the potential of the scan electrode Y fall at a constant rate to the potential −Vn of the negative voltage source En. In other words, the reset voltage pulse reaches the lower limit −Vn in the ON period of the low side scan switching device SC2. The low side reset pulse transmission path runs from the cathode of the low side ramp wave generating section QR2 to the anode of the low side scan switching device SC2. The sustaining pulse transmission path J1-SC2 overlaps the low side reset pulse transmission path QR2-SC2. However, the first separation switching device QS1 is maintained in the OFF state, thereby cutting off a current to flow from the output terminal J1 of the first sustaining pulse generating section 3A (3B, 3C, or 3D) to the low side scan switching device SC2. Accordingly, the potential of the part of the sustaining pulse transmission path J1-SC2 coupled directly to the anode of the low side scan switching device SC2 can fall to the negative potential −Vn. In other words, the reset voltage pulse reliably reaches the lower limit −Vn, without being clamped to the ground potential, that is, the lower limit of the sustaining voltage pulse. In the sustain electrode driver section 12, the state in the mode V is maintained, and accordingly, the sustain electrode X is maintained at the potential Vs of the power supply section Es. Thus, the voltage opposite in polarity to the voltages applied in the modes II-V is applied uniformly to all the discharge cells of the PDP 20. Thereby, wall charges are uniformly eliminated and evened in all the discharge cells. At that time, the falling rate of the applied voltage is low, and therefore, the light emitted the discharge cell is very feeble. In particular, the lower limit −Vn of the reset voltage pulse is lower than the ground potential: −Vn<0. Accordingly, the voltages applied to the discharge cells of the PDP 20 are enhanced sufficiently high, and thereby, the wall charges are sufficiently eliminated. Alternatively, the voltage applied to the sustain electrodes X in the reset period may be reduced. Thereby, the power consumption is reduced.

During the address and sustain periods, the scan electrode driver section 11 operates quite similarly to the scan electrode driver section 11 according to Embodiment 2. Accordingly, for the details, the explanation of Embodiment 2 is cited. Note that, in FIGS. 9 and 11, the first separation switching device QS1 may be turned on and of f in synchronization with the first low side sustain switching device Q2, when the first power recovery section 4 is not connected to the node J5 between the first separation and low-side-sustain switching devices QS1 and Q2. Similarly, in FIGS. 10 and 11, the second separation switching device QS2 may be turned on and off in synchronization with the first high side sustain switching device Q1, when the first power recovery section 4 is not connected to the node J7 between the second separation switching device QS2 and the first high side sustain switching device Q1. Furthermore, in FIGS. 9-11, at least one of the two separation switching devices QS1 and QS2 allows currents caused by the gas discharges in the PDP 20 to flow only in one direction, in contrast to FIG. 8. Accordingly, the separation switching device has low conduction losses.

During the sustain period, the low side auxiliary switching device SA2 is maintained in the ON state, and accordingly, the current to flow from the scan electrode Y toward the output terminal J1 of the first sustaining pulse generating section 3A-3D can pass not only the low side scan switching device SC2 but also the body diode of the high side scan switching device SC1. Thereby, the occurrence of latch up due to the increase in the amount of current is effectively prevented in the series connection 1S of the scan switching devices SC1 and SC2.

In the PDP driver according to Embodiment 3 of the invention as described above, the second separation switching device QS2 is eliminated, or its withstand voltage is sufficiently low. Accordingly, the second separation switching device QS2 has low conduction losses and is easy to miniaturize in the PDP driver according to Embodiment 3 of the invention. In the case where the second separation switching device QS2 can be eliminated, furthermore, parasitic inductances caused by the circuit elements and lines on the sustaining pulse transmission path are reduced, and therefore, the ringing included in the voltage applied to the PDP is reduced. As a result, the PDP driver according to Embodiment 3 of the invention has advantage in further improvement in high image quality of the plasma display.

Embodiment 4

A plasma display according to Embodiment 4 of the invention comprises a configuration really similar to that of the plasma display according to the above-described Embodiment 1 (cf. FIG. 1). Accordingly, for the details of the configuration, the explanation of the above-described Embodiment 1 and FIG. 1 are cited.

The sustain electrode driver section according to Embodiment 4 of the invention (not shown) comprises a configuration really similar to that of the sustain electrode driver section 12 according to Embodiment 1 (cf. FIG. 2). Accordingly, for the details of the configuration, the explanation of Embodiment 1 and FIG. 2 are cited.

Figure 13:
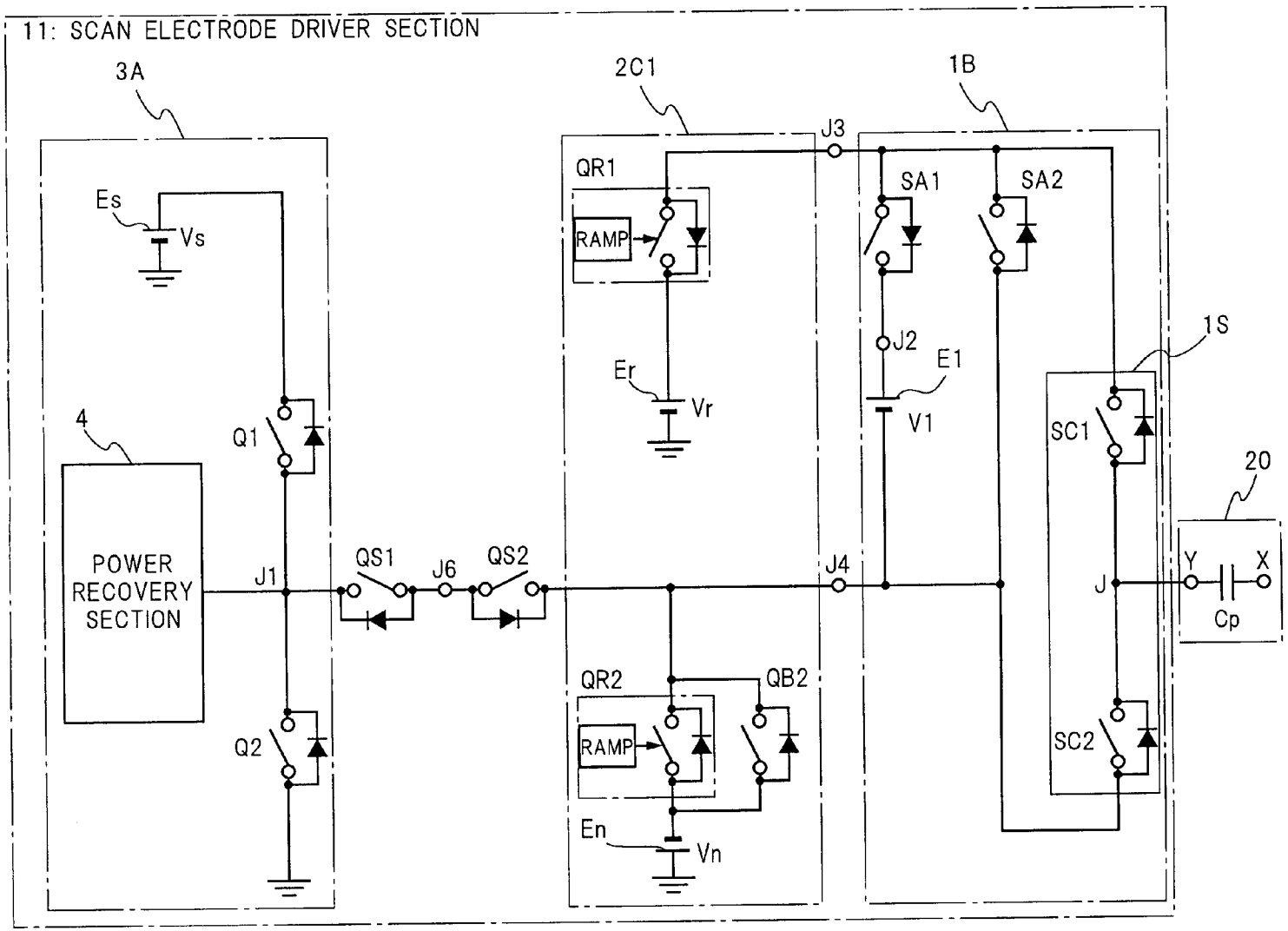
FIG. 13 is an equivalent circuit diagram that shows the scan electrode driver section 11 according to Embodiment 4 of the invention and the PDP 20.
Figure 14:
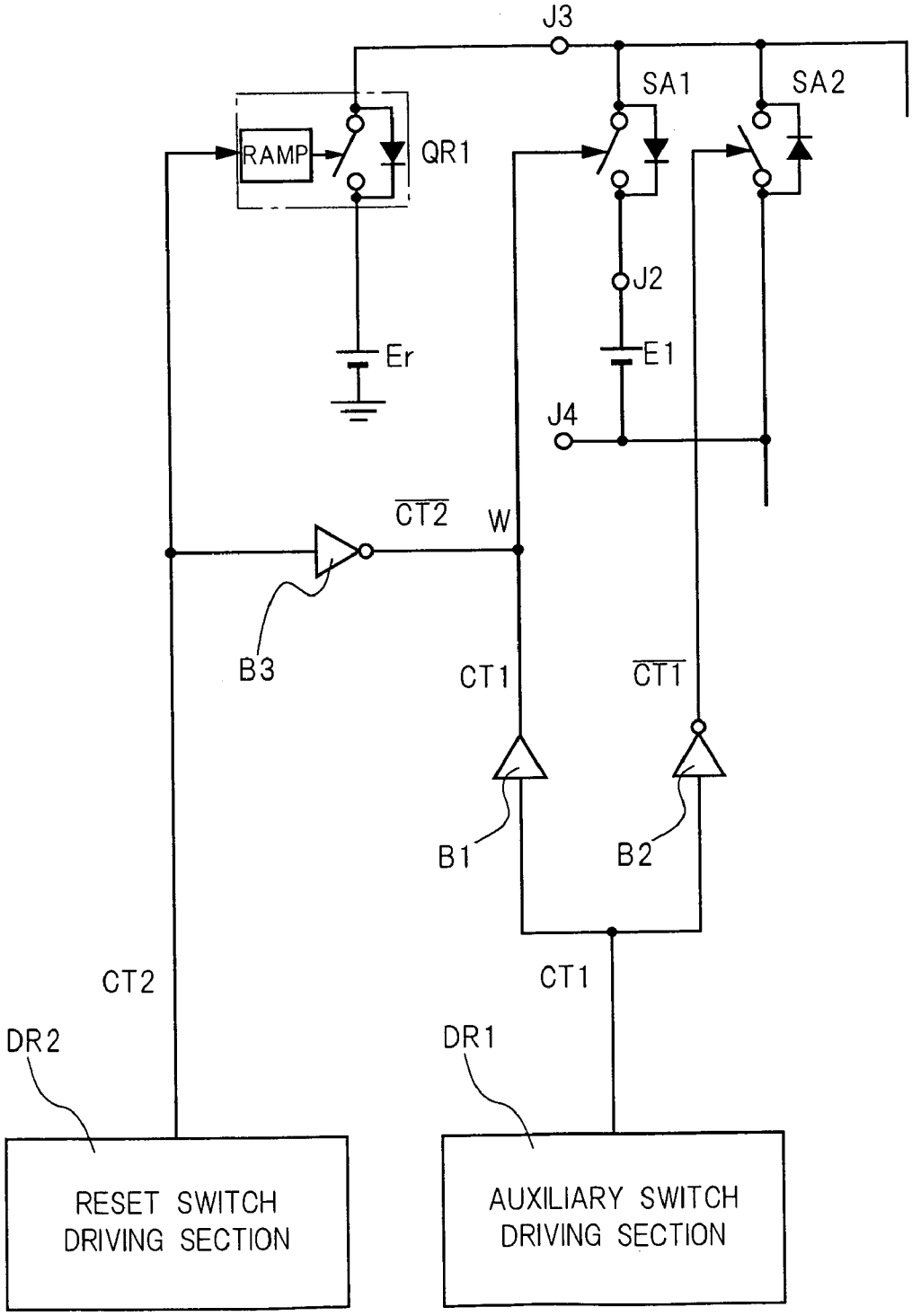
FIG. 14 is, regarding the scan electrode driver section 11 according to Embodiment 4 of the invention, a block diagram that shows signal lines between the auxiliary switch driving section DR1 and the auxiliary switching devices SA1 and SA2 and a signal line between the reset switch driving section DR2 and the high side ramp wave generating section QR1.
Figure 15:
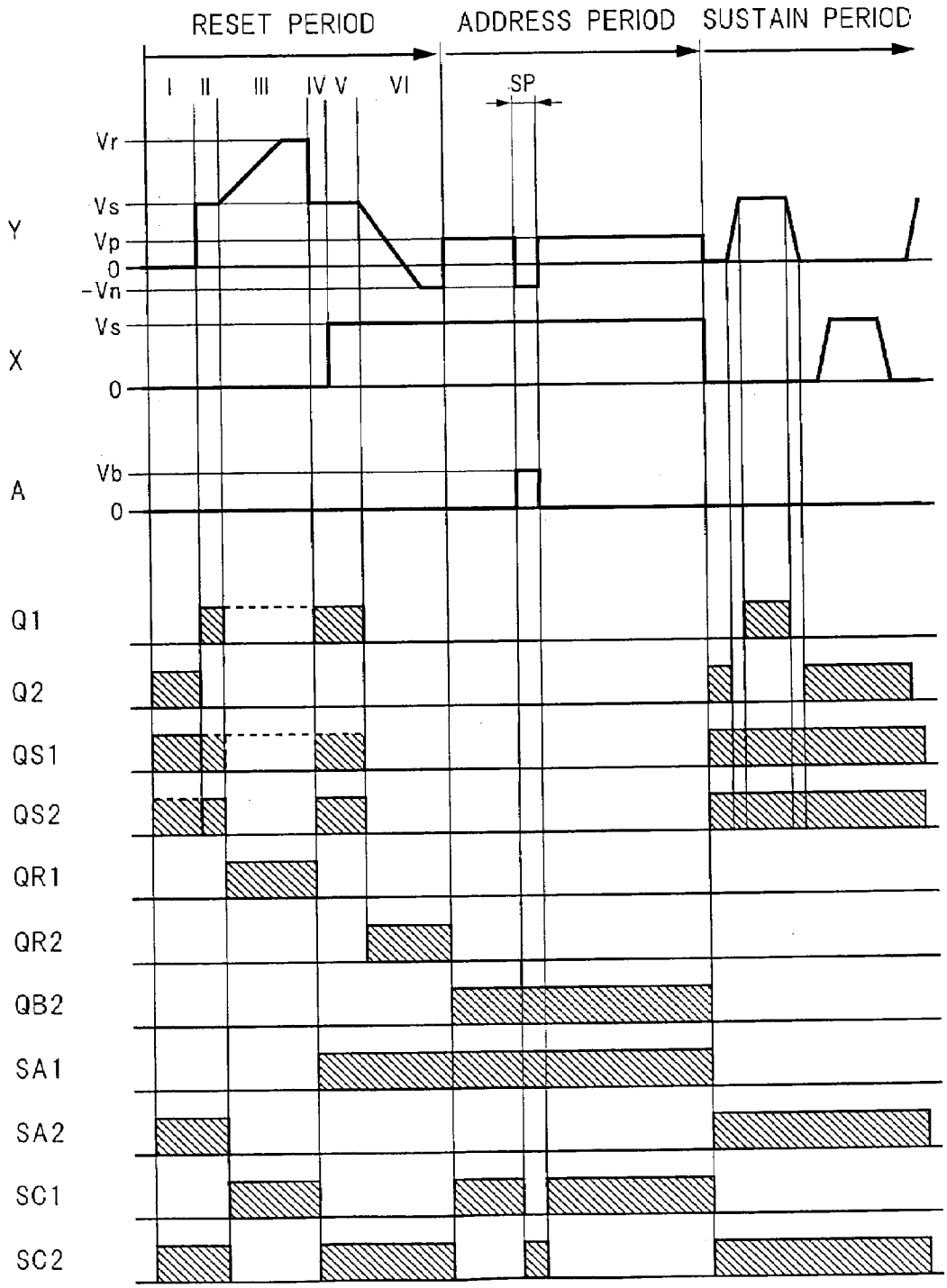
FIG. 15 is, regarding Embodiment 4 of the invention, a waveform chart that shows voltages applied to the scan, sustain, and address electrodes Y, X, and A of the PDP 20, and the ON periods of switching devices Q1, Q2, QS1, QS2, QR1, QR2, QB2, SA1, SA2, SC1, and SC2 included in the scan electrode driver section 11, in the reset, address, and sustain periods.

In the scan electrode driver section 11 according to Embodiment 4 of the invention, the reset pulse generating section 2C1 does not include the series circuit consisting of the reset switching device Q6 and the protection diode Dp, which is connected to the power supply section Es, in contrast to the reset pulse generating section 2C according to Embodiment 3 (cf. FIGS. 8-11). See FIG. 13. Furthermore, the anode of the high side ramp wave generating section QR1 is coupled directly to the cathode of the high side scan switching device SC1. In addition, while maintaining the high side ramp wave generating section QR1 in the ON state, the reset switch driving section DR2 suppresses the turn-on of the high side auxiliary switching device SA1 by the auxiliary switch driving section DR1 as follows. See FIGS. 14 and 15. Other components and their operations are similar to the components and operations according to Embodiment 3. In particular, the two separation switching devices QS1 and QS2 may be installed at positions similar to the positions shown in FIGS. 9-11, instead of the positions shown in FIG. 13. In FIGS. 13-15, the similar components are marked with the same reference symbols as the reference symbols shown in FIGS. 8-12. Furthermore, for the details of the similar components and their operations, the explanation of Embodiment 3 of the invention is cited.

The auxiliary switch driving section DR1 sends out the same first control signal CT1 to the two auxiliary switching devices SA1 and SA2. See FIG. 14. The first control signal CT1 is a logic signal, and preferably, its H and L levels designate the ON and OFF states of the target auxiliary switching device, respectively. The first control signal CT1 is applied to the high- and low-side auxiliary switching devices SA1 and SA2 through the buffer B1 and the first inverter B2 with the original and reversed polarities, respectively. Alternatively, the auxiliary switch driving section DR1 may send out two different control signals to the two auxiliary switching devices SA1 and SA2. Each control signal is a logic signal, and preferably, its H and L levels designate the ON and OFF states of the target auxiliary switching devices. In this case, the two control signals are maintained to be of opposite polarity.

The reset switch driving section DR2 sends out a second control signal CT2 to the high side ramp wave generating section QR1. See FIG. 14. The second control signal CT2 is a logic signal, and preferably, its H and L levels designate the ON and OFF states of the high side ramp wave generating section. The second control signal CT2 is applied to the high side ramp wave generating section QR1 with the original polarity and to the high side auxiliary switching device SA1 through the second inverter B3 with the reversed polarity. In particular, a wired OR circuit, namely an OR circuit of negative logic, is constructed at the node W between the output terminals of the buffer B1 and the second inverter B3. Accordingly, while the second control signal CT2 is at the L level, the high side auxiliary switching device SA1 is turned on and off in response to the first control signal CT1; while the second control signal CT2 is at the H level, the high side auxiliary switching device SA1 is maintained in the OFF state, regardless of the level of the first control signal CT1.

In the reset, address, and sustain periods, the potentials of the scan, sustain, and address electrodes Y, X, and A of the PDP 20 may vary as shown in FIG. 15. In FIG. 15, hatched areas represent the ON periods of the switching devices Q1, Q2, QS1, QS2, QR1, QR2, QB2, SA1, SA2, SC1, and SC2 included in the scan electrode driver section 11. The operation of Embodiment 4 is similar to the operation of Embodiment 3 except for the modes I-III in the reset period. Accordingly, the following explains about the operation in those periods, and as for the operation of other periods, the explanation of Embodiment 3 is cited.

<Mode I>

The first low side sustain switching device Q2, the first separation switching device QS1, the second separation switching device QS2, and the low side scan switching device SC2 are turned on. Thereby, the sustaining pulse transmission path J1-SC2 and the scan electrode Y are maintained at the ground potential. However, the second separation switching devices QS2 at the positions shown in FIGS. 10 and 11 are not required to be turned on. On the other hand, both the two control signals CT1 and CT2 are maintained at the L level, and thereby, the high side auxiliary switching device SA1 and the high side ramp wave generating section QR1 are maintained in the OFF states and the low side auxiliary switching device SA2 is maintained in the ON state. Furthermore, the high side scan switching device SC1 is maintained in the OFF state and the low side scan switching device SC2 is maintained in the ON state.

<Mode II>

The first low- and high-side sustain switching devices Q2 and Q1 are turned off and on, respectively. Thereby, the potentials of the sustaining pulse transmission path J1-SC2 and the scan electrode Y rise to the potential Vs of the power supply section Es. However, the first separation switching device QS1 at the positions shown in FIGS. 9 and 11 are not required to be turned on.

<Mode III>

The second separation switching device QS2 is turned off. Here, the first high-side-sustain and separation switching devices Q1 and QS1 may be maintained in any of the ON and OFF states. On the other hand, both the two control signals CT1 and CT2 are switched to the H level, and then, the high side ramp wave generating section QR1 is turned on and both the two auxiliary switching devices SA1 and SA2 are turned off. Furthermore, the high- and low-side scan switching devices SC1 and SC2 are turned on and off, respectively. Thus, the reset voltage pulse reliably reaches to the upper limit Vr, without being clamped to the potential Vs+V1 that is, by the voltage V1 of the first constant-voltage source E1, higher than the potential of the positive electrode of the first constant-voltage source E1, in other words, the upper limit Vs of the sustaining voltage pulse.

In the scan electrode driver section 11 according to Embodiment 4 of the invention, the anode of the high side ramp wave generating section QR1 is coupled directly to the cathode of the high side scan switching device SC1, and the second inverter B3 and the wired OR circuit W connect between the transmission paths of the first and second control signals CT1 and CT2, in contrast to the scan electrode driver section 11 according to Embodiment 3. See FIGS. 13 and 14. Such a comparatively simple change in circuitry allows both the two auxiliary switching devices SA1 and SA2 to be maintained in the OFF state during the ON period of the high side ramp wave generating section QR1, without changing the configuration of the auxiliary switch driving section DR1. See FIG.

15. As a result, the series circuit consisting of the reset switching device Q6 and the protection diode Dp, which is connected to the power supply section Es (cf. FIGS. 8-11,) is eliminated as shown in FIG. 13. Thus, the component count and size of the scan electrode driver section 11 are reduced.

Similarly, in the scan electrode driver sections 11 according to Embodiments 1 and 2 of the invention (cf. FIGS. 1 and 5), the bypass switching device QB1 can be reduced.

Embodiment 5

A plasma display according to Embodiment 5 of the invention comprises a configuration quite similar to that of the above-described plasma display according to Embodiment 1 (cf. FIG. 1). Accordingly, for the details of the configuration, the explanation of the above-described Embodiment 1 and FIG. 1 are cited.

Figure 16:
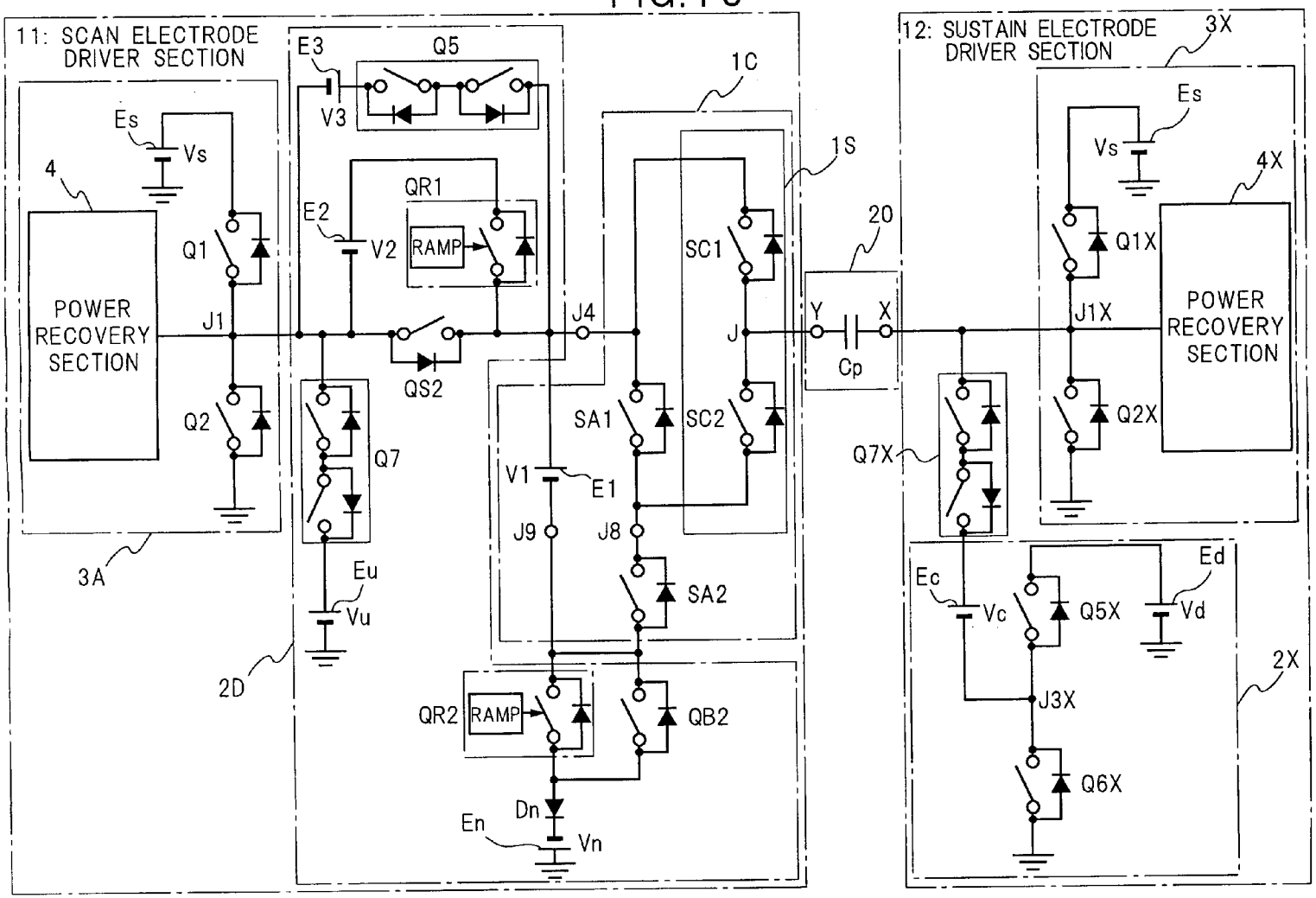
FIG. 16 is an equivalent circuit diagram that shows scan and sustain electrode driver sections 11 and 12 according to Embodiment 5 of the invention and the PDP 20.

A scan electrode driver section 11 according to Embodiment 5 of the invention has scan and reset pulse generating sections 1C and 2D in different configurations, when compared with the scan electrode driver sections 11 according to Embodiments 1-3 (cf. FIGS. 2, 5, 6, and 8-11). See FIG. 16. Furthermore, the scan electrode driver section 11 includes a second separation switching device QS2. Other components are similar to the components according to Embodiments 1-3. In FIG. 16, the components similar to the components according to Embodiments 1-3 are marked with the same reference symbols as the reference symbols shown in FIGS. 2, 5, 6, and 8-11. Furthermore, for the details of the similar components, the explanation of Embodiments 1-3 of the invention is cited.

The scan pulse generating section 1C includes a series connection 1S of two scan switching devices SC1 and SC2, a first constant-voltage source E1, and two auxiliary switching devices SA1 and SA2, similarly to the scan pulse generating sections 1A according Embodiments 1 and 2 (cf. FIGS. 2, 5, and 6) and the scan pulse generating section 1B according to Embodiment 3 (cf. FIGS. 8-11). However, the voltage V1 of the first constant-voltage source E1 is higher than the output voltage Vn of the negative voltage source En: V1>Vn. The positive electrode of the first constant-voltage source E1 is connected to the cathodes of the high-side scan and auxiliary switching devices SC1 and SA1. The anodes of the low-side-scan and high-side-auxiliary switching devices SC2 and SA1 are connected to the cathode of the low side auxiliary switching device SA2. The anode of the low side auxiliary switching device SA2 is connected to the negative electrode of the first constant-voltage source E1. The two auxiliary switching devices SA1 and SA2 do not need to be installed, similarly to the scan pulse generating sections 1A and 1B according to Embodiments 1-3. In that case, the anode of the low side scan switching device SC2 is coupled directly to the negative electrode of the first constant-voltage source E1, and connected through the first constant-voltage source E1 to the cathode of the high side scan switching device SC1. The low side auxiliary switching device SA2 may further be connected between the positive electrode of the first constant-voltage source E1 and the cathode of the high side scan switching device SC1, aside from the position shown in FIG. 16. In that case, the negative electrode of the first constant-voltage source E1 is coupled directly to the anode of the low side scan switching device SC2.

The reset pulse generating section 2D includes a protection diode Dn, second and third constant-voltage sources E2 and E3, a first positive voltage source Eu, and two reset switch sections Q5 and Q7, in addition to the negative voltage source En, the two ramp wave generating sections QR1 and QR2, and the second bypass switching device QB2. The protection diode Dn prevents a current from flowing from the negative voltage source En toward the first constant-voltage source E1, thereby preventing the ground fault of the first constant-voltage source E1 through the negative voltage source En when the positive electrode of the first constant-voltage source E1 is grounded through the second separation switching device QS2 and the first low side sustain switching device Q2. The second constant-voltage source E2 has an output voltage V2 equal to the difference between the upper limit Vr of the reset voltage pulse and the upper limit Vs of the sustaining voltage pulse (=the potential of the power supply section Es): V2=Vr−Vs, similarly to the second constant-voltage source E2 according to Embodiments 1 and 2 (cf. FIGS. 2, 5, and 6). The third constant-voltage source E3 maintains its positive terminal at a potential higher than that of its negative terminal by a constant voltage V3, based on the output voltage Vs of the power supply section Es, by using, for example, a DC-DC converter (not shown). The voltage V3 is equal to the voltage V1 of the first constant-voltage source E1 and lower than the voltage V2 of the second constant-voltage source E2:V3=V1<V2. The first positive voltage source Eu maintains its output terminal at a constant potential Vu, based on the output voltage Vs of the power supply section Es, by using, for example, a DC-DC converter (not shown). The potential Vu is lower than the upper limit Vs of the sustaining voltage pulse: Vu<Vs. Any of the two reset switch sections Q5 and Q7 is a two-way switch, and includes, for example, a series connection of two switching devices. Each of the switching devices is preferably a MOSFET, or alternatively, may be an IGBT or a bipolar transistor connected to a diode in parallel. In each of the reset switch sections, the anodes or cathodes of the two switching devices are connected to each other, and then, the switching devices are turned on and off in synchronization with each other. The two reset switch sections Q5 and Q7 may be a parallel connection of two IGBTs or bipolar transistors. In that case, the collector of one of the two transistors is connected to the emitter of the other.

The negative voltage source En is connected to the cathode of the protection diode Dn. The anode of the protection diode Dn is connected to the anodes of the low side ramp wave generating section QR2 and the second bypass switching device QB2. Both the cathodes of the second bypass switching device QB2 and the low side ramp wave generating section QR2 are connected to both the anode of the low side auxiliary switching device SA2 and the negative electrode of the first constant-voltage source E1. The negative and positive electrodes of the second constant-voltage source E2 are connected to the output terminal J1 of the first sustaining pulse generating section 3A and the cathode of the high side ramp wave generating section QR1, respectively. The anode of the high side ramp wave generating section QR1 is connected to the cathode of the high side scan switching device SC1. The negative electrode of the third constant-voltage source E3 is connected to the output terminal J1 of the first sustaining pulse generating section 3A. The positive electrode of the third constant-voltage source E3 is connected through the first reset switch section Q5 to the cathode of the high side scan switching device SC1. The anode and cathode of the second separation switching device QS2 are connected to the output terminal J1 of the first sustaining pulse generating section 3A and the cathode of the high side scan switching device SC1. The first positive voltage source Eu is connected through the second reset switch section Q7 to the anode of the second separation switching device QS2.

In the scan electrode driver section 11 according to Embodiment 5 of the invention, a path running from the output terminal J1 of the first sustaining pulse generating section 3A through the second separation switching device QS2 to the cathode of the high side scan switching device SC1 is used as a sustaining voltage pulse transmission path, in contrast to the scan electrode driver sections 11 according Embodiments 1-3. On the other hand, a path running from the anode of the high side ramp wave generating section QR1 to the cathode of the high side scan switching device SC1 is used as a high side reset pulse transmission path. Furthermore, a path running from the cathode of the low side ramp wave generating section QR2 through the low side auxiliary switching device SA2 to the anode of the low side scan switching device SC2 is used as a low side reset pulse transmission path. The first constant-voltage source E1 maintains the sustaining pulse transmission path J1-SC1 at a potential the constant voltage V1 higher than the potential of the low side reset pulse transmission path QR2-SA2-SC2.

The first power recovery section 4 has a circuitry exactly equivalent to the first power recovery section 4 according to Embodiment 1 (cf. FIGS. 2 and 3). Accordingly, in FIG. 16, an equivalent circuit of the first power recovery section 4 is omitted from illustration. For the details of the equivalent circuit, the explanation of Embodiment 1 and FIGS. 2 and 3 are cited. In particular, when the first power recovery section 4 includes two inductors L1 and L2 as shown in FIG. 3B, their second ends 41 and 42 may be connected to the same node or separate nodes. In FIG. 16, the second ends 41 and 42 of the inductors L1 and L2 are connected to one in common, or two separately, of the following, for example: the conducting path coupled directly to the output terminal J1 of the first sustaining pulse generating section 3A; the conducting path coupled directly to the cathode of the second separation switching device QS2 (e.g., the node J4); the conducting path coupled directly to the anode of the low side scan switching device SC2 (e.g., the node J8); and the conducting path coupled directly to the negative terminal of the first constant-voltage source E1 (e.g., the node J9).

A sustain electrode driver section 12 according to Embodiment 5 of the invention includes a reset/scan pulse generating section 2X and a separation switch section Q7X, in addition to the second sustaining pulse generating section 3X, in contrast to the sustain electrode driver section 12 according to Embodiment 1 (cf. FIG. 2). See FIG. 16. Other components are similar to the components according to Embodiment 1. In FIG. 16, the components similar to the components according to Embodiment 1 are marked with the same reference symbols as the reference symbols shown in FIG. 2. Furthermore, for the details of the similar components, the explanation of Embodiment 1 of the invention is cited. In particular, the second power recovery section 4X has the same circuitry as the second power recovery section 4X according to Embodiment 1 of the invention (cf. FIG. 2). Accordingly, in FIG. 16, an equivalent circuit of the second power recovery section 4X is omitted from illustration, and for the details of the equivalent circuit, the explanation of Embodiment 1 and FIG. 2 are cited.

The reset/scan pulse generating section 2X includes fourth and second constant-voltage sources Ec and Ed, a high side switching device Q5X, and a low side switching device Q6X. The fourth constant-voltage source Ec maintains its positive terminal at a potential higher than that of its negative terminal by a constant voltage Vc, based on the output voltage Vs of the power supply section Es, by using, for example, a DC-DC converter (not shown). The voltage Vc is lower than the output voltage Vs of the power supply section Es: Vc<Vs. The second positive voltage source Ed maintains its output terminal at a constant potential Vd, based on the output voltage Vs of the power supply section Es, by using, for example, a DC-DC converter (not shown). The potential Vd is sufficiently lower than any of the output voltage Vs of the power supply section Es and the voltage Vc of the fourth constant-voltage source Ec: Vd<<Vs, Vc. The two switching devices Q5X and Q6X are preferably MOSFETs, or alternatively, may be IGBTs or bipolar transistors. Further preferably, they are wide band gap semiconductor switching devices. The separation switch section Q7X is a two-way switch, and includes, for example, a series connection of two switching devices. Each of the switching devices is preferably a MOSFET, or alternatively, may be an IGBT or a bipolar transistor connected to a diode in parallel. In the separation switch section Q7X, the anodes or cathodes of the two switching devices are connected to each other, and the switching devices are turned on and off in synchronization with each other. The separation switch section Q7X may be a parallel connection of two IGBTs or bipolar transistors. In that case, the collector of one of the two transistors is connected to the emitter of the other.

The second positive voltage source Ed is connected to the cathode of the high side switching device Q5X. The anode of the high side switching device Q5X is connected to the cathode of the low side switching device Q6X. The anode of the low side switching device Q6X is grounded. The node J3X between the two switching devices Q5X and Q6X is connected to the negative electrode of the fourth constant-voltage source Ec. The positive electrode of the fourth constant-voltage source Ec is connected through the separation switch section Q7X to the sustain electrode X of the PDP 20.

Figure 17:
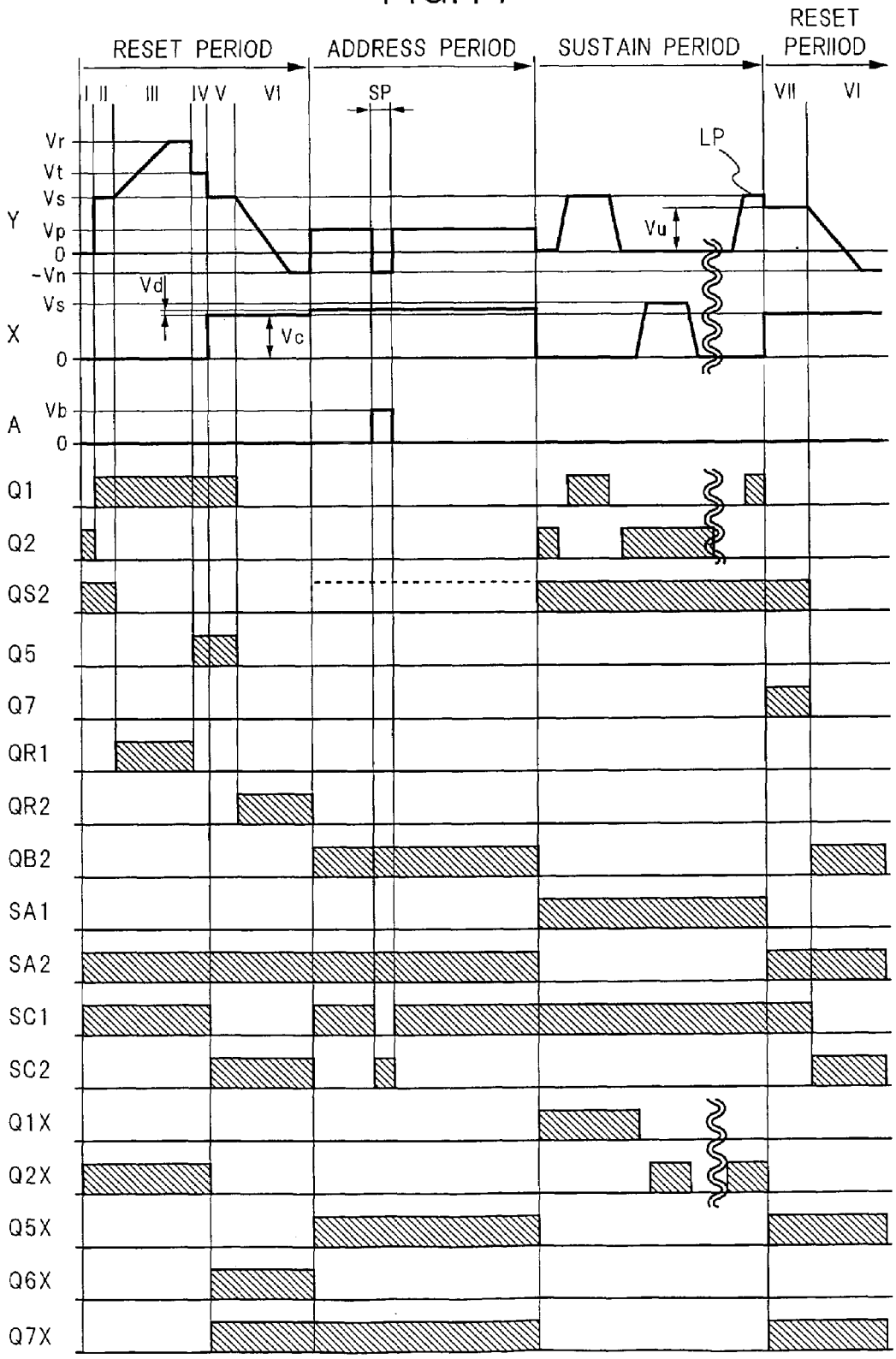
FIG. 17 is, regarding Embodiment 5 of the invention, a waveform chart that shows the voltages applied to the scan, sustain, and address electrodes Y, X, and A of the PDP 20, and the ON periods of the switching devices Q1, Q2, QS2, Q5, Q7, QR1, QR2, QB2, SA1, SA2, SC1, and SC2 included in the scan electrode driver section 11, and the ON periods of the switching devices Q1X, Q2X, Q5X, Q6X, and Q7X included in the sustain electrode driver section 12, in the reset, address, and sustain periods.

In the reset, address, and sustain periods, the potentials of the scan, sustain, and address electrodes Y, X, and A of the PDP 20 change as follows. See FIG. 17. In FIG. 17, hatched areas show the ON periods of the switching devices Q1, Q2, QS2, Q5, Q7, QR1, QR2, QB2, SA1, SA2, SC1, and SC2 included in the scan electrode driver section 11, and the switching devices Q1X, Q2X, Q5X, Q6X, and Q7X included in the sustain electrode driver section 12.

During the reset period, the application of the reset voltage pulses changes the potentials of the scan and sustain electrodes Y and X. On the other hand, the address electrode A is maintained at the ground potential (nearly equal to 0). Depending on the changes in the reset voltage pulse, the reset period is divided into the following six modes I-VI. The ON and OFF states of the switching devices are switched to each other mode by mode. Note that, during the reset period, in the scan electrode driver section 11, the second reset switch section Q7, the second bypass switching device QB2, and the high side auxiliary switching device SA1 are maintained in the OFF state, and the low side auxiliary switching device SA2 is maintained in the ON state, and in the sustain electrode driver section 12, the second high side sustain switching device Q1X and the high side switching device Q5X are maintained in the OFF state.

<Mode I>

In the scan electrode driver section 11, the first low side sustain switching device Q2, the second separation switching device QS2, and the high side scan switching device SC1 are turned on. Thereby, the sustaining pulse transmission path J1-SC1 and the scan electrode Y are maintained at the ground potential. In the sustain electrode driver section 12, the second low side sustain switching device Q2X is turned on. Thereby, the sustain electrode X is maintained at the ground potential.

<Mode II>

In the scan electrode driver section 11, the first low side sustain switching device Q2 is turned off, and the first high side sustain switching device Q1 is turned on. Thereby, the potentials of the sustaining pulse transmission path J1-SC1 and the scan electrode Y rise to the potential Vs of the power supply section Es. In the sustain electrode driver section 12, the state in the mode I is maintained, and accordingly, the sustain electrode X is maintained at the ground potential.

<Mode III>

In the scan electrode driver section 11, the second separation switching device QS2 is turned off, and the high side ramp wave generating section QR1 is turned on. Thereby, the potentials of the high side reset pulse transmission path QR1-SC1 and the scan electrode Y rise at a constant rate by the voltage V2 of the second constant-voltage source E2, and reach the upper limit Vr=Vs+V2 of the reset voltage pulse. In other words, the reset voltage pulse reaches the upper limit Vr in the ON period of the high side scan switching device SC1. The sustaining pulse transmission path J1-SC1 overlaps the high side reset pulse transmission path QR1-SC1. However, the second separation switching device QS2 is maintained in the OFF state, thereby cutting off a current to flow from the high side scan switching device SC1 toward the output terminal J1 of the first sustaining pulse generating section 3A. Accordingly, the potential of the part of the sustaining pulse transmission path connected to the cathode of the second separation switching device QS2 can reliably exceed the upper limit Vs of the sustaining voltage pulse. In other words, the reset voltage pulse reliably reaches its upper limit Vr, without being clamped to the upper limit Vs of the sustaining voltage pulse. At that time, the voltage across the second separation switching device QS2 is maintained at approximately the voltage V2 of the second constant-voltage source E2. In other words, the withstand voltage of the second separation switching device QS2 is sufficiently lower than the withstand voltage of the conventional separation switching device (approximately the upper limit Vr of the reset voltage pulse). In the sustain electrode driver section 12, the state in the mode II is maintained, and accordingly, the sustain electrode X is maintained at the ground potential. Thus, voltages applied to all the discharge cells of the PDP 20 uniformly rise to the upper limit Vr of the reset voltage pulse at a comparatively slow rate. Thereby, uniform wall charges accumulate in all the discharge cells of the PDP 20. At that time, the rising rate of the applied voltage is low, and thereby, the light emitted by the discharge cell is very feeble.

<Mode IV>

In the scan electrode driver section 11, the high side ramp wave generating section QR1 is turned off, and the first reset switch section Q5 is turned on. Thereby, the potentials of the high side reset pulse transmission path QR1-SC1 and the scan electrode Y fall to a potential Vt higher than the potential Vs of the power supply section Es by the voltage V3 of the third constant-voltage source E3: Vt=Vs+V3<Vs+V2=Vr. Here, the second separation switching device QS2 is maintained in the OFF state, and accordingly, the output terminal J1 of the first sustaining pulse generating section 3A is maintained at the potential Vs of the power supply section Es. In the sustain electrode driver section 12, the state in the mode III is maintained, and thereby, the sustain electrode X is maintained at the ground potential. Accordingly, the feeble light emission stops in the discharge cell of the PDP 20 since the voltage between the scan and sustain electrodes Y and X falls.

<Mode V>

In the scan electrode driver section 11, the high side scan switching device SC1 is turned off, and the low side scan switching device SC2 is turned on. In other words, the voltage is applied through the low side scan switching device SC2 to the scan electrode Y. In particular, the voltages cancel each other out between the first and third constant-voltage sources E1 and E3 (V1=V3), and thereby, the potential of the scan electrode Y falls to the potential Vs of the power supply section Es. The high side reset pulse transmission path, in particular the cathode of the high side scan switching device SC1, is maintained at the potential Vt=Vs+V3 in the mode IV. At that time, the second separation switching device QS2 is maintained in the OFF state, and accordingly, the output terminal J1 of the first sustaining pulse generating section 3A is maintained at the potential Vs of the power supply section Es. In the sustain electrode driver section 12, the second low side sustain switching device Q2X is turned off, and the low side switching device Q6X and the separation switch section Q7X are turned on. Thereby, the potential of the sustain electrode X rises by the voltage Vc of the fourth constant-voltage source Ec. Thus, the voltage Vs−Vc is applied between the scan and sustain electrodes Y and X in the discharge cell of the PDP 20.

In the modes IV-V, the potential of the scan electrode Y falls in two steps from the upper limit Vr of the reset voltage pulse to the potential Vs of the power supply section Es. Alternatively, the mode IV may be omitted, in other words, the potential of the scan electrode Y may fall in one step from the upper limit Vr of the reset voltage pulse to the potential Vs of the power supply section Es. Thereby, the reset time is reduced. When the mode IV is omitted, the series connection of the third constant-voltage source E3 and the first reset switch section Q5 may be omitted. At that time, in the mode V, the high side ramp wave generating section QR1 is maintained in the ON state, and the scan electrode Y is maintained at a potential Vr−V1 lower than the upper limit Vr of the reset voltage pulse by the voltage V1 of the first constant-voltage source E1.

<Mode VI>

In the scan electrode driver section 11, the first high-side-sustain and reset switching devices Q1 and Q5 are turned off, and the low side ramp wave generating section QR2 is turned on. Thereby, the potentials of the low side reset pulse transmission path QR2-SA2-SC2 and the scan electrode Y fall at a constant rate to the potential −Vn of the negative voltage source En (the lower limit of the reset voltage pulse). In other words, the reset voltage pulse reaches the lower limit −Vn in the ON period of the low side scan switching device SC2. Here, the part of the sustaining pulse transmission path J1-SC1 coupled directly to the cathode of the second separation switching device QS2, that is, the high side reset pulse transmission path QR1-SC1 is at a potential higher than the potential of the low side reset pulse transmission path QR2-SA2-SC2 by the voltage V1 of the first constant-voltage source E1. Accordingly, in the mode VI, the whole of the sustaining pulse transmission path J1-SC1 is maintained at a potential higher than the ground potential, regardless of the turning on and off of the second separation switching device QS2. In the sustain electrode driver section 12, the state in the mode V is maintained, and thereby, the sustain electrode X is maintained at the potential Vc in the mode V. Accordingly, the voltage opposite in polarity to the voltages applied in the modes II-V is applied to the discharge cell of the PDP 20. In particular, the applied voltage falls at a comparatively slow rate. Thereby, wall charges are uniformly eliminated and evened in all the discharge cells. At that time, the falling rate of the applied voltage is low, and therefore, the light emitted the discharge cell is very feeble. In particular, the lower limit −Vn of the reset voltage pulse is lower than the ground potential: −Vn<0. Accordingly, the voltages applied to the discharge cells of the PDP 20 are enhanced sufficiently high, and thereby, the wall charges are sufficiently eliminated. Alternatively, the voltage applied to the sustain electrodes X in the reset period may be reduced. Thereby, the power consumption is reduced.

In the mode V, the voltages cancel each other between the first and third constant-voltage sources E1 and E3: V1=V3. Accordingly, the potential of the scan electrode Y is equal to the potential Vs of the power supply section Es at the starts of the modes V and VI. Alternatively, the voltage V1 of the first constant-voltage source E1 may be higher than the voltage V3 of the third constant-voltage source E3: V1>V3. In that case, at the starts of the modes V and VI, the potential of the scan electrode Y is lower than the potential Vs of the power supply section Es by the difference V1−V3 of the voltage between two constant-voltage sources E1 and E3: Vs−(V1−V3). Thereby, the duration of the mode VI is reduced, and accordingly, the whole of the reset time is reduced.

During the address period, in the sustain electrode driver section 12, the high side switching device Q5X and the separation switch section Q7X are maintained in the ON state and the other switching devices Q1X, Q2X, and Q6X are maintained in the OFF state. Thereby, the sustain electrode X is maintained at the potential Vc+Vd higher than the potential Vd of the second positive voltage source Ed by the voltage Vc of the fourth constant-voltage source Ec.

During the address period, in the scan electrode driver section 11, the second bypass switching device QB2 and the low side auxiliary switching device SA2 are maintained in the ON state. Here, the second separation switching device QS2 may be maintained in the ON or OFF state. At that time, the anode of the low side scan switching device SC2 is maintained at the potential −Vn of the negative voltage source En, which is hereafter referred to as the lower limit of the scan voltage pulse. On the other hand, the part of the sustaining pulse transmission path J1-SC1 connected to the cathode of the second separation switching device QS2 (in particular, the cathode of the high side scan switching device SC1) is maintained at the potential Vp=V1−Vn higher than the lower limit −Vn of the scan voltage pulse by the voltage V1 of the first constant-voltage source E1. The potential Vp is hereafter referred to as the upper limit of the scan voltage pulse.

During the address period, the scan electrode driver section 11 changes the ON and OFF states of the scan switching devices SC1 and SC2 connected to the respective scan electrodes Y1, Y2, Y3, in sequence, similarly to the scan electrode driver section 11 according to Embodiment 2. Thus, the scan voltage pulses SP are applied to the scan electrodes Y1, Y2, Y3, . . . , one after another. The address electrode driver section 13 changes the potential of the selected address electrode A, similarly to the address electrode driver section 13 according to Embodiment 2. As a result of the above-described, new wall charges accumulate on the surfaces of the predetermined discharge cells.

During the sustain period, in the scan electrode driver section 11, the second separation switching device QS2 and the high-side auxiliary and scan switching devices SA1 and SC1 are maintained in the ON state, and the low side auxiliary switching device SA2 is maintained in the OFF state. Thereby, the output terminal J1 of the first sustaining pulse generating section 3A is connected to the scan electrode Y through the high side scan switching device SC1. In the scan electrode driver section 11, furthermore, the first sustaining pulse generating section 3A turns on and off the two sustain switching devices Q1 and Q2 alternately. As a result, the potential of the scan electrode Y changes between the potential Vs of the power supply section Es and the ground potential. At that time, the current to flow from the output terminal J1 of the first sustaining pulse generating section 3A toward the scan electrode Y can pass not only the high side scan switching device SC1 but also the body diode of the low side scan switching device SC2. Thereby, the occurrence of latch up due to the increase in the amount of current is effectively suppressed in the series connection 1S of the scan switching devices SC1 and SC2. In the sustain electrode driver section 12, the separation switch section Q7X is maintained in the OFF state, and the second sustaining pulse generating section 3X turns on and off the two sustain switching devices Q1X and Q2X alternately. As a result, the potential of the sustain electrode X changes between the potential Vs of the power supply section Es and the ground potential. The scan and sustain electrode driver sections 11 and 12 apply the sustaining voltage pulses alternately to the scan and sustain electrodes Y and X, respectively. At that time, in the discharge cells where the wall charges have accumulated during the address period, the discharge in gas and the accumulation of wall charge are repeated, and thus, the light emission of phosphor is sustained.

The above-described reset, address, and sustain periods are repeated, for example, sub-field by sub-field. Alternatively, as the following mode VII, for example, the sustaining voltage pulse applied to the scan electrode Y at the end of the sustain period may be used, instead of the reset voltage pulses in the above-described modes I-V of the reset period. See the mode VII shown in FIG. 17.

<Mode VII>

At the end of the sustain period, the mode VII of the next reset period starts under the condition where the last sustaining voltage pulse LP applied to the scan electrode Y has risen. Here, the last sustaining voltage pulse LP has a width narrower than the widths of the other sustaining voltage pulses. Thereby, in the discharge cells having glowed during the sustain period, the wall charges are eliminated at the start of the mode VII. In the scan electrode driver section 11, the first high side sustain switching device Q1 and the high side auxiliary switching device SA1 are turned off, and the second reset switch section Q7 and the low side auxiliary switching device SA2 are turned on. Thereby, the potentials of the sustaining pulse transmission path J1-SC1 and the scan electrode Y fall to the potential Vu of the first positive voltage source Eu. The potential Vu is lower than the upper limit Vs of the sustaining voltage pulse, and accordingly, the whole of the sustaining pulse transmission path J1-SC1 is maintained at the potential Vu with stability. In the sustain electrode driver section 12, the second low side sustain switching device Q2X is turned off, and the high side switching device Q5X and the separation switch section Q7X are turned on. Thereby, the potential of the sustain electrode X rises by the voltage Vc of the fourth constant-voltage source Ec. Thus, the potential Vu of the scan electrode Y is maintained a little higher than the potential Vc of the sustain electrode X in the mode VII, similarly in the mode V.

After the mode VII, the above-described mode VI is performed, and thus, the potential of the scan electrode Y falls at a constant rate to the lower limit −Vn (<0) of the reset voltage pulse. On the other hand, the sustain electrode X is maintained at the potential Vc (>0) in the mode VII. Accordingly, the voltages in the polarity opposite to that of the applied voltages in the mode VII are applied to the discharge cells of the PDP 20. Thereby, wall charges are uniformly eliminated and evened in all the discharge cells. At that time, the falling rate of the applied voltage is low, and therefore, the light emitted the discharge cell is very feeble. The light emission of the discharge cell in the mode VII and the just next mode VI is feebler than the light emission in the modes I-VI. During one field, for example, the reset in the modes I-VI may be performed only at the top sub-field, and the reset in the modes VII-VI may be performed at the remainder of the sub-fields.

In that case, the "black" level in brightness of the PDP 20 is reduced, and therefore, the contrast of the PDP 20 is improved.

In the PDP driver according to Embodiment 5 of the invention as described above, the sustaining pulse transmission path J1-SC1 is maintained at a potential equal to or above the ground potential, that is, the lower limit of the sustaining voltage pulse over both the reset and address periods. Accordingly, any substantial current does not flow out of the output terminal J1 of the first sustaining pulse generating section 3A. Therefore, the reset voltage pulse reliably reaches the lower limit −Vn, without being clamped to the lower limit of the sustaining voltage pulse, even if no separation switching devices for cutting off the current is installed. Thus, the number of the separation switching devices is reduced, and accordingly, the PDP driver according to Embodiment 5 of the invention has low conduction losses at the separation switching devices. Therefore, the PDP driver has the power consumption lower than that of the conventional driver. Furthermore, the PDP driver is easy to miniaturize because of the reduction in number of the separation switching devices. In addition, the ringing included in the voltage applied to the PDP is reduced since parasitic inductances caused by the circuit elements and lines on the sustaining pulse transmission path are reduced. As a result, the PDP driver according to Embodiment 5 of the invention has advantage in further improvement in high image quality of the plasma display.

In the above-described reset pulse generating section 2D according to Embodiment 5 of the invention, the series connection of the third constant-voltage source E3 and the first reset switch section Q5 is connected in parallel to the second separation switching device QS2 between the output terminal J1 of the first sustaining pulse generating section 3A and the cathode of the high side scan switching device SC1. Alternatively, the series connection of the third constant-voltage source E3 and the first reset switch section Q5 may be connected between the anode of the second separation switching device QS2 and the ground terminal. (The negative electrode of the third constant-voltage source E3 may be grounded.) In that case, the voltage V3 of the third constant-voltage source E3 is established, so that the sum of the voltage V3 of the third constant-voltage source E3 and the voltage V2=Vr−Vs of the second constant-voltage source E2 may be equal to the potential Vt of the scan electrode Y in the above-described mode IV: V3=Vt−V2=Vt-(Vr−Vs). During the modes IV and V of the reset period, the first high side sustain switching device Q1 is maintained in the OFF state, and the high side ramp wave generating section QR1 is maintained in the ON state. Thereby, the cathode of the high side scan switching device SC1 is maintained at the above-described potential Vt. Furthermore, in the case where the output voltage Vu of the first positive voltage source Eu may be equal to the voltage V3 of the third constant-voltage source E3, a common constant-voltage source may double as the first positive voltage source Eu and the third constant-voltage source E3. Thereby, the numbers of constant-voltage sources and two-way switches to be connected to the sources can be reduced.

Aside from the above-described, the series connection of the third constant-voltage source E3 and the first reset switch section Q5 may be connected between the cathode of the second separation switching device QS2 and the ground terminal. (The negative electrode of the third constant-voltage source E3 may be grounded.) In that case, the voltage V3 of the third constant-voltage source E3 is established equal to the potential Vt of the scan electrode Y in the above-described mode IV: V3=Vt. During the modes IV and V of the reset period, the cathode of the high side scan switching device SC1 is maintained at the above-described potential Vt, even if the first high side sustain switching device Q1 is maintained in the OFF state.

Embodiment 6

A plasma display according to Embodiment 6 of the invention comprises a configuration quite similar to that of the above-described plasma display according to Embodiment 1 (cf. FIG. 1). Accordingly, for the details of the configuration, the explanation of the above-described Embodiment 1 and FIG. 1 are cited.

A sustain electrode driver section according to Embodiment 6 of the invention (not shown) comprises a configuration quite similar to that of the sustain electrode driver section 12 according to Embodiment 1 (cf. FIG. 2). Accordingly, for the details of the configuration, the explanation of Embodiment 1 and FIG. 2 are cited.

Figure 18:
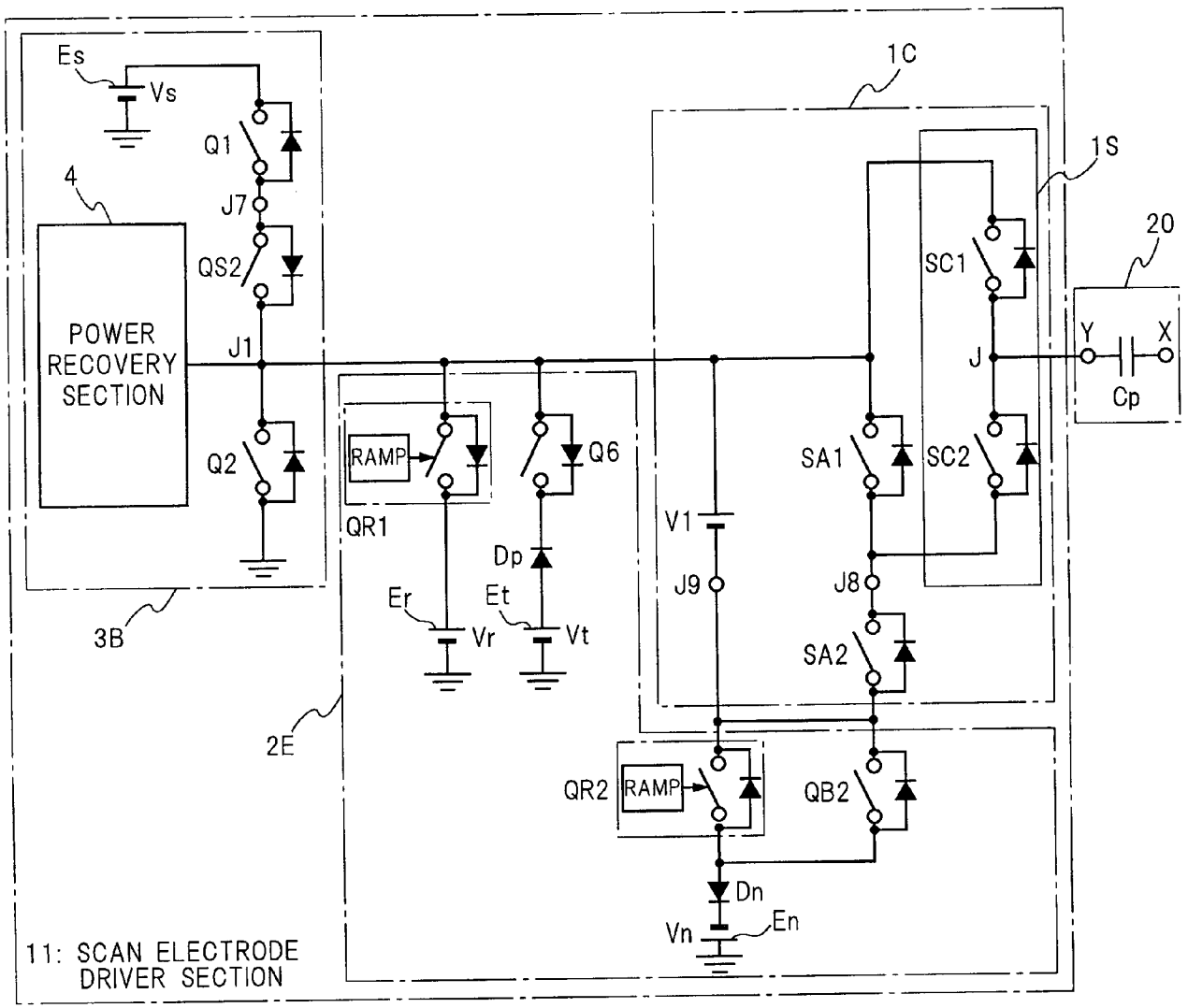
FIG. 18 is an equivalent circuit diagram that shows the scan electrode driver section 11 according to Embodiment 6 of the invention and the PDP 20.

In a scan electrode driver section 11 according to Embodiment 6 of the invention, the output terminal J1 of a first sustaining pulse generating section 3B is coupled directly to the cathode of a high side scan switching device SC1, in contrast to the scan electrode driver sections 11 according to Embodiments 1-3 and 5. See FIG. 18. A reset pulse generating section 2E includes a second positive voltage source Et similar to the positive voltage sources Et according to Embodiments 1 and 2 (cf. FIGS. 2, 5, and 6), and a second protection diode Dn similar to the protection diode Dn according to Embodiment 5 (cf. FIG. 16), in addition to components similar to the components of the reset pulse generating section 2C according to Embodiment 3 (cf. FIGS. 8-11). In the first sustaining pulse generating section 3B, the series connection of a second separation switching device QS2 and a first high side sustain switching device Q1 is installed between a power supply section Es and the output terminal J1, similarly to the second pattern of the connections according to Embodiment 2 (cf. FIG. 6). Other components are similar to the components according to Embodiments 1-3 and 5. In FIG. 18, the similar components are marked ith the same reference symbols as the reference symbols shown in FIGS. 2, 5, 6, 8-11, and 16. Furthermore, for the details of the similar components, the explanation of Embodiments 1-3 and 5 of the invention is cited. The first positive voltage source Er maintains its output terminal at a potential equal to the upper limit Vr of the reset voltage pulse. The first positive voltage source Er is connected to the cathode of the high side ramp wave generating section QR1. The anode of the high side ramp wave generating section QR1 is coupled directly to the cathode of the high side scan switching device SC1. The second positive voltage source Et maintains its output terminal at the constant potential Vt. The potential Vt is preferably higher than the potential Vs of the power supply section Es by the voltage V1 of the first constant-voltage source E1: Vt=Vs+V1. The second positive voltage source Et is connected to the anode of the first protection diode Dp. The cathode of the first protection diode Dp is connected to the cathode of the reset switching device Q6. The anode of the reset switching device Q6 is coupled directly to the cathode of the high side scan switching device SC1.

The first power recovery section 4 has a circuitry exactly equivalent to the first power recovery section 4 according to Embodiment 1 (cf. FIGS. 2 and 3). Accordingly, in FIG. 18, an equivalent circuit of the first power recovery section 4 is omitted from illustration. For the details of the equivalent circuit, the explanation of Embodiment 1 and FIGS. 2 and 3 are cited. In articular, when the first power recovery section 4 includes two inductors L1 and L2 as shown in FIG. 3B, their second ends 41 and 42 may be connected to the same node or separate nodes. In FIG. 18, the second ends 41 and 42 of the inductors L1 and L2 are connected to one in common, or two separately, of the following, for example: the conducting path coupled directly to the output terminal J1 of the first sustaining pulse generating section 3B; the node J7 between the first high side sustain switching device Q1 and the second separation switching device QS2; the conducting path coupled directly to the anode of the low side scan switching device SC2 (e.g., the node J8); and the conducting path coupled directly to the negative terminal of the first constant-voltage source E1 (e.g., the node J9). Note that, when the first high side sustain switching device Q1 and the second separation switching device QS2 are connected to each other in the polarity opposite to the polarity shown in FIG. 15, the first power recovery section 4 is not connected to the node J7 between the switching devices.

Figure 19:
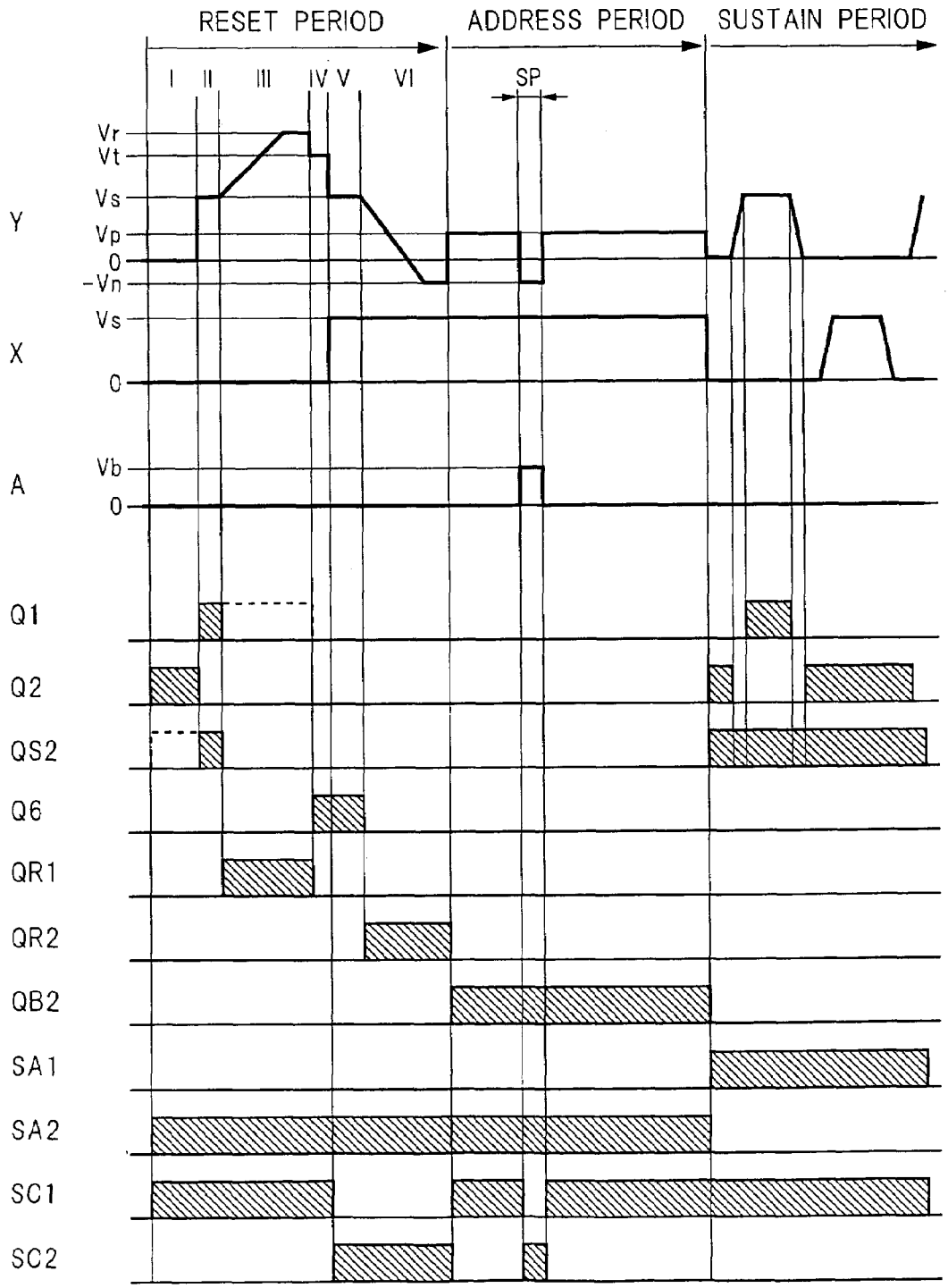
FIG. 19 is, regarding Embodiment 6 of the invention, a waveform chart that shows the voltages applied to the scan, sustain, and address electrodes Y, X, and A of the PDP 20, and the ON periods of the switching devices Q1, Q2, QS2, Q6, QR1, QR2, QB2, SA1, SA2, SC1, and SC2 included in the scan electrode driver section 11, in the reset, address, and sustain periods.

In the reset, address, and sustain periods, the potentials of the scan, sustain, and address electrodes Y, X, and A of the PDP 20 change as follows. See FIG. 19. In FIG. 19, hatched areas show the ON periods of the switching devices Q1, Q2, QS2, Q6, QR1, QR2, QB2, SA1, SA2, SC1, and SC2 included in the scan electrode driver section 11.

During the reset period, the application of the reset voltage pulses changes the potentials of the scan and sustain electrodes Y and X. On the other hand, the address electrode A is maintained at the ground potential (nearly equal to 0). Depending on the changes in the reset voltage pulse, the reset period is divided into the following six modes I-VI. The ON and OFF states of the switching devices included in the scan electrode driver section 11 are switched to each other mode by mode. Note that, during the reset period, the second bypass switching device QB2 and the high side auxiliary switching device SA1 are maintained in the OFF state, and the low side auxiliary switching device SA2 is maintained in the ON state.

<Mode I>

The first low side sustain switching device Q2 and the high side scan switching device SC1 are turned on, and then, the sustaining pulse transmission path J1-SC1 and the scan electrode Y are maintained at the ground potential. The second separation switching device QS2 does not need to be turned on.

<Mode II>

The first low side sustain switching device Q2 is turned off, and the first high side sustain switching device Q1 and the second separation switching device QS2 are turned on. Thereby, the potentials of the sustaining pulse transmission path J1-SC1 and the scan electrode Y rise to the potential Vs of the power supply section Es.

<Mode III>

The second separation switching device QS2 is turned off and the high side ramp wave generating section QR1 is turned on, and then, the potentials of the sustaining pulse transmission path J1-SC1 and the scan electrode Y rise at a constant rate from the potential Vs of the power supply section Es, and reach the potential Vr of the first positive voltage source Er (the upper limit of the reset voltage pulse). In other words, the reset voltage pulse reaches the upper limit Vr in the ON period of the high side scan switching device SC1. Here, in FIG. 18, the high side sustain switching device Q1 does not need to be turned on. Thus, voltages applied to all the discharge cells of the PDP 20 uniformly rise to the upper limit Vr of the reset voltage pulse at a comparatively slow rate. Thereby, uniform wall charges accumulate in all the discharge cells of the PDP 20. At that time, the rising rate of the applied voltage is low, and thereby, the light emitted by the discharge cell is very feeble.

The sustaining pulse transmission path J1-SC1 overlaps the high side reset pulse transmission path QR1-SC1. However, the second separation switching device QS2 is maintained in the OFF state, and thereby, the potential of the sustaining pulse transmission path J1-SC1 can reliably exceed the upper limit Vs of the sustaining voltage pulse. In other words, the reset voltage pulse reliably reaches its upper limit Vr, without being clamped to the upper limit Vs of the sustaining voltage pulse. At that time, the voltage across the second separation switching device QS2 is maintained at approximately the difference Vr−Vs between the upper limit Vr of the reset voltage pulse and the potential Vs of the power supply section Es. In other words, the withstand voltage of the second separation switching device QS2 is sufficiently lower than the withstand voltage of the conventional separation switching device (approximately the upper limit Vr of the reset voltage pulse). Accordingly, the second separation switching device QS2 has low conduction losses.

<Mode IV>

The high side ramp wave generating section QR1 is turned off and the reset switching device Q6 is turned on, and then, the potentials of the sustaining pulse transmission path J1-SC1 and the scan electrode Y fall to the potential Vt of the second positive voltage source Et.

<Mode V>

The high side scan switching device SC1 is turned off, and the low side scan switching device SC2 is turned on. In other words, the voltage is applied through the low side scan switching device SC2 to the scan electrode Y. The output voltage Vt of the second positive voltage source Et is applied through the first constant-voltage source E1 to the scan electrode Y, and then, the potential of the scan electrode Y falls to the potential Vs of the power supply section Es: Vs=Vt−V1. On the other hand, the sustaining pulse transmission path J1-SC1 is maintained at the potential Vt of the second positive voltage source Et. Thus, in the discharge cell of the PDP 20, the scan and sustain electrodes Y and X are maintained at the same potential Vs.

In the modes IV-V, the potential of the scan electrode Y falls in two steps from the upper limit Vr of the reset voltage pulse to the potential Vs of the power supply section Es. Alternatively, the mode IV may be omitted, in other words, the potential of the scan electrode Y may fall in one step from the upper limit Vr of the reset voltage pulse to the potential Vs of the power supply section Es. Thereby, the reset time is reduced. When the mode IV is omitted, the second positive voltage source Et, the first protection diode Dp, and the reset switching device Q6 may be omitted. At that time, in the mode V, the high side ramp wave generating section QR1 is maintained in the ON state, and the scan electrode Y is maintained at a potential Vr−V1 lower than the upper limit Vr of the reset voltage pulse by the voltage V1 of the first constant-voltage source E1.

<Mode VI>

The reset switching device Q6 is turned off and the low side ramp wave generating section QR2 is turned on, and thereby, the potentials of the low side reset pulse transmission path QR2-SA2-SC2 and the scan electrode Y fall at a constant rate to the potential −Vn of the negative voltage source En. In other words, the reset voltage pulse reaches its lower limit −Vn in the ON period of the low side scan switching device SC2. The potential of the sustaining pulse transmission path J1-SC1 is higher than the potential of the low side reset pulse transmission path QR2-SA2-SC2 by the voltage V1 of the first constant-voltage source E1. Accordingly, in the ode V1, the whole of the sustaining pulse transmission path J1-SC1 is maintained at a potential higher than the ground potential. In other words, the reset voltage pulse reliably reaches its lower limit −Vn, without being clamped to the ground potential (the lower limit of the sustaining voltage pulse). In the sustain electrode driver section 12, the state in the mode V is maintained, and thereby, the sustain electrode X is maintained at the potential Vs of the power supply section Es. Thus, the voltage opposite in polarity to the voltages applied in the modes II-V is applied to the discharge cell of the PDP 20. Thereby, wall charges are uniformly eliminated and evened in all the discharge cells. At that time, the falling rate of the applied voltage is low, and therefore, the light emitted the discharge cell is very feeble. In particular, the lower limit −Vn of the reset voltage pulse is lower than the ground potential: −Vn<0. Accordingly, the voltages applied to the discharge cells of the PDP 20 are enhanced sufficiently high, and thereby, the wall charges are sufficiently eliminated. Alternatively, the voltage applied to the sustain electrodes X in the reset period may be reduced. Thereby, the power consumption is reduced.

During the address and sustain periods, the scan electrode driver section 11 operates quite similarly to the scan electrode driver section 11 according to Embodiment 5. Accordingly, for the details, the explanation of Embodiment 5 is cited. Note that, when the first power recovery section 4 is not connected to the node J7 between the second separation switching device QS2 and the first high side sustain switching device Q1, the second separation switching device QS2 may be turned on and off in synchronization with the first high side sustain switching device Q1 during the sustain period. Furthermore, during the sustain period, the second separation switching device QS2 allows currents caused by the gas discharges in the PDP 20 to flow only in one direction. Accordingly, the second separation switching device QS2 has low conduction losses.

During the sustain time, the high side auxiliary switching device SA1 is maintained in the ON state, and accordingly, the current to flow from the output terminal J1 of the first sustaining pulse generating section 3B toward the scan electrode Y can pass not only the high side scan switching device SC1 but also the body diode of the low side scan switching device SC2. Thereby, the occurrence of latch up due to the increase in the amount of current is effectively suppressed in the series connection 1S of the scan switching devices SC1 and SC2.

In the PDP driver according to Embodiment 6 of the invention as described above, the sustaining pulse transmission path J1-SC1 is maintained at a potential equal to or above the ground potential, that is, the lower limit of the sustaining voltage pulse over both the reset and address periods. Accordingly, any substantial current does not flow out of the output terminal J1 of the first sustaining pulse generating section 3B. Therefore, the reset voltage pulse reliably reaches the lower limit −Vn, without being clamped to the lower limit of the sustaining voltage pulse, even if no separation switching device for cutting off the current is installed. Thus, the number of the separation switching devices is reduced, and accordingly, the PDP driver according to Embodiment 6 of the invention has low conduction losses at the separation switching devices. Therefore, the PDP driver has a power consumption lower than that of the conventional driver. Furthermore, the PDP driver is easy to miniaturize because of the reduction in number of the separation switching devices. In addition, the ringing included in the voltage applied to the PDP is reduced since parasitic inductances caused by the circuit elements and lines on the sustaining pulse transmission path are reduced. As a result, the PDP driver according to Embodiment 6 of the invention has advantage in further improvement in high image quality of the plasma display.

Embodiment 7

A plasma display according to Embodiment 7 of the invention comprises a configuration quite similar to that of the above-described plasma display according to Embodiment 1 (cf. FIG. 1). Accordingly, for the details of the configuration, the explanation of the above-described Embodiment 1 and FIG. 1 are cited.

A sustain electrode driver section according to Embodiment 7 of the invention (not shown) comprises a configuration quite similar to that of the sustain electrode driver section 12 according to Embodiment 1 (cf. FIG. 2). Accordingly, for the details of the configuration, the explanation of Embodiment 1 and FIG. 2 are cited.

In a scan electrode driver section 11 according to Embodiment 7 of the invention, a first sustaining pulse generating section 3E has two output terminals J11 and J12, in contrast to the scan electrode driver sections 11 according to Embodiments 1-6. See FIG. 20. The anode of the first high side sustain switching device Q1 is connected to the cathode of the high side scan switching device SC1 through the high side output terminal J11 and the second separation switching device QS2. In other words, the upper limit Vs of the sustaining voltage pulse is applied to the scan electrode Y through a path running from the high side output terminal J11 through the second separation switching device QS2 to the high side scan switching device SC1. The path is hereafter referred to as a high side sustaining pulse transmission path. The cathode of the first low side sustain switching device Q2 is connected to the anode of the low side scan switching device SC2 through the low side output terminal J12 and the first separation switching device QS1. In other words, the lower limit of the sustaining voltage pulse (=the ground voltage) is applied to the scan electrode Y through a path running from the low side output terminal J12 through the first separation switching device QS1 to the low side scan switching device SC2. The path is hereafter referred to as a low side sustaining pulse transmission path.

The first low-side-sustain and separation switching devices Q2 and QS1 may be connected in the reversed polarity; in other words, the cathode of the first separation switching device QS1 may be grounded and its anode may be connected to the anode of the first low side sustain switching device Q2, and the cathode of the first low side sustain switching device Q2 may be connected to the low side output terminal J12.

A scan pulse generating section 1B comprises a configuration quite similar to that of the scan pulse generating section 1B according to Embodiment 3 (cf. FIGS. 8-11). See FIG. 20. In particular, the high side sustaining pulse transmission path J11-QS2-SC1 is maintained at a potential higher than the potential of the low side sustaining pulse transmission path J12-QS1-SC2 by the voltage V1 of the first constant-voltage source E1.

A reset pulse generating section 2F has a configuration similar to that of the reset pulse generating section 2D according to Embodiment 5 (cf. FIG. 16), except that it does not include the series connection of the first positive voltage source Eu and the second reset switch section Q7, and the second protection diode Dn. See FIG. 20. The reset pulse generating section may alternatively have a configuration similar to that of the reset pulse generating section 2E according to Embodiment 6 (cf. FIG. 18). In that case, the first high side sustain switching device Q1 and the second separation switching device QS2 may be connected in the polarity opposite to the polarity shown in FIG. 20. In other words, the anode and cathode of the second separation switching device QS2 may be connected to the power supply section Es and the cathode of the first high side sustain switching device Q1, respectively, and the anode of the first high side sustain switching device Q1 may be connected to the high side output terminal J11.

Figure 20:
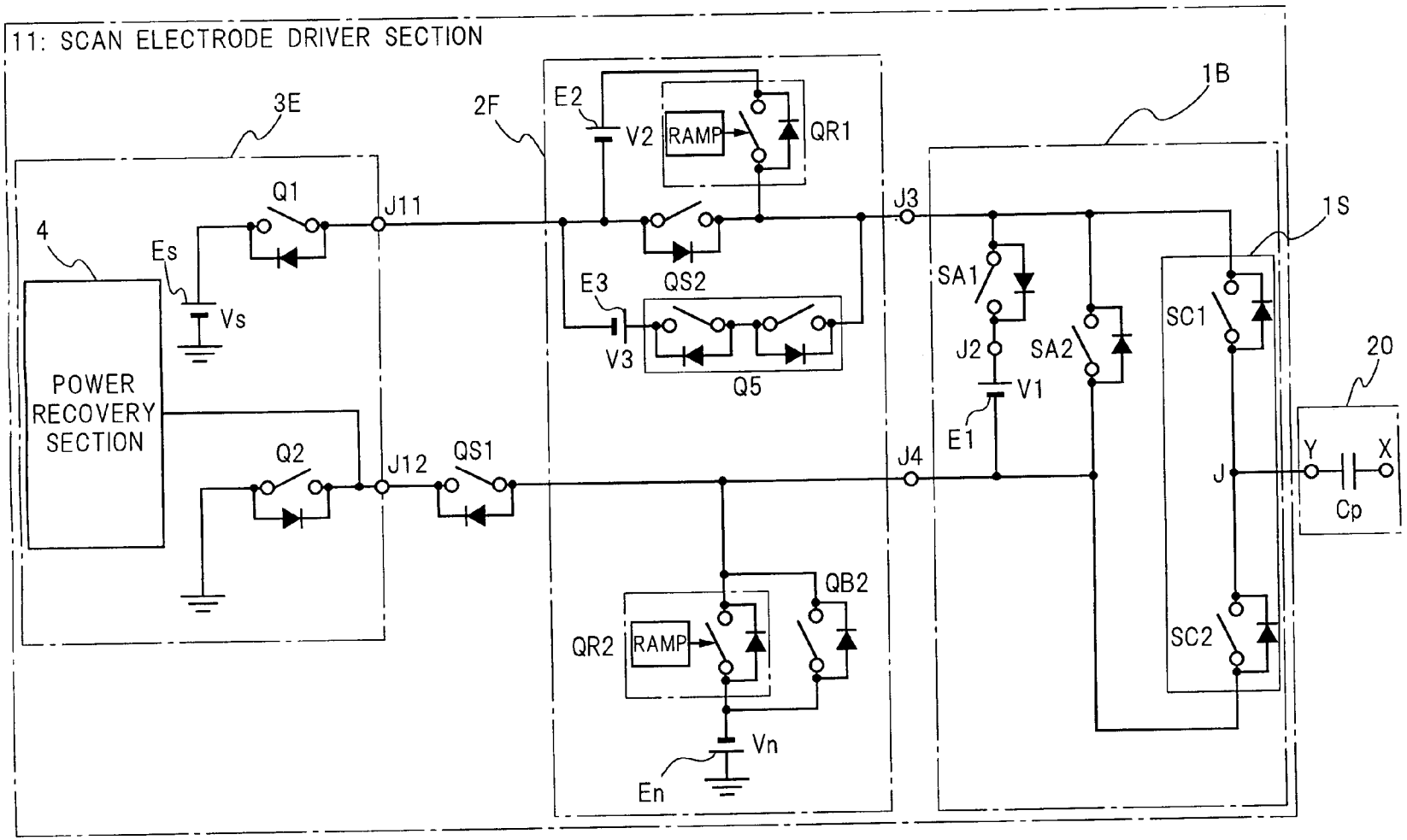
FIG. 20 is an equivalent circuit diagram that shows the scan electrode driver section 11 according to Embodiment 7 of the invention and the PDP 20.

Other components are similar to the components according to Embodiments 1-3, 5, and 6. In FIG. 20, the similar components are marked with the same reference symbols as the reference symbols shown in FIGS. 8-11 and 16. Furthermore, for the details of the similar components, the explanation of Embodiments 1-3, 5, and 6 of the invention is cited.

A first power recovery section 4 has a circuitry exactly equivalent to the first power recovery section 4 according to Embodiment 1 (cf. FIGS. 2 and 3). Accordingly, in FIG. 20, an equivalent circuit of the first power recovery section 4 is omitted from illustration. For the details of the equivalent circuit, the explanation of Embodiment 1 and FIGS. 2 and 3 are cited. In particular, when the first power recovery section 4 includes two inductors L1 and L2 as shown in FIG. 3B, their second ends 41 and 42 may be connected to the same node or separate nodes. In FIG. 20, the second ends 41 and 42 of the inductors L1 and L2 are connected to one in common, or two separately, of the following, for example: the conducting path coupled directly to the high side output terminal J11 of the first sustaining pulse generating section 3E; the conducting path coupled directly to the low side output terminals J12 of the first sustaining pulse generating section 3E; the conducting path coupled directly to the cathode of the high side scan switching device SC1 (e.g., the node J2); the conducting path coupled directly to the positive terminal of the first constant-voltage source E1 (e.g., the node J3); and the conducting path coupled directly to the negative terminal of the first constant-voltage source E1 (e.g., the node J4).

Figure 21:
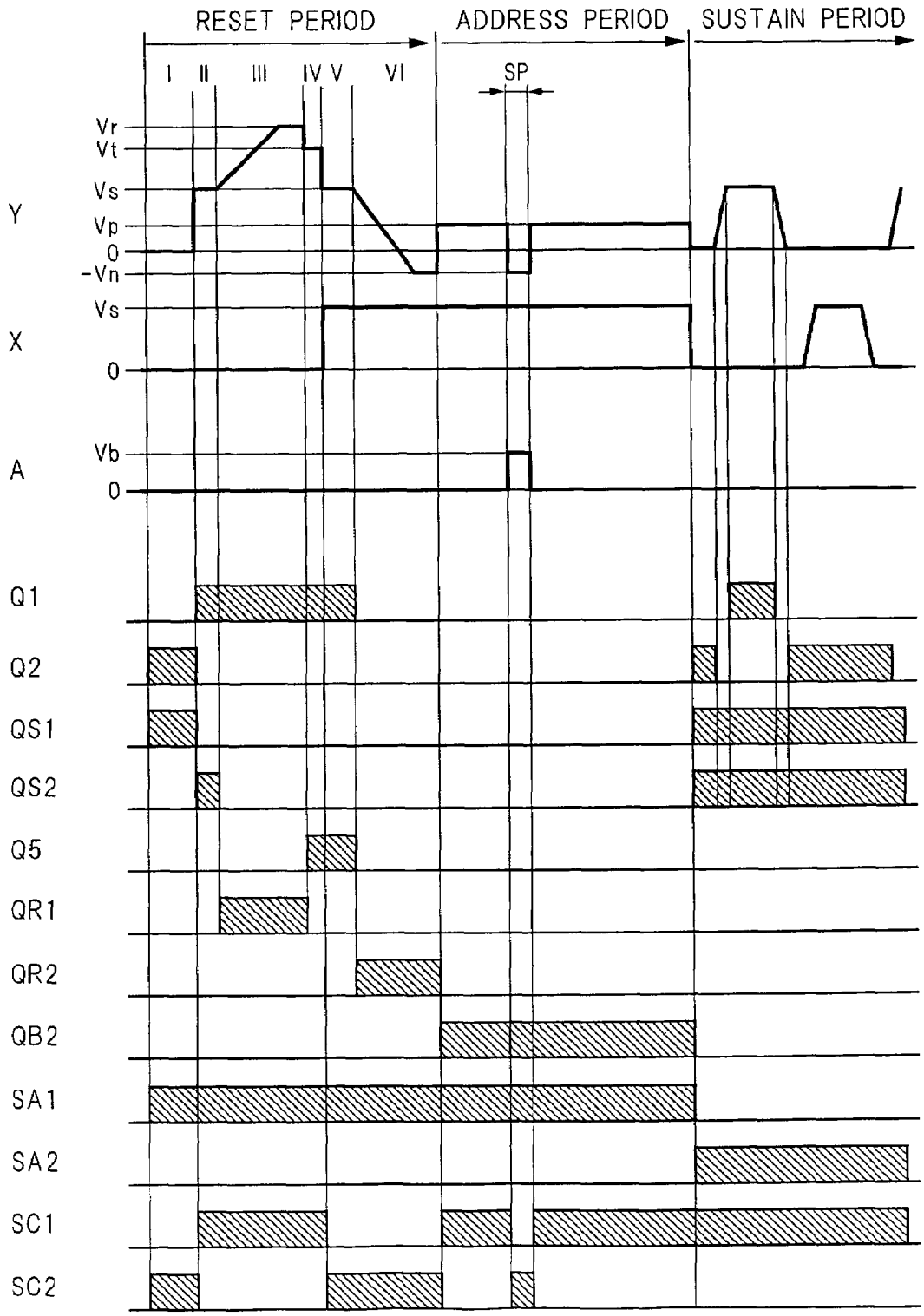
FIG. 21 is, regarding Embodiment 7 of the invention, a waveform chart that shows the voltages applied to the scan, sustain, and address electrodes Y, X, and A of the PDP 20, and the ON periods of the switching devices Q1, Q2, QS1, QS2, Q5, QR1, QR2, QB2, SA1, SA2, SC1, and SC2 included in the scan electrode driver section 11, in the reset, address, and sustain periods.

In the reset, address, and sustain periods, the potentials of the scan, sustain, and address electrodes Y, X, and A of the PDP 20 change as follows. See FIG. 21. In FIG. 21, hatched areas show the ON periods of the switching devices Q1, Q2, QS1, QS2, Q5, QR1, QR2, QB2, SA1, SA2, SC1, and SC2 included in the scan electrode driver section 11.

During the reset period, the application of the reset voltage pulses changes the potentials of the scan and sustain electrodes Y and X. On the other hand, the address electrode A is maintained at the ground potential (nearly equal to 0). Depending on the changes in the reset voltage pulse, the reset period is divided into the following six modes I-VI. The ON and OFF states of the switching devices included in the scan electrode driver section 11 are switched to each other mode by mode. Note that, during the reset period, the second bypass switching device QB2 is maintained in the OFF state.

<Mode I>

The first low-side-sustain and separation switching devices Q2 and QS1 and the low side scan switching device SC2 are turned on, and then, the low side sustaining pulse transmission path J12-QS1-SC2 and the scan electrode Y are maintained at the ground potential. On the other hand, the high side sustaining pulse transmission path J11-QS2-SC1 is maintained at a potential equal to or above the potential higher than the ground potential by the voltage V1 of the first constant-voltage source E1.

<Mode II>

The first low-side-sustain and separation switching devices Q2 and QS1 and the low side scan switching device SC2 are turned off, and the first high side sustain switching device Q1, the second separation switching device QS2, and the high side scan switching device SC1 are turned on. Thereby, the high side sustaining pulse transmission path J11-QS2-SC1 is maintained at the potential Vs of the power supply section Es, and accordingly, the potential of the scan electrode Y rises to the potential Vs of the power supply section Es. On the other hand, the low side sustaining pulse transmission path J12-QS1-SC2 is maintained a potential Vs−V1 lower than the potential Vs of the power supply section Es by the voltage V1 of the first constant-voltage source E1.

<Mode III>

The second separation switching device QS2 is turned of f and the high side ramp wave generating section QR1 is turned on, and thereby, the potentials of the high side reset pulse transmission path QR1-SC1 and the scan electrode Y rise at a constant rate by the voltage V2 of the second constant-voltage source E2, and reach the upper limit Vr=Vs+V2 of the reset voltage pulse. In other words, the reset voltage pulse reaches its upper limit Vr in the ON period of the high side scan switching device SC1. Thus, voltages applied to all the discharge cells of the PDP 20 uniformly rise to the upper limit Vr of the reset voltage pulse at a comparatively slow rate. Thereby, uniform wall charges accumulate in all the discharge cells of the PDP 20. At that time, the rising rate of the applied voltage is low, and thereby, the light emitted by the discharge cell is very feeble.

A part QS2-SC1 of the high side sustaining pulse transmission path J11-QS2-SC1 overlaps the high side reset pulse transmission path QR1-SC1. However, since the second separation switching device QS2 is maintained in the OFF state, the cathode potential of the high side scan switching device SC1 can reliably exceed the upper limit Vs of the sustaining voltage pulse. In other words, the reset voltage pulse reliably reaches the upper limit Vr, without being clamped to the upper limit Vs of the sustaining voltage pulse. At that time, the voltage across the second separation switching device QS2 is maintained at approximately the voltage V2=Vr−Vs of the second constant-voltage source E2. In other words, the withstand voltage of the second separation switching device QS2 is sufficiently lower than the withstand voltage of the conventional separation switching device (approximately the upper limit Vr of the reset voltage pulse). Accordingly, the second separation switching device QS2 has low conduction losses. On the other hand, the potential of the low side sustaining pulse transmission path J12-QS1-SC2 rises to the potential Vr−V1 lower than the upper limit Vr of the reset voltage pulse by the voltage V1 of the first constant-voltage source E1.

<Mode IV>

In the scan electrode driver section 11, the high side ramp wave generating section QR1 is turned off, and the first reset switch section Q5 is turned on. Thereby, the potentials of the high side reset pulse transmission path QR1-SC1 and the scan electrode Y fall to the potential Vt higher than the potential Vs of the power supply section Es by the voltage V3 of the third constant-voltage source E3: Vt=Vs+V3<Vs+V2=Vr. Here, since the second separation switching device QS2 is maintained in the OFF state, the high side output terminal J11 is maintained at the potential Vs of the power supply section Es. On the other hand, the potential of the low side sustaining pulse transmission path J12-QS1-SC2 falls to a potential Vt−V1 lower than the potential Vt=Vs+V3=Vs+V1 of the high side reset pulse transmission path QR1-SC1 by the voltage V1 of the first constant-voltage source E1, that is, the potential Vs of the power supply section Es. In the sustain electrode driver section 12, the state in the mode III is maintained, and thereby, the sustain electrode X is maintained at the ground potential. Accordingly, the feeble light emission stops in the discharge cell of the PDP 20 since the voltage between the scan and sustain electrodes Y and X falls.

<Mode V>

In the scan electrode driver section 11, the high side scan switching device SC1 is turned off, and the low side scan switching device SC2 is turned on. In other words, the voltage is applied through the low side scan switching device SC2 to the scan electrode Y. In particular, the voltages cancel each other out between the first and third constant-voltage sources E1 and E3 (V1=V3), and thereby, the low side sustaining pulse transmission path J12-QS1-SC2 is maintained at the potential Vs of the power supply section Es. Accordingly, the potential of the scan electrode Y falls to the potential Vs of the power supply section Es. On the other hand, the high side reset pulse transmission path QR1-SC1 is maintained at the potential Vt=Vs+V3 in the mode IV. However, since the second separation switching device QS2 is maintained in the OFF state, the high side output terminal J11 is maintained at the potential Vs of the power supply section Es. In the sustain electrode driver section 12, the second low side sustain switching device Q2X is turned off (cf. FIG. 2), and thereby, the potential of the sustain electrode X rises to the potential Vs of the power supply section Es. Thus, the scan and sustain electrodes Y and X are maintained at the same potential Vs.

In the modes IV-V, the potential of the scan electrode Y falls in two steps from the upper limit Vr of the reset voltage pulse to the potential Vs of the power supply section Es. Alternatively, the mode IV may be omitted, in other words, the potential of the scan electrode Y may fall in one step from the upper limit Vr of the reset voltage pulse to the potential Vs of the power supply section Es. Thereby, the reset time is reduced. When the mode IV is omitted, the series connection of the third constant-voltage source E3 and the first reset switch section Q5 may be omitted. In that case, in the mode V, the high side ramp wave generating section QR1 is maintained in the ON state, and thereby, the scan electrode Y is maintained at a potential Vr−V1 lower than the upper limit Vr of the reset voltage pulse by the voltage V1 of the first constant-voltage source E1.

<Mode VI>

In the scan electrode driver section 11, the first high-side-sustain and reset switching devices Q1 and Q5 are turned off, and the low side ramp wave generating section QR2 is turned on. Thereby, both the potentials of the low side reset pulse transmission path QR2-SC2 and the scan electrode Y fall at a constant rate to the potential −Vn of the negative voltage source En (the lower limit of the reset voltage pulse). In other words, the reset voltage pulse reaches its lower limit −Vn in the ON period of the low side scan switching device SC2.

The low side sustaining pulse transmission path J12-QR1-SC2 overlaps the low side reset pulse transmission path QR2-SC2. However, the first separation switching device QS1 is maintained in the OFF state, thereby cutting off the current to flow from the low side output terminal J12 toward the low side scan switching device SC2. Accordingly, the potential of the part of the low side reset pulse transmission path QR2-SC2 connected to the anode of the first separation switching device QS1 can reliably fall to the negative potential −Vn. In other words, the reset voltage pulse reliably reaches its lower limit −Vn, without being clamped to the ground potential, that is, the lower limit of the sustaining voltage pulse.

In the sustain electrode driver section 12, the state in the mode V is maintained, and thereby, the sustain electrode X is maintained at the potential Vs of the power supply section Es. Thus, the voltage opposite in polarity to the voltages applied in the modes II-V is applied uniformly to all the discharge cells of the PDP 20. Thereby, wall charges are uniformly eliminated and evened in all the discharge cells. At that time, the falling rate of the applied voltage is low, and therefore, the light emitted the discharge cell is very feeble. In particular, the lower limit −Vn of the reset voltage pulse is lower than the ground potential: −Vn<0. Accordingly, the voltages applied to the discharge cells of the PDP 20 are enhanced sufficiently high, and thereby, the wall charges are sufficiently eliminated. Alternatively, the voltages applied to the sustain electrode X during the reset period may be reduced. Thereby, the power consumption is reduced.

In the mode V, the voltages cancel each other between the first and third constant-voltage sources E1 and E3: V1=V3. Accordingly, the potential of the scan electrode Y is equal to the potential Vs of the power supply section Es at the starts of the modes V and VI. Alternatively, the voltage V1 of the first constant-voltage source E1 may be higher than the voltage V3 of the third constant-voltage source E3: V1>V3. In that case, at the starts of the modes V and VI, the potential of the scan electrode Y is lower than the potential Vs of the power supply section Es by the difference V1−V3 between the voltages of the two constant-voltage sources E1 and E3: Vs−(V1−V3). Thereby, the duration of the mode VI is reduced, and accordingly, the whole of the reset time is reduced.

During the address and sustain periods, the scan electrode driver section 11 operates quite similarly to the scan electrode driver section 11 according to Embodiment 4. Accordingly, for the details, the explanation of Embodiment 4 is cited.

During the sustain period, in particular, each of the separation switching devices QS1 and QS2 allows currents caused by the gas discharges in the PDP 20 to flow only in one direction, and accordingly, the two separation switching devices QS1 and QS2 both have low conduction losses.

During the sustain period, both the two separation switching devices QS1 and QS2 are maintained in the ON state. Alternatively, when the first power recovery section 4 is not coupled directly to the low side output terminal J12, the first separation switching device QS1 may be turned on and off, in synchronization with the first low side sustain switching device Q2. Similarly, when the first power recovery section 4 is not coupled directly to the high side output terminal J11, the second separation switching device QS2 may be turned on and off, in synchronization with the first high side sustain switching device Q1.

In FIG. 21, during the sustain period, the high side auxiliary switching device SA1 and the low side scan switching device SC2 are maintained in the OFF state, and the low side auxiliary switching device SA2 and the high side scan switching device SC1 are maintained in the ON state. At that time, the current to flow from the high side output terminal J11 of the first sustaining pulse generating section 3E toward the scan electrode Y can pass not only the high side scan switching device SC1 but also the body diode of the low side scan switching device SC2. The two scan switching devices SC1 and SC2 may maintain the reversed ON and OFF states. In that case, the current to flow from the scan electrode Y toward the low side output terminal J12 of the first sustaining pulse generating section 3E can pass not only the low side scan switching device SC2 but also the body diode of the high side scan switching device SC1. In any of the cases, the occurrence of latch up due to the increase in the amount of current is effectively suppressed in the series connection 1S of the scan switching devices SC1 and SC2.

Alternatively, during the sustain period, the high- and low-side scan switching devices SC1 and SC2 may be turned on when the first high- and low-side sustain switching devices Q1 and Q2 are turned on, respectively. Note that any of the two scan switching devices SC1 and SC2 is maintained in the ON state during the period when both the two sustain switching devices Q1 and Q2 are maintained in the OFF state (the dead time). The scan switching device in the ON state passes a current caused by the resonance of the panel capacitance Cp of the PDP 20 and the inductor included in the first power recovery section 4 (cf. FIG. 3).

Embodiment 8

A plasma display according to Embodiment 8 of the invention comprises a configuration quite similar to that of the above-described plasma display according to Embodiment 1 (cf. FIG. 1). Accordingly, for the details of the configuration, the explanation of the above-described Embodiment 1 and FIG. 1 are cited.

A sustain electrode driver section according to Embodiment 8 of the invention (not shown) comprises a configuration quite similar to that of the sustain electrode driver section 12 according to Embodiment 1 (cf. FIG. 2). Accordingly, for the details of the configuration, the explanation of Embodiment 1 and FIG. 2 are cited.

Figure 22:
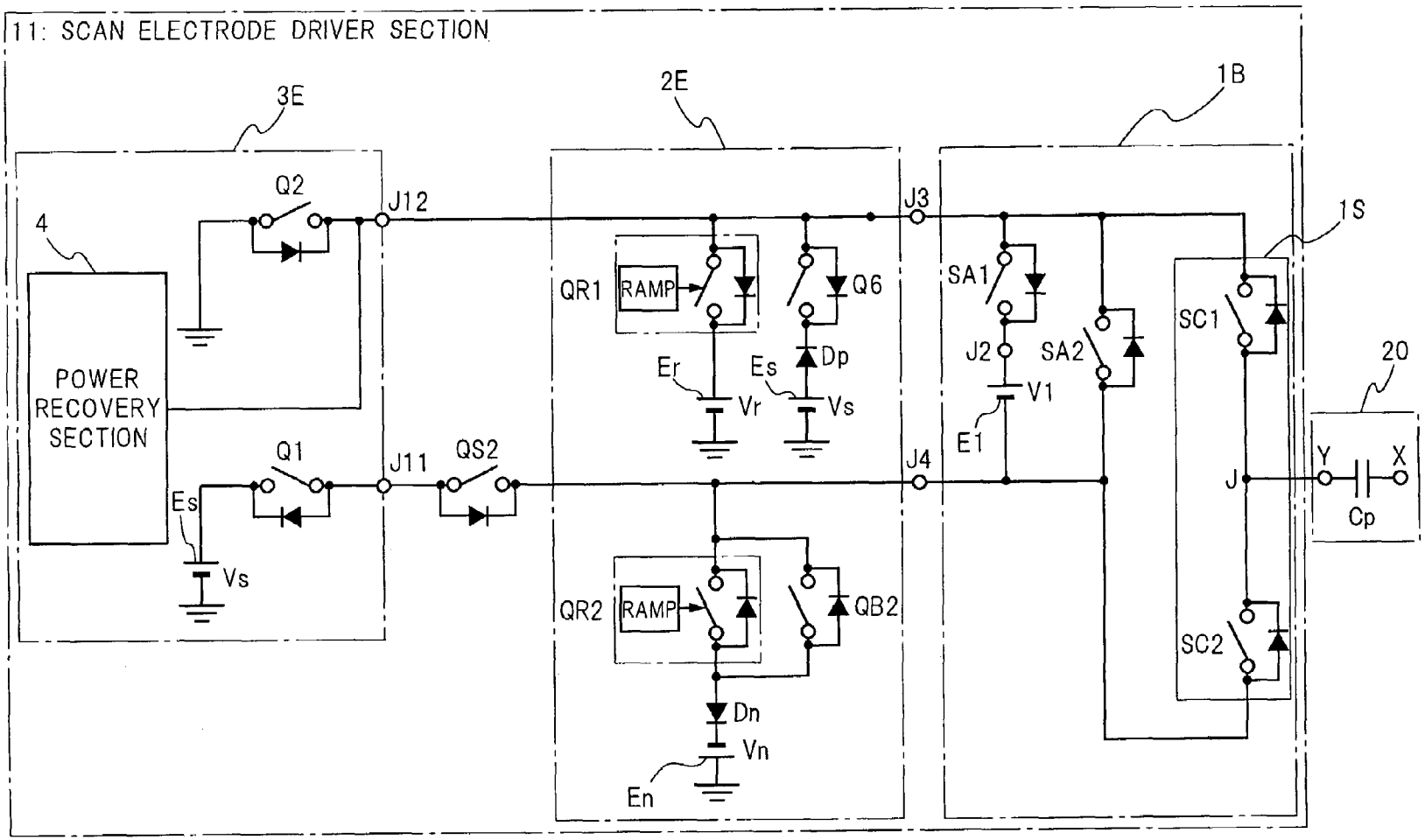
FIG. 22 is an equivalent circuit diagram that shows the scan electrode driver section 11 according to Embodiment 8 of the invention and the PDP 20.

A scan electrode driver section 11 according to Embodiment 8 of the invention has the configurations of the scan and first-sustaining pulse generating sections 1B and 3E in common with the scan electrode driver section 11 according to Embodiment 7 (cf. FIG. 20). See FIG. 22. However, the scan electrode driver section 11 according to Embodiment 8 does not include a first separation switching device QS1 in contrast to the scan electrode driver section 11 according to Embodiment 7. Furthermore, a reset pulse generating section 2E has the configuration similar to that of the reset pulse generating section 2E according to Embodiment 5 (cf. FIG. 18). However, the power supply section Es (or a positive voltage source at a potential equal to the potential Vs of the power supply section Es) is connected to the first protection diode Dp, instead of the second positive voltage source Et. In addition, the two output terminals J11 and J12 of the first sustaining pulse generating section 3E are connected to the series connection 1S of the two scan switching devices SC1 and SC2 in the polarity opposite to the polarity in the scan electrode driver section 11 according to Embodiment 7 (cf. FIG. 20) as follows. The high side output terminal J11 is connected to the anode of the low side scan switching device SC2 through the second separation switching device QS2. In other words, the upper limit Vs of the sustaining voltage pulse is applied to the scan electrode Y through a path running from the high side output terminal J11 through the second separation switching device QS2 to the low side scan switching device SC2. The path is hereafter referred to as a high side sustaining pulse transmission path. The low side output terminal J12 is coupled directly to the cathode of the high side scan switching device SC1. In other words, the lower limit of the sustaining voltage pulse (=the ground voltage) is applied to the scan electrode Y through a path from the low side output terminal J12 to the high side scan switching device SC1. The path is hereafter referred to as a low side sustaining pulse transmission path. The high side sustaining pulse transmission path J11-QS2-SC2 is maintained at a potential lower than the potential of the low side sustaining pulse transmission path J12-SC1 by the voltage V1 of the first constant-voltage source E1. The first high side sustain switching device Q1 and the second separation switching device QS2 may be connected in the polarity opposite to the polarity shown in FIG. 22. In other words, the anode and cathode of the second separation switching device QS2 may be connected to the power supply section Es and the cathode of the first high side sustain switching device Q1, respectively, and the anode of the first high side sustain switching device Q1 may be connected to the high side output terminal J11. Other components are similar to the components according to Embodiments 1-7. In FIG. 22, the similar components are marked with the same reference symbols as the reference symbols shown in FIGS. 18 and 20. Furthermore, for the details of the similar components, the explanation of Embodiments 1-7 of the invention is cited.

The first power recovery section 4 has a circuitry exactly equivalent to the first power recovery section 4 according to Embodiment 1 (cf. FIGS. 2 and 3). Accordingly, in FIG. 22, an equivalent circuit of the first power recovery section 4 is omitted from illustration. For the details of the equivalent circuit, the explanation of Embodiment 1 and FIGS. 2 and 3 are cited. In particular, when the first power recovery section 4 includes two inductors L1 and L2 as shown in FIG. 3B, their second ends 41 and 42 may be connected to the same node or separate nodes. In FIG. 22, the second ends 41 and 42 of the inductors L1 and L2 are connected to one in common, or two separately, of the following, for example: the conducting path coupled directly to the high side output terminal J11 of the first sustaining pulse generating section 3E; the conducting path coupled directly to the low side output terminals J12 of the first sustaining pulse generating section 3E; the conducting path coupled directly to the positive terminal of the first constant-voltage source E1 (e.g., the node J3); and the conducting path coupled directly to the negative terminal of the first constant-voltage source E1 (e.g., the node J4).

Figure 23:
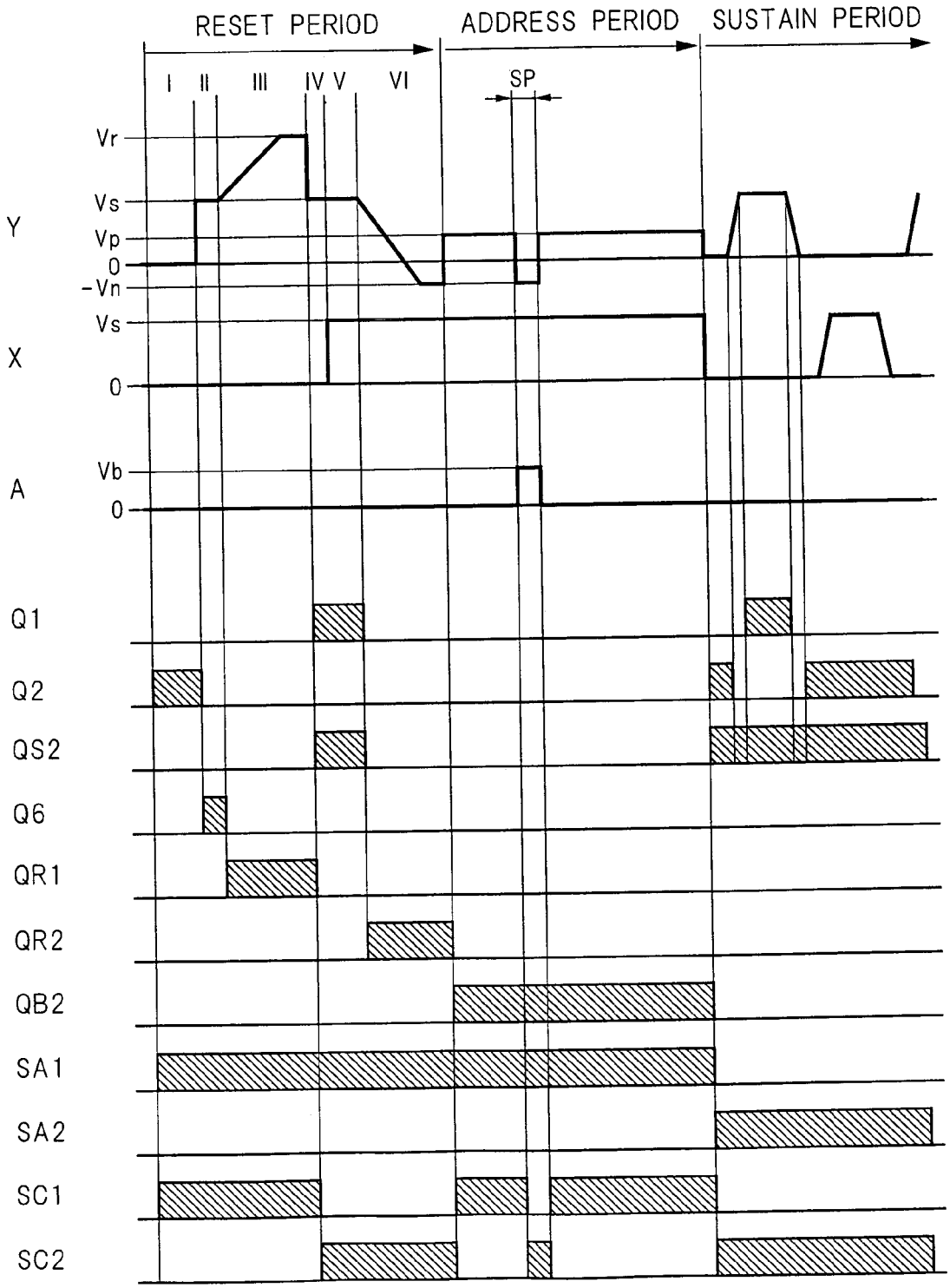
FIG. 23 is, regarding Embodiment 8 of the invention, a waveform chart that shows the voltages applied to the scan, sustain, and address electrodes Y, X, and A of the PDP 20, and the ON periods of the switching devices Q1, Q2, QS2, Q6, QR1, QR2, QB2, SA1, SA2, SC1, and SC2 included in the scan electrode driver section 11, in the reset, address, and sustain periods.

In the reset, address, and sustain periods, the potentials of the scan, sustain, and address electrodes Y, X, and A of the PDP 20 change as follows. See FIG. 23. In FIG. 23, hatched areas show the ON periods of the switching devices Q1, Q2, QS2, Q6, QR1, QR2, QB2, SA1, SA2, SC1, and SC2 included in the scan electrode driver section 11.

During the reset period, the application of the reset voltage pulses changes the potentials of the scan and sustain electrodes Y and X. On the other hand, the address electrode A is maintained at the ground potential (nearly equal to 0). Depending on the changes in the reset voltage pulse, the reset period is divided into the following six modes I-VI. The ON and OFF states of the switching devices included in the scan electrode driver section 11 are switched to each other mode by mode. Note that, during the reset period, the second bypass switching device QB2 and the low side auxiliary switching device SA2 are maintained in the OFF state, and the high side auxiliary switching device SA1 is maintained in the ON state.

<Mode I>

The first low side sustain switching device Q2 and the high side scan switching device SC1 are turned on. Thereby, the low side sustaining pulse transmission path J12-SC1 and the scan electrode Y are maintained at the ground potential. On the other hand, the high side sustaining pulse transmission path J11-QS2-SC2 is maintained at a potential lower than the ground potential by the voltage V1 of the first constant-voltage source E1 or more.

<Mode II>

The first low side sustain switching device Q2 is turned off, and the reset switching device Q6 is turned on. Thereby, the potentials of the low side sustaining pulse transmission path J12-SC1 and the scan electrode Y rise to the potential Vs of the power supply section Es. On the other hand, the potential of the high side sustaining pulse transmission path J11-QS2-

SC2 rises to the potential Vs−V1 lower than the potential Vs of the power supply section Es by the voltage VI of the first constant-voltage source E1.

<Mode III>

The reset switching device Q6 is turned of f, and the high side ramp wave generating section QR1 is turned on. Thereby, the potentials of the high side reset pulse transmission path QR1-SC1, that is, the low side sustaining pulse transmission path J12-SC1, and the scan electrode Y rise at a constant rate, and reach the upper limit Vr of the reset voltage pulse. In other words, the reset voltage pulse reaches its upper limit Vr in the ON period of the high side scan switching device SC1. Thus, voltages applied to all the discharge cells of the PDP 20 uniformly rise to the upper limit Vr of the reset voltage pulse at a comparatively slow rate. Thereby, uniform wall charges accumulate in all the discharge cells of the PDP 20. At that time, the rising rate of the applied voltage is low, and thereby, the light emitted by the discharge cell is very feeble.

When the difference Vr−V1 between the upper limit Vr of the reset voltage pulse and the voltage Vi of the first constant-voltage source E1 is lower than the potential Vs of the power supply section Es (Vr−V1<Vs), the potential of the high side sustaining pulse transmission path J11-QS2-SC2 is maintained at a potential equal to or below the upper limit Vs of the sustaining voltage pulse. Accordingly, the reset voltage pulse is not clamped to the upper limit Vs of the sustaining voltage pulse, and therefore, the second separation switching device QS2 does not need to be installed. Thereby, the number of separation switching devices is reduced. When the difference Vr−V1 between the upper limit Vr of the reset voltage pulse and the voltage V1 of the first constant-voltage source E1 is higher than the potential Vs of the power supply section Es (Vr−V1>Vs), in the part QS2-SC1 of the high side sustaining pulse transmission path J11-QS2-SC1 connected to the cathode of the second separation switching device QS2, the potential can exceed the upper limit Vs of the sustaining voltage pulse. However, since the second separation switching device QS2 is maintained in the OFF state, the cathode potential of the high side scan switching device SC1 can reliably exceed the upper limit Vs of the sustaining voltage pulse. In other words, the reset voltage pulse reliably reaches the upper limit Vr, without being clamped to the upper limit Vs of the sustaining voltage pulse. In that case, the voltage across the second separation switching device QS2 is maintained approximately at the difference Vr−V1−Vs between the potential Vr−V1, which is lower than the upper limit Vr of the reset voltage pulse by the voltage V1 of the first constant-voltage source E1, and the potential Vs of the power supply section Es. In other words, the withstand voltage of the second separation switching device QS2 is sufficiently lower than the withstand voltage of the conventional separation switching device (approximately the upper limit Vr of the reset voltage pulse). Accordingly, the second separation switching device QS2 has low conduction losses.

<Mode IV>

In the scan electrode driver section 11, the high side ramp wave generating section QR1 and the high side scan switching device SC1 are turned off, and the first high side sustain switching device Q1, the second separation switching device QS2, and the low side scan switching device SC2 are turned on. Thereby, the high side sustaining pulse transmission path J11-QS2-SC2 is maintained at the potential Vs of the power supply section Es, and accordingly, the potential of the scan electrode Y falls to the potential Vs of the power supply section Es. The low side sustaining pulse transmission path J12-SC1 is maintained at a potential higher than the potential Vs of the high side sustaining pulse transmission path J11-QS2-SC2 by the voltage V1 of the first constant-voltage source E1. In the sustain electrode driver section 12, the state in the mode III is maintained, and thereby, the sustain electrode X is maintained at the ground potential. Accordingly, the feeble light emission stops in the discharge cell of the PDP 20 since the voltage between the scan and sustain electrodes Y and X falls.

<Mode V>

In the scan electrode driver section 11, the state in the mode IV is maintained, and thereby, the scan electrode Y is maintained at the potential Vs of the power supply section Es. In the sustain electrode driver section 12, the second low side sustain switching device Q2X is turned off (cf. FIG. 2), and then, the potential of the sustain electrode X rises to the potential Vs of the power supply section Es. Thus, the scan and sustain electrodes Y and X are maintained at the same potential Vs.

<Mode VI>

In the scan electrode driver section 11, the first high side sustain switching device Q1 and the second separation switching device QS2 are turned off, and the low side ramp wave generating section QR2 is turned on. Thereby, both the potentials of the low side reset pulse transmission path QR2-SC2 and the scan electrode Y fall at a constant rate to the potential −Vn of the negative voltage source En (the lower limit of the reset voltage pulse). In other words, the reset voltage pulse reaches its lower limit −Vn in the ON period of the low side scan switching device SC2. The potential of the low side sustaining pulse transmission path J12-SC1 is higher than the potential of the low side reset pulse transmission path QR2-SC2 by the voltage V1 of the first constant-voltage source E1, and in particular, higher than the ground potential. Accordingly, the potential of the low side reset pulse transmission path QR2-SC2 can fall reliably to the negative potential −Vn, even if there is no separation switching device for cutting off the current to flow from the low side sustaining pulse transmission path J12-SC1 to the low side output terminal J12. In other words, the reset voltage pulse reliably reaches its lower limit −Vn, without being clamped to the ground potential, that is, the lower limit of the sustaining voltage pulse. Thus, the number of separation switching devices is reduced. In the sustain electrode driver section 12, the state in the mode V is maintained, and thereby, the sustain electrode X is maintained at the potential Vs of the power supply section Es. Thus, the voltage opposite in polarity to the voltages applied in the modes II-V is applied uniformly to all the discharge cells of the PDP 20. Thereby, wall charges are uniformly eliminated and evened in all the discharge cells. At that time, the falling rate of the applied voltage is low, and therefore, the light emitted the discharge cell is very feeble. In particular, the lower limit −Vn of the reset voltage pulse is lower than the ground potential: −Vn<0. Accordingly, the voltages applied to the discharge cells of the PDP 20 are enhanced sufficiently high, and thereby, the wall charges are sufficiently eliminated. Alternatively, the voltages applied to the sustain electrode X during the reset period may be reduced. Thereby, the power consumption is reduced.

During the address and sustain periods, the scan electrode driver section 11 operates quite similarly to the scan electrode driver section 11 according to Embodiment 4. Accordingly, for the details, the explanation of Embodiment 4 is cited. During the sustain period, in particular, the second separation switching device QS2 allows currents caused by the gas discharges in the PDP 20 to flow only in one direction, and accordingly, the second separation switching device QS2 has low conduction losses.

During the sustain period, the second separation switching device QS2 is maintained in the ON state. Alternatively, when the first power recovery section 4 is not coupled directly to the high side output terminal J11, the second separation switching device QS2 may be turned on and off, in synchronization with the first high side sustain switching device Q1.

In FIG. 23, during the sustain period, the high-side auxiliary and scan switching devices SA1 and SC1 are maintained in the OFF state, and the low-side auxiliary and scan switching devices SA2 and SC2 are maintained in the ON state. At that time, the current to flow from the scan electrode Y toward the low side output terminal J12 of the first sustaining pulse generating section 3E can pass not only the low side scan switching device SC2 but also the body diode of the high side scan switching device SC1. The two scan switching devices SC1 and SC2 may maintain the reversed ON and OFF states. At that time, the current to flow from the high side output terminal J11 of the first sustaining pulse generating section 3E toward the scan electrode Y can pass not only the high side scan switching device SC1 but also the body diode of the low side scan switching device SC2. In any of the cases, the occurrence of latch up due to the increase in the amount of current is effectively suppressed in the series connection 1S of the scan switching devices SC1 and SC2.

Alternatively, during the sustain period, the high- and low-side scan switching devices SC1 and SC2 may be turned on when the first high- and low-side sustain switching devices Q1 and Q2 re turned on, respectively. Note that either of the two scan switching devices SC1 and SC2 is maintained in the ON state during the period when both the two sustain switching devices Q1 and Q2 are maintained in the OFF state (the dead time). The scan switching device in the ON state passes a current caused by the resonance of the panel capacitance Cp of the PDP 20 and the inductor included in the first power recovery section 4 (cf. FIG. 3).

In the PDP driver according to Embodiment 8 of the invention as described above, especially the low side sustaining pulse transmission path J12-SC1 is maintained at a potential equal to or above the lower limit of the sustaining voltage pulse (=the ground potential) over both the reset and address periods, and thus, any substantial current does not flow through the low side output terminal J12 into the first sustaining pulse generating section 3E. Accordingly, the reset voltage pulse reliably reaches the lower limit −Vn, without being clamped to the lower limit of the sustaining voltage pulse, even if no separation switching device for cutting off the current is installed, in contrast to the conventional driver (cf. FIG. 24). Thus, the number of the separation switching devices is reduced, and accordingly, the PDP driver according to Embodiment 8 of the invention has the low conduction losses at the separation switching devices. Therefore, the PDP driver has the power consumption lower than that of the conventional driver. Furthermore, the PDP driver is easy to miniaturize because of the reduction in number of the separation switching devices. In addition, the ringing included in the voltage applied to the PDP is reduced since parasitic inductances caused by the circuit elements and lines on the sustaining pulse transmission path are reduced. As a result, the PDP driver according to Embodiment 8 of the invention has advantage in further improvement in high image quality of the plasma display.

The second inverter B3 and the wired OR circuit W may connect between the transmission paths of the first and second control signals CT1 and CT2 in the scan electrode driver section 11 according to Embodiment 8 of the invention, similarly in the scan electrode driver section 11 according to Embodiment 4. See FIG. 14. Thereby, both the two auxiliary switching devices SA1 and SA2 can be maintained in the OFF state during the ON period of the high side ramp wave generating section QR1 without changing the configuration of the auxiliary switch driving section DR1. See FIG. 15. As a result, the series circuit consisting of the reset switching devices Q6 and the protection diodes Dp, which is connected to the power supply section Es, may be eliminated, similarly in FIG. 13.

The above-described disclosure of the invention in terms of the presently preferred embodiments is not to be interpreted as intended for limiting. Various alterations and modifications will no doubt become apparent to those skilled in the art to which the invention pertains, after having read the disclosure. As a corollary to that, such alterations and modifications apparently fall within the true spirit and scope of the invention. Furthermore, it is to be understood that the appended claims be intended as covering the alterations and modifications.

As described above, the present invention relates to a PDP driver, and according to the invention, its pulse generating sections are connected to each other in patterns different from that in the conventional drivers. As is clear from this, the invention has industrial applicability.

The invention claimed is:

1. A plasma display panel (PDP) driver comprising:

a scan pulse generating section including high- and low-side scan switching devices connected in series, whose node is connected to a scan electrode of a PDP, turning on said high- and low-side scan switching devices alternately at a predetermined timing, and applying a scan voltage pulse to said scan electrode;

a sustaining pulse generating section turning on one of said high- and low-side scan switching devices and applying a sustaining voltage pulse to said scan electrode; and a reset pulse generating section turning on said high- and low-side scan switching devices alternately at a predetermined timing and applying to said scan electrode a reset voltage pulse reaching its upper and lower limits in the ON periods of said high- and low-side scan switching devices, respectively, wherein said scan pulse generating section further includes:

a constant-voltage source which includes an negative electrode connected to said low side scan switching device and which maintains a constant voltage between a positive electrode and said negative electrode, a high side auxiliary switching device which connects said positive electrode of said constant-voltage source to said high side scan switching device, a low side auxiliary switching device which connects between both ends of the series connection of said high- and low-side scan switching devices, and an auxiliary switch driving section which turns on and off said high- and low-side auxiliary switching devices alternately; and wherein said reset pulse generating section, when raising said reset voltage pulse to its upper limit, suppresses the turn-on of said high side auxiliary switching device by said auxiliary switch driving section, so as to turn off both of said high- and low-side auxiliary switching devices.

2. The PDP driver according to claim 1 wherein said reset pulse generating section comprises:

a high side ramp wave generating section raising a voltage applied to said high side scan switching device at a predetermined rate, and a low side ramp wave generating section lowering a voltage applied to said low side scan switching device at a predetermined rate.

3. The PDP driver according to claim 1 wherein the upper and lower limits of said sustaining voltage pulse are applied to said scan pulse generating section through a common sustaining pulse transmission path connecting between said sustaining pulse generating section and said low side scan switching device.

4. The PDP driver according to claim 3 wherein:

said sustaining pulse generating section includes a high side sustain switching device connected to an external power supply and provided with a voltage equal to the upper limit of said sustaining voltage pulse a low side sustain switching device connected to one of an external power supply and a ground conductor, and provided with a voltage equal to the lower limit of said sustaining voltage pulse; and said high- and low-side sustain switching devices are connected in series and their node is connected to said low side scan switching device through said sustaining pulse transmission path.

5. The PDP driver according to claim 3 wherein the lower limit of said reset voltage pulse is, at the lowest, equal to the lower limit of said sustaining voltage pulse.

6. The PDP driver according to claim 3 further comprising a first separation switching device, in the case of the lower limit of said reset voltage pulse lower than the lower limit of said sustaining voltage pulse, cutting off a current to flow from said sustaining pulse generating section through said sustaining pulse transmission path to said low side scan switching device during a period of said reset voltage pulse below the lower limit of said sustaining voltage pulse.

7. The PDP driver according to claim 3 further comprising:

a constant-voltage source including positive and negative electrodes connected to said high- and low-side scan switching devices, respectively, and maintaining a constant voltage between said positive and negative electrodes; and a second separation switching device, in the case where the difference between the upper limit of said reset voltage pulse and the voltage of said constant-voltage source is higher than the upper limit of said sustaining voltage pulse, cutting off a current to flow from the negative electrode of said constant-voltage source through said sustaining pulse transmission path to said sustaining pulse generating section during a period of said reset voltage pulse exceeding the sum of the voltage of said constant-voltage source and the upper limit of said sustaining voltage pulse.

8. The PDP driver according to claim 1, wherein said reset pulse generating section further comprises:

a high side ramp wave generating section which raises a voltage applied to said high side scan switching device at a predetermined rate, and a reset switch driving section which turns said high side ramp wave generating section on and off, and in particular when turning it on, suppresses the turn-on of said high side auxiliary switching device by said auxiliary switch driving section.

9. The PDP driver according to claim 1 wherein the upper and lower limits of said sustaining voltage pulse are applied to said scan pulse generating section through a common sustaining pulse transmission path connecting between said sustaining pulse generating section and said high side scan switching device.

10. The PDP driver according to claim 9 wherein:

said sustaining pulse generating section includes a high side sustain switching device connected to an external power supply and provided with a voltage equal to the upper limit of said sustaining voltage pulse, and a low side sustain switching device connected to one of an external power supply and a ground conductor, and provided with a voltage equal to the lower limit of said sustaining voltage pulse; and said high- and low-side sustain switching devices are connected in series and their node is connected through said sustaining pulse transmission path to said high side scan switching device.

11. The PDP driver according to claim 9 further comprising a second separation switching device cutting off a current to flow from said high side scan switching device through said sustaining pulse transmission path to said sustaining pulse generating section during a period of said reset voltage pulse exceeding the upper limit of said sustaining voltage pulse.

12. The PDP driver according to claim 9 further comprising, in the case of the lower limit of said reset voltage pulse lower than the lower limit of said sustaining voltage pulse, a constant-voltage source including positive and negative electrodes connected to said high- and low-side scan switching devices, respectively, and maintaining a voltage between said positive and negative electrodes, at the lowest, equal to the difference between the lower limits of said sustaining and reset voltage pulses.

13. The PDP driver according to claim 1 wherein:

the upper limit of said sustaining voltage pulse is applied to said scan pulse generating section through a high side sustaining pulse transmission path connecting between said sustaining pulse generating section and said high side scan switching device; and the lower limit of said sustaining voltage pulse is applied to said scan pulse generating section through a low side sustaining pulse transmission path connecting between said sustaining pulse generating section and said low side scan switching device.

14. The PDP driver according to claim 13 wherein said sustaining pulse generating section includes a high side sustain switching device connected between an external power supply and said high side scan switching device and provided with a voltage equal to the upper limit of said sustaining voltage pulse, and a low side sustain switching device connected between said low side scan switching device and one of an external power supply and a ground conductor, and provided with a voltage equal to the lower limit of said sustaining voltage pulse.

15. The PDP driver according to claim 13 wherein the lower limit of said reset voltage pulse is, at the lowest, equal to the lower limit of said sustaining voltage pulse.

16. The PDP driver according to claim 13 further comprising a first separation switching device, in the case of the lower limit of said reset voltage pulse lower than the lower limit of said sustaining voltage pulse, cutting off a current to flow from said sustaining pulse generating section through said low side sustaining pulse transmission path to said low side scan switching device during a period of said reset voltage pulse below the lower limit of said sustaining voltage pulse.

17. The PDP driver according to claim 13 further comprising a second separation switching device cutting off a current to flow from said high side scan switching device through said high side sustaining pulse transmission path to said sustaining pulse generating section during a period of said reset voltage pulse exceeding the upper limit of said sustaining voltage pulse.

18. The PDP driver according to claim 1 wherein:

the upper limit of said sustaining voltage pulse is applied to said scan pulse generating section through a high side sustaining pulse transmission path connecting between said sustaining pulse generating section and said low side scan switching device; and the lower limit of said sustaining voltage pulse is applied to said scan pulse generating section through a low side sustaining pulse transmission path connecting between said sustaining pulse generating section and said high side scan switching device.

19. The PDP driver according to claim 18 wherein said sustaining pulse generating section includes a high side sustain switching device connected between an external power supply and said low side scan switching device, and provided with a voltage equal to the upper limit of said sustaining voltage pulse, and a low side sustain switching device connected between said high side scan switching device and one of an external power supply and a ground conductor, and provided with a voltage equal to the lower limit of said sustaining voltage pulse.

20. The PDP driver according to claim 18 further comprising, in the case of the lower limit of said reset voltage pulse lower than the lower limit of said sustaining voltage pulse, a constant-voltage source including positive and negative electrodes connected to said high and low side scan switching device, respectively, and maintaining the voltage between said positive and negative electrodes, at the lowest, equal to the difference between the lower limits of said sustaining and reset voltage pulses.

21. The PDP driver according to claim 18 further comprising:

a constant-voltage source including positive and negative electrodes connected to said high- and low-side scan switching devices, respectively, and maintaining a constant voltage between said positive and negative electrodes; and a second separation switching device, in the case where the difference between the upper limit of said reset voltage pulse and the voltage of said constant-voltage source is higher than the upper limit of said sustaining voltage pulse, cutting off a current to flow from the negative electrode of said constant-voltage source to said sustaining pulse generating section during a period of said reset voltage pulse exceeding the sum of the voltage of said constant-voltage source and the upper limit of said sustaining voltage pulse.

22. A plasma display comprising:

a PDP comprising a discharge cell emitting light due to a electric discharge in gas filling its inside, and sustain and scan electrodes for applying reset, scan, and sustaining voltage pulses to said discharge cell; and a PDP driver comprising:

a scan pulse generating section including high- and low-side scan switching devices connected in series, whose node is connected to said scan electrode, turning on said high- and low-side scan switching devices alternately at a predetermined timing, and applying a scan voltage pulse to said scan electrode;

a sustaining pulse generating section turning on one of said high- and low-side scan switching devices and applying a sustaining voltage pulse to said scan electrode; and a reset pulse generating section turning on said high- and low-side scan switching devices alternately at a predetermined timing and applying to said scan electrode a reset voltage pulse reaching its upper and lower limits in the ON periods of said high- and low-side scan switching devices, respectively, wherein said scan pulse generating section further includes:

a constant-voltage source which includes an negative electrode connected to said low side scan switching device and which maintains a constant voltage between a positive electrode and said negative electrode, a high side auxiliary switching device which connects said positive electrode of said constant-voltage source to said high side scan switching device, a low side auxiliary switching device which connects between both ends of the series connection of said high- and low-side scan switching devices, and an auxiliary switch driving section which turns on and off said high- and low-side auxiliary switching devices alternately; and wherein said reset pulse generating section, when raising said reset voltage pulse to its upper limit, suppresses the turn-on of said high side auxiliary switching device by said auxiliary switch driving section, so as to turn off both of said high- and low-side auxiliary switching devices.

23. The plasma display according to claim 22, wherein said reset pulse generating section further comprises:

a high side ramp wave generating section which raises a voltage applied to said high side scan switching device at a predetermined rate, and a reset switch driving section which turns said high side ramp wave generating section on and off, and in particular when turning it on, suppresses the turn-on of said high side auxiliary switching device by said auxiliary switch driving section.

* * * * *